US010204629B2

(12) United States Patent
Atti et al.

(10) Patent No.: US 10,204,629 B2
(45) **Date of Patent: *Feb. 12, 2019**

(54) AUDIO PROCESSING FOR TEMPORALLY MISMATCHED SIGNALS

(71) Applicant: QUALCOMM Incorporated, San Diego, CA (US)

(72) Inventors: Venkatraman Atti, San Diego, CA (US); Venkata Subrahmanyam Chandra Sekhar Chebiyyam, Santa Clara, CA (US); Daniel Jared Sinder, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/049,688

(22) Filed: Jul. 30, 2018

(65) Prior Publication Data

US 2018/0336907 A1 Nov. 22, 2018

Related U.S. Application Data

(63) Continuation of application No. 15/461,356, filed on Mar. 16, 2017.

(Continued)

(51) Int. Cl.
*G10L 19/00* (2013.01)
*G10L 19/04* (2013.01)

(Continued)

(52) U.S. Cl.
CPC ..... *G10L 19/002* (2013.01); *G10L 19/025* (2013.01); *G10L 19/008* (2013.01); *G10L 19/22* (2013.01)

(58) Field of Classification Search
CPC ..... G10L 19/00; G10L 19/04; G10L 19/002

(Continued)

(56) References Cited

U.S. PATENT DOCUMENTS 9,653,088 B2 * 5/2017 Rajendran ..... G10L 19/022
9,905,230 B2 * 2/2018 Purnhagen ..... G10L 19/008

(Continued)

FOREIGN PATENT DOCUMENTS

EP 1953736 A1 8/2008
EP 2381439 A1 10/2011
WO 2017112434 A1 6/2017

OTHER PUBLICATIONS

Lindblom et al., "Flexible sum-difference stereo coding based on time-aligned signal components", IEEE, 2005.*

(Continued)

*Primary Examiner* — Seong Ah A Shin
(74) *Attorney, Agent, or Firm* — Toler Law Group, P.C.

(57) ABSTRACT

A device includes a processor and a transmitter. The processor is configured to determine a first value and a second value indicative of a first amount and a second amount, respectively, of a temporal mismatch between a first audio signal and a second audio signal. The processor is also configured to determine an effective value based on the first value and the second value, to select, based on the effective value, a first coding mode and a second coding mode, and to generate at least one encoded signal having a bit allocation. The at least one encoded signal is based on a first encoded signal and a second encoded signal that are based on the first coding mode and the second coding mode, respectively. The bit allocation is at least partially based on the effective mismatch value. The transmitter is configured to transmit the at least one encoded signal.

43 Claims, 32 Drawing Sheets

Related U.S. Application Data

(60) Provisional application No. 62/310,611, filed on Mar. 18, 2016.

(51) Int. Cl.
*G10L 19/002* (2013.01)
*G10L 19/025* (2013.01)
*G10L 19/22* (2013.01)
*G10L 19/008* (2013.01)

(58) Field of Classification Search
USPC ..... 704/206, 230, 500; 381/22
See application file for complete search history.

(56) References Cited

U.S. PATENT DOCUMENTS

2006/0029239 A1* 2/2006 Smithers ..... H04R 3/02 381/119
2006/0190247 A1* 8/2006 Lindblom ..... G10L 19/008 704/230
2008/0294446 A1* 11/2008 Guo ..... G10L 19/167 704/501
2009/0119111 A1* 5/2009 Goto ..... G10L 19/008 704/500
2011/0288872 A1* 11/2011 Liu ..... G10L 19/008 704/500
2012/0002818 A1* 1/2012 Heiko ..... G10L 19/008 381/22
2012/0101813 A1* 4/2012 Vaillancourt ..... G10L 19/20 704/206
2012/0323582 A1* 12/2012 Peng ..... G10L 19/24 704/500
2016/0064007 A1* 3/2016 Villemoes ..... G10L 19/02 704/203
2017/0270934 A1* 9/2017 Atti ..... G10L 19/002

OTHER PUBLICATIONS

Kaniewska et al., "Enhanced AWR-WB bandwidth extension in 3GPP EVS codec", IEEE, 2015, pp. 652-656.*
International Search Report and Written Opinion—PCT/US2017/023026—ISA/EPO—Jul. 19, 2017.
Kaniewska M., et al., "Enhanced AMR-WB Bandwidth Extension in 3GPP EVS Codec", IEEE Global Conference on Signal and Information Processing, Dec. 14, 2015, XP032871732, DOI: 10.1109/GLOBALSIP.2015.7418277, [retrieved on Feb. 23, 2016], pp. 652-656.
Lindblom J., et al., "Flexible Sum-Difference Stereo Coding based on Time-Aligned Signal Components", Applications of Signal Processing to Audio and Acoustics , IEEE Workshop on New Paltz, NY, USA, Oct. 16-19, 2005 (Oct. 16, 2005), XP010854377, pp. 255-258.
Partial International Search Report and Written Opinion—PCT/US2017/023026—ISA/EPO—May 11, 2017.

* cited by examiner

AUDIO PROCESSING FOR TEMPORALLY MISMATCHED SIGNALS

I. CROSS-REFERENCE TO RELATED APPLICATIONS

The present application claims priority from and is a continuation application of pending U.S. patent application Ser. No. 15/461,356, filed Mar. 16, 2017 and entitled "AUDIO PROCESSING FOR TEMPORALLY MISMATCHED SIGNALS," which claims priority from U.S. Provisional Patent Application No. 62/310,611, filed Mar. 18, 2016, and entitled "AUDIO PROCESSING FOR TEMPORALLY OFFSET SIGNALS," the contents of both of which are incorporated by reference in their entirety.

II. FIELD

The present disclosure is generally related to audio processing.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio signals. Generally, a sound source is closer to a first microphone than to a second microphone of the multiple microphones. Accordingly, a second audio signal received from the second microphone may be delayed relative to a first audio signal received from the first microphone. In stereo-encoding, audio signals from the microphones may be encoded to generate a mid channel signal and one or more side channel signals. The mid channel signal may correspond to a sum of the first audio signal and the second audio signal. A side channel signal may correspond to a difference between the first audio signal and the second audio signal. The first audio signal may not be temporally aligned with the second audio signal because of the delay in receiving the second audio signal relative to the first audio signal. The misalignment (or "temporal offset") of the first audio signal relative to the second audio signal may increase a magnitude of the side channel signal. Because of the increase in magnitude of the side channel signal, a greater number of bits may be needed to encode the side channel signal.

Additionally, different frame types may cause the computing device to generate different temporal offsets or shift estimates. For example, the computing device may determine that a voiced frame of the first audio signal is offset by a corresponding voiced frame in the second audio signal by a particular amount. However, due to a relatively high amount of noise, the computing device may determine that a transition frame (or unvoiced frame) of the first audio signal is offset by a corresponding transition frame (or corresponding unvoiced frame) of the second audio signal by a different amount. Variations in the shift estimates may cause sample repetition and artifact skipping at frame boundaries. Additionally, variation in shift estimates may result in higher side channel energies, which may reduce coding efficiency.

IV. SUMMARY

According to one implementation of the techniques disclosed herein, a device for communication includes a processor and a transmitter. The processor is configured to determine a first mismatch value indicative of a first amount of a temporal mismatch between a first audio signal and a second audio signal. The first mismatch value is associated with a first frame to be encoded. The processor is also configured to determine a second mismatch value indicative of a second amount of a temporal mismatch between the first audio signal and the second audio signal. The second mismatch value is associated with a second frame to be encoded. The second frame to be encoded is subsequent to the first frame to be encoded. The processor is further configured to determine an effective mismatch value based on the first mismatch value and the second mismatch value. The second frame to be encoded includes first samples of the first audio signal and second samples of the second audio signal. The second samples are selected based at least in part on the effective mismatch value. The processor is also configured to generate, based at least partially on the second frame to be encoded, at least one encoded signal having a bit allocation. The bit allocation is at least partially based on the effective mismatch value. The transmitter configured to transmit the at least one encoded signal to a second device.

According to another implementation of the techniques disclosed herein, a method of communication includes determining, at a device, a first mismatch value indicative of a first amount of a temporal mismatch between a first audio signal and a second audio signal. The first mismatch value is associated with a first frame to be encoded. The method also includes determining, at the device, a second mismatch value. The second mismatch value is indicative of a second amount of a temporal mismatch between the first audio signal and the second audio signal. The second mismatch value is associated with a second frame to be encoded. The second frame to be encoded is subsequent to the first frame to be encoded. The method further includes determining, at the device, an effective mismatch value based on the first mismatch value and the second mismatch value. The second frame to be encoded includes first samples of the first audio signal and second samples of the second audio signal. The second samples are selected based at least in part on the effective mismatch value. The method also includes generating, based at least partially on the second frame to be encoded, at least one encoded signal having a bit allocation. The bit allocation is at least partially based on the effective mismatch value. The method also includes sending the at least one encoded signal to a second device.

According to another implementation of the techniques disclosed herein, a computer-readable storage device stores instructions that, when executed by a processor, cause the processor to perform operations including determining a first mismatch value indicative of a first amount of temporal mismatch between a first audio signal and a second audio signal. The first mismatch value is associated with a first frame to be encoded. The operations also include determining a second mismatch value indicative of a second amount of temporal mismatch between the first audio signal and the second audio signal. The second mismatch value is associated with a second frame to be encoded. The second frame to be encoded is subsequent to the first frame to be encoded. The operations further include determining an effective mismatch value based on the first mismatch value and the second mismatch value. The second frame to be encoded includes first samples of the first audio signal and second samples of the second audio signal. The second samples are selected based at least in part on the effective mismatch value. The operations also include generating, based at least partially on the second frame to be encoded, at least one encoded signal having a bit allocation. The bit allocation is at least partially based on the effective mismatch value.

According to another implementation of the techniques disclosed herein, a device for communication includes a processor configured to determine a shift value and a second shift value. The shift value is indicative off a shift of a first audio signal relative to a second audio signal. The second shift value is based on the shift value. The processor is also configured to determine a bit allocation based on the second shift value and the shift value. The processor is further configured to generate at least one encoded signal based on the bit allocation. The at least one encoded signal is based on first samples of the first audio signal and second samples of the second audio signal. The second samples are time-shifted relative to the first samples by an amount that is based on the second shift value. The device also includes a transmitter configured to transmit the at least one encoded signal to a second device.

According to another implementation of the techniques disclosed herein, a method of communication includes determining, at a device, a shift value and a second shift value. The shift value is indicative of a shift of a first audio signal relative to a second audio signal. The second shift value is based on the shift value. The method also includes determining, at the device, a coding mode based on the second shift value and the shift value. The method further includes generating, at the device, at least one encoded signal based on the coding mode. The at least one encoded signal is based on first samples of the first audio signal and second samples of the second audio signal. The second samples are time-shifted relative to the first samples by an amount that is based on the second shift value. The method also includes sending the at least one encoded signal to a second device.

According to another implementation of the techniques described herein, a computer-readable storage device stores instructions that, when executed by a processor, cause the processor to perform operations including determining a shift value and a second shift value. The shift value is indicative of a shift of a first audio signal relative to a second audio signal. The second shift value is based on the shift value. The operations also include determining a bit allocation based on the second shift value and the shift value. The operations further include generating at least one encoded signal based on the bit allocation. The at least one encoded signal is based on first samples of the first audio signal and second samples of the second audio signal. The second samples are time-shifted relative to the first samples by an amount that is based on the second shift value.

According to another implementation of the techniques described herein, an apparatus includes means for determining a bit allocation based on a shift value and a second shift value. The shift value is indicative of a shift of a first audio signal relative to a second audio signal. The second shift value is based on the shift value. The apparatus also includes means for transmitting at least one encoded signal that is generated based on the bit allocation. The at least one encoded signal is based on first samples of the first audio signal and second samples of the second audio signal. The second samples are time-shifted relative to the first samples by an amount that is based on the second shift value.

V. BRIEF DESCRIPTION OF THE DRAWINGS

VI. DETAILED DESCRIPTION

Figure 1:
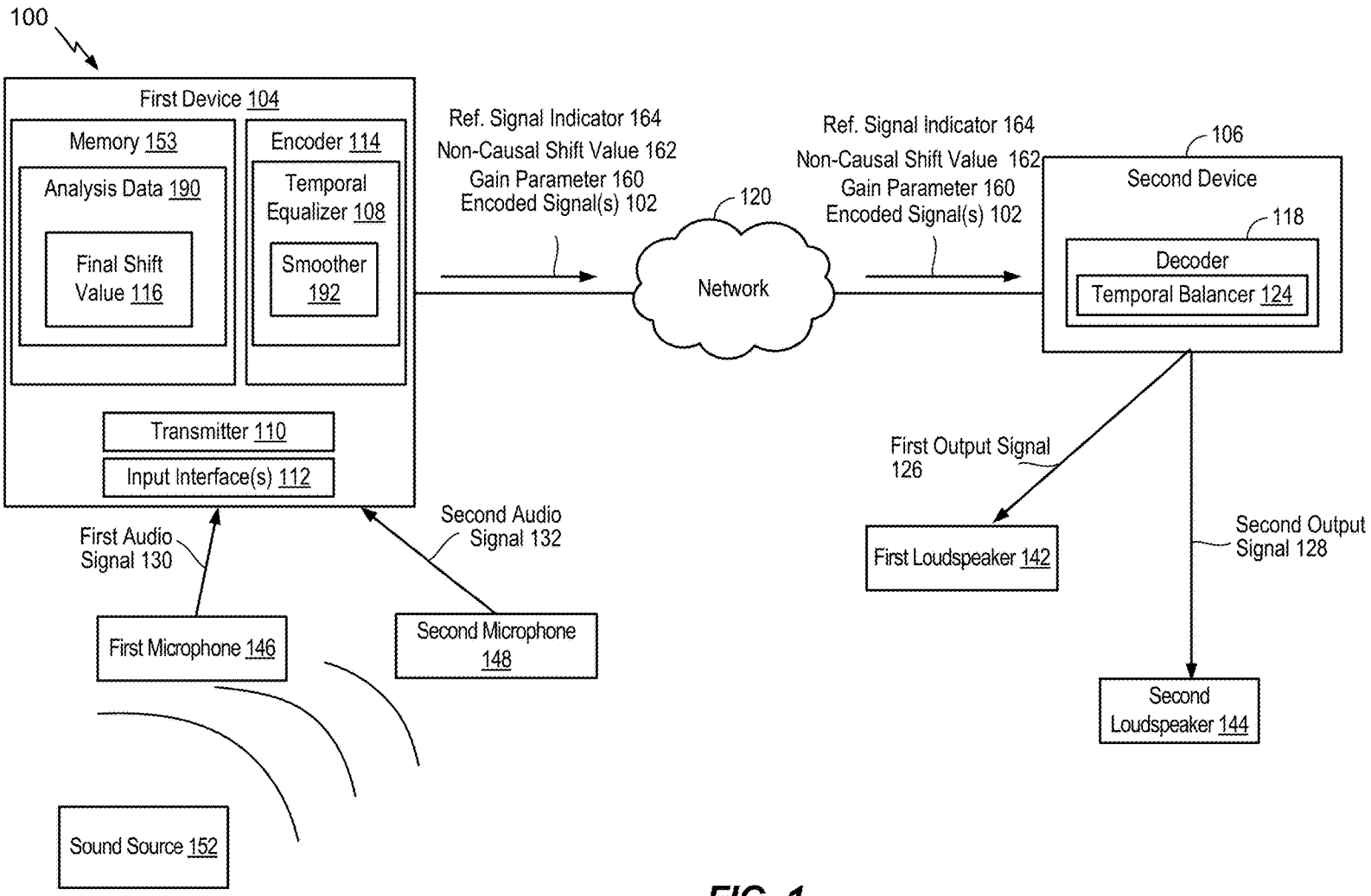
FIG. 1 is a block diagram of a particular illustrative example of a system that includes a device operable to encode multiple audio signals.

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded in MS coding. Relatively more bits are spent on the sum signal than on the side signal. PS coding reduces redundancy in each sub-band by transforming the L/R signals into a sum signal and a set of side parameters. The side parameters may indicate an inter-channel intensity difference (IID), an inter-channel phase difference (IPD), an inter-channel time difference (ITD), etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical.

The MS coding and the PS coding may be done in either the frequency domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift (or a temporal mismatch) between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),\ S=c(L-R), \qquad \text{Formula 2}$$

where c corresponds to a complex value which is frequency dependent.

Generating the Mid channel and the Side channel based on Formula 1 or Formula 2 may be referred to as performing a "downmixing" algorithm. A reverse process of generating the Left channel and the Right channel from the Mid channel and the Side channel based on Formula 1 or Formula 2 may be referred to as performing an "upmixing" algorithm.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a temporal shift value indicative of a shift of the first audio signal relative to the second audio signal. The shift value may correspond to an amount of temporal delay between receipt of the first audio signal at the first microphone and receipt of the second audio signal at the second microphone. Furthermore, the encoder may determine the shift value on a frame-by-frame basis, e.g., based on each 20 milliseconds (ms) speech/audio frame. For example, the shift value may correspond to an amount of time that a second frame of the second audio signal is delayed with respect to a first frame of the first audio signal. Alternatively, the shift value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal delay value may also change from one frame to another. However, in some implementations, the shift value may always be positive to indicate an amount of delay of the "target" channel relative to the "reference" channel. Furthermore, the shift value may correspond to a "non-causal shift" value by which the delayed target channel is "pulled back" in time such that the target channel is aligned (e.g., maximally aligned) with the "reference" channel. The down mix algorithm to determine the mid channel and the side channel may be performed on the reference channel and the non-causal shifted target channel.

The encoder may determine the shift value based on the reference audio channel and a plurality of shift values applied to the target audio channel. For example, a first frame of the reference audio channel, X, may be received at a first time ($m_1$). A first particular frame of the target audio channel, Y, may be received at a second time ($n_1$) corresponding to a first shift value, e.g., shift1=$n_1-m_1$. Further, a second frame of the reference audio channel may be received at a third time ($m_2$). A second particular frame of the target audio channel may be received at a fourth time ($n_2$) corresponding to a second shift value, e.g., shift2=$n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a shift value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally not aligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples, a time of arrival of audio signals at the microphones from multiple sound sources (e.g., talkers) may vary when the multiple talkers are alternatively talking (e.g., without overlap). In such a case, the encoder may dynamically adjust a temporal shift value based on the talker to identify the reference channel. In some other examples, the multiple talkers may be talking at the same time, which may result in varying temporal shift values depending on who is the loudest talker, closest to the microphone, etc.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values, variation values, or cross-correlation values) based on a comparison of a first frame of the first audio signal and a plurality of frames of the second audio signal. Each frame of the plurality of frames may correspond to a particular shift value. The encoder may generate a first estimated shift value based on the comparison values. For example, the first estimated shift value may correspond to a comparison value indicating a higher temporal-similarity (or lower difference) between the first frame of the first audio signal and a corresponding first frame of the second audio signal.

The encoder may determine the final shift value by refining, in multiple stages, a series of estimated shift values. For example, the encoder may first estimate a "tentative" shift value based on comparison values generated from stereo pre-processed and re-sampled versions of the first audio signal and the second audio signal. The encoder may generate interpolated comparison values associated with shift values proximate to the estimated "tentative" shift value. The encoder may determine a second estimated "interpolated" shift value based on the interpolated comparison values. For example, the second estimated "interpolated" shift value may correspond to a particular interpolated comparison value that indicates a higher temporal-similarity (or lower difference) than the remaining interpolated comparison values and the first estimated "tentative" shift value. If the second estimated "interpolated" shift value of the current frame (e.g., the first frame of the first audio signal) is different than a final shift value of a previous frame (e.g., a frame of the first audio signal that precedes the first frame), then the "interpolated" shift value of the current frame is further "amended" to improve the temporal-similarity between the first audio signal and the shifted second audio signal. In particular, a third estimated "amended" shift value may correspond to a more accurate measure of temporal-similarity by searching around the second estimated "interpolated" shift value of the current frame and the final estimated shift value of the previous frame. The third estimated "amended" shift value is further conditioned to estimate the final shift value by limiting any spurious changes in the shift value between frames and further controlled to not switch from a negative shift value to a positive shift value (or vice versa) in two successive (or consecutive) frames as described herein.

In some examples, the encoder may refrain from switching between a positive shift value and a negative shift value or vice-versa in consecutive frames or in adjacent frames. For example, the encoder may set the final shift value to a particular value (e.g., 0) indicating no temporal-shift based on the estimated "interpolated" or "amended" shift value of the first frame and a corresponding estimated "interpolated" or "amended" or final shift value in a particular frame that precedes the first frame. To illustrate, the encoder may set the final shift value of the current frame (e.g., the first frame) to indicate no temporal-shift, i.e., shift1=0, in response to determining that one of the estimated "tentative" or "interpolated" or "amended" shift value of the current frame is positive and the other of the estimated "tentative" or "interpolated" or "amended" or "final" estimated shift value of the previous frame (e.g., the frame preceding the first frame) is negative. Alternatively, the encoder may also set the final shift value of the current frame (e.g., the first frame) to indicate no temporal-shift, i.e., shift1=0, in response to determining that one of the estimated "tentative" or "interpolated" or "amended" shift value of the current frame is negative and the other of the estimated "tentative" or "interpolated" or "amended" or "final" estimated shift value of the previous frame (e.g., the frame preceding the first frame) is positive.

The encoder may select a frame of the first audio signal or the second audio signal as a "reference" or "target" based on the shift value. For example, in response to determining that the final shift value is positive, the encoder may generate a reference channel or signal indicator having a first value (e.g., 0) indicating that the first audio signal is a "reference" signal and that the second audio signal is the "target" signal. Alternatively, in response to determining that the final shift value is negative, the encoder may generate the reference channel or signal indicator having a second value (e.g., 1) indicating that the second audio signal is the "reference" signal and that the first audio signal is the "target" signal.

The encoder may estimate a relative gain (e.g., a relative gain parameter) associated with the reference signal and the non-causal shifted target signal. For example, in response to determining that the final shift value is positive, the encoder may estimate a gain value to normalize or equalize the energy or power levels of the first audio signal relative to the second audio signal that is offset by the non-causal shift value (e.g., an absolute value of the final shift value). Alternatively, in response to determining that the final shift value is negative, the encoder may estimate a gain value to normalize or equalize the power levels of the non-causal shifted first audio signal relative to the second audio signal. In some examples, the encoder may estimate a gain value to normalize or equalize the energy or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal, the non-causal shift value, and the relative gain parameter. The side signal may correspond to a difference between first samples of the first frame of the first audio signal and selected samples of a selected frame of the second audio signal. The encoder may select the selected frame based on the final shift value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal shift value, the relative gain parameter, the reference channel or signal indicator, or a combination thereof.

The encoder may generate at least one encoded signal (e.g., a mid signal, a side signal, or both) based on the reference signal, the target signal, the non-causal shift value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal shift value and inter-channel relative gain parameter. The low band parameters, the high band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal shift value, the relative gain parameter, the reference channel (or signal) indicator, or a combination thereof.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The encoder 114 may include a temporal equalizer 108 and may be configured to down mix and encode multiple audio signals, as described herein. The first device 104 may also include a memory 153 configured to store analysis data 190. The second device 106 may include a decoder 118. The decoder 118 may include a temporal balancer 124 that is configured to upmix and render the multiple channels. The second device 106 may be coupled to a first loudspeaker 142, a second loudspeaker 144, or both.

During operation, the first device 104 may receive a first audio signal 130 via the first input interface from the first microphone 146 and may receive a second audio signal 132 via the second input interface from the second microphone 148. The first audio signal 130 may correspond to one of a right channel signal or a left channel signal. The second audio signal 132 may correspond to the other of the right channel signal or the left channel signal. A sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132.

The temporal equalizer 108 may be configured to estimate a temporal offset between audio captured at the microphones 146, 148. The temporal offset may be estimated based on a delay between a first frame of the first audio signal 130 and a second frame of the second audio signal 132, where the second frame includes substantially similar content as the first frame. For example, the temporal equalizer 108 may determine a cross-correlation between the first frame and the second frame. The cross-correlation may measure the similarity of the two frames as a function of the lag of one frame relative to the other. Based on the cross-correlation, the temporal equalizer 108 may determine the delay (e.g., lag) between the first frame and the second frame. The temporal equalizer 108 may estimate the temporal offset between the first audio signal 130 and the second audio signal 132 based on the delay and historical delay data.

The historical data may include delays between frames captured from the first microphone 146 and corresponding frames captured from the second microphone 148. For example, the temporal equalizer 108 may determine a cross-correlation (e.g., a lag) between previous frames associated with the first audio signal 130 and corresponding frames associated with the second audio signal 132. Each lag may be represented by a "comparison value". That is, a comparison value may indicate a time shift (k) between a frame of the first audio signal 130 and a corresponding frame of the second audio signal 132. According to one implementation, the comparison values for previous frames may be stored at the memory 153. A smoother 192 of the temporal equalizer 108 may "smooth" (or average) comparison values over a long-term set of frames and use the long-term smoothed comparison values for estimating a temporal offset (e.g., "shift") between the first audio signal 130 and the second audio signal 132.

To illustrate, if $CompVal_N(k)$ represents the comparison value at a shift of k for the frame N, the frame N may have comparison values from k=T_MIN (a minimum shift) to k=T_MAX (a maximum shift). The smoothing may be performed such that a long-term comparison value $CompVal_{LT_N}(k)$ is represented by $CompVal_{LT_N}(k)=f(CompVal_N(k), CompVal_{N-1}(k), CompVal_{LT_{N-2}}(k), \ldots)$. The function f in the above equation may be a function of all (or a subset) of past comparison values at the shift (k). An alternative representation of the long-term comparison value $CompVal_{LT_N}(k)$ may be $CompVal_{LT_N}(k)=g(CompVal_N(k), CompVal_{N-1}(k), CompVal_{N-2}(k), \ldots)$. The functions f or g may be simple finite impulse response (FIR) filters or infinite impulse response (IIR) filters, respectively. For example, the function g may be a single tap IIR filter such that the long-term comparison value $CompVal_{LT_N}(k)$ is represented by $CompVal_{LT_N}(k)=(1-\alpha)*CompVal_N(k), +(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of a increases, the amount of smoothing in the long-term comparison value increases. In a particular aspect, the function f may be a L-tap FIR filter such that the long-term comparison value $CompVal_{LT_N}(k)$ is represented by $CompVal_{LT_N}(k)=(\alpha1)*CompVal_N(k),+(\alpha2)*CompVal_{N-1}(k)+\ldots+(\alpha L)*CompVal_{N-L+1}(k)$, where $\alpha1, \alpha2, \ldots$, and $\alpha L$ correspond to weights. In a particular aspect, each of the $\alpha1, \alpha2, \ldots$, and $\alpha L\in(0, 1.0)$, and a particular weight of the $\alpha1, \alpha2, \ldots$, and $\alpha L$ may be the same as or distinct from another weight of the $\alpha1, \alpha2, \ldots$, and $\alpha L$. Thus, the long-term comparison value $CompVal_{LT_N}(k)$ may be based on a weighted mixture of the instantaneous comparison value $CompVal_N(k)$ at frame N and the comparison values $CompVal_{N-i}(k)$ over the previous (L−1) frames.

The smoothing techniques described above may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

The temporal equalizer 108 may determine a final shift value 116 (e.g., a non-causal shift value) indicative of the shift (e.g., a non-causal shift) of the first audio signal 130 (e.g., "target") relative to the second audio signal 132 (e.g., "reference"). The final shift value 116 may be based on the instantaneous comparison value $CompVal_N(k)$ and the long-term comparison $CompVal_{LT_{N-1}}(k)$. For example, the smoothing operation described above may be performed on a tentative shift value, on an interpolated shift value, on an amended shift value, or a combination thereof, as described with respect to FIG. 5. The final shift value 116 may be based on the tentative shift value, the interpolated shift value, and the amended shift value, as described with respect to FIG. 5. A first value (e.g., a positive value) of the final shift value 116 may indicate that the second audio signal 132 is delayed relative to the first audio signal 130. A second value (e.g., a negative value) of the final shift value 116 may indicate that the first audio signal 130 is delayed relative to the second audio signal 132. A third value (e.g., 0) of the final shift value 116 may indicate no delay between the first audio signal 130 and the second audio signal 132.

In some implementations, the third value (e.g., 0) of the final shift value 116 may indicate that delay between the first audio signal 130 and the second audio signal 132 has switched sign. For example, a first particular frame of the first audio signal 130 may precede the first frame. The first particular frame and a second particular frame of the second audio signal 132 may correspond to the same sound emitted by the sound source 152. The delay between the first audio signal 130 and the second audio signal 132 may switch from having the first particular frame delayed with respect to the second particular frame to having the second frame delayed with respect to the first frame. Alternatively, the delay between the first audio signal 130 and the second audio signal 132 may switch from having the second particular frame delayed with respect to the first particular frame to having the first frame delayed with respect to the second frame. The temporal equalizer 108 may set the final shift value 116 to indicate the third value (e.g., 0) in response to determining that the delay between the first audio signal 130 and the second audio signal 132 has switched sign.

The temporal equalizer 108 may generate a reference signal indicator 164 based on the final shift value 116. For example, the temporal equalizer 108 may, in response to determining that the final shift value 116 indicates a first value (e.g., a positive value), generate the reference signal indicator 164 to have a first value (e.g., 0) indicating that the first audio signal 130 is a "reference" signal. The temporal equalizer 108 may determine that the second audio signal 132 corresponds to a "target" signal in response to determining that the final shift value 116 indicates the first value (e.g., a positive value). Alternatively, the temporal equalizer 108 may, in response to determining that the final shift value 116 indicates a second value (e.g., a negative value), generate the reference signal indicator 164 to have a second value (e.g., 1) indicating that the second audio signal 132 is the "reference" signal. The temporal equalizer 108 may determine that the first audio signal 130 corresponds to the "target" signal in response to determining that the final shift value 116 indicates the second value (e.g., a negative value). The temporal equalizer 108 may, in response to determining that the final shift value 116 indicates a third value (e.g., 0), generate the reference signal indicator 164 to have a first value (e.g., 0) indicating that the first audio signal 130 is a "reference" signal. The temporal equalizer 108 may determine that the second audio signal 132 corresponds to a "target" signal in response to determining that the final shift value 116 indicates the third value (e.g., 0). Alternatively, the temporal equalizer 108 may, in response to determining that the final shift value 116 indicates the third value (e.g., 0), generate the reference signal indicator 164 to have a second value (e.g., 1) indicating that the second audio signal 132 is a "reference" signal. The temporal equalizer 108 may determine that the first audio signal 130 corresponds to a "target" signal in response to determining that the final shift value 116 indicates the third value (e.g., 0). In some implementations, the temporal equalizer 108 may, in response to determining that the final shift value 116 indicates a third value (e.g., 0), leave the reference signal indicator 164 unchanged. For example, the reference signal indicator 164 may be the same as a reference signal indicator corresponding to the first particular frame of the first audio signal 130. The temporal equalizer 108 may generate a non-causal shift value 162 indicating an absolute value of the final shift value 116.

The temporal equalizer 108 may generate a gain parameter 160 (e.g., a codec gain parameter) based on samples of the "target" signal and based on samples of the "reference" signal. For example, the temporal equalizer 108 may select samples of the second audio signal 132 based on the non-causal shift value 162. Alternatively, the temporal equalizer 108 may select samples of the second audio signal 132 independent of the non-causal shift value 162. The temporal equalizer 108 may, in response to determining that the first audio signal 130 is the reference signal, determine the gain parameter 160 of the selected samples based on the first samples of the first frame of the first audio signal 130. Alternatively, the temporal equalizer 108 may, in response to determining that the second audio signal 132 is the reference signal, determine the gain parameter 160 of the first samples based on the selected samples. As an example, the gain parameter 160 may be based on one of the following Equations:

$$g_D = \frac{\sum_{n=0}^{N-N_1} Ref(n)Targ(n+N_1)}{\sum_{n=0}^{N-N_1} Targ^2(n+N_1)}, \quad \text{Equation 1a}$$

-continued $$g_D = \frac{\sum_{n=0}^{N-N_1} |Ref(n)|}{\sum_{n=0}^{N-N_1} |Targ(n+N_1)|}, \quad \text{Equation 1b}$$

$$g_D = \frac{\sum_{n=0}^{N} Ref(n)Targ(n)}{\sum_{n=0}^{N} Targ^2(n)}, \quad \text{Equation 1c}$$

$$g_D = \frac{\sum_{n=0}^{N} |Ref(n)|}{\sum_{n=0}^{N} |Targ(n)|}, \quad \text{Equation 1d}$$

$$g_D = \frac{\sum_{n=0}^{N-N_1} Ref(n)Targ(n)}{\sum_{n=0}^{N} Ref^2(n)}, \quad \text{Equation 1e}$$

$$g_D = \frac{\sum_{n=0}^{N-N_1} |Targ(n)|}{\sum_{n=0}^{N} |Ref(n)|}, \quad \text{Equation 1f}$$

where $g_D$ corresponds to the relative gain parameter 160 for down mix processing, Ref(n) corresponds to samples of the "reference" signal, $N_1$ corresponds to the non-causal shift value 162 of the first frame, and Targ(n+$N_1$) corresponds to samples of the "target" signal. The gain parameter 160 ($g_D$) may be modified, e.g., based on one of the Equations 1a-1f, to incorporate long term smoothing/hysteresis logic to avoid large jumps in gain between frames. When the target signal includes the first audio signal 130, the first samples may include samples of the target signal and the selected samples may include samples of the reference signal. When the target signal includes the second audio signal 132, the first samples may include samples of the reference signal, and the selected samples may include samples of the target signal.

In some implementations, the temporal equalizer 108 may generate the gain parameter 160 based on treating the first audio signal 130 as a reference signal and treating the second audio signal 132 as a target signal, irrespective of the reference signal indicator 164. For example, the temporal equalizer 108 may generate the gain parameter 160 based on one of the Equations 1a-1f where Ref(n) corresponds to samples (e.g., the first samples) of the first audio signal 130 and Targ(n+$N_1$) corresponds to samples (e.g., the selected samples) of the second audio signal 132. In alternate implementations, the temporal equalizer 108 may generate the gain parameter 160 based on treating the second audio signal 132 as a reference signal and treating the first audio signal 130 as a target signal, irrespective of the reference signal indicator 164. For example, the temporal equalizer 108 may generate the gain parameter 160 based on one of the Equations 1a-1f where Ref(n) corresponds to samples (e.g., the selected samples) of the second audio signal 132 and Targ (n+$N_1$) corresponds to samples (e.g., the first samples) of the first audio signal 130.

The temporal equalizer 108 may generate one or more encoded signals 102 (e.g., a mid channel signal, a side channel signal, or both) based on the first samples, the selected samples, and the relative gain parameter 160 for down mix processing. For example, the temporal equalizer 108 may generate the mid signal based on one of the following Equations:

$$M=\mathrm{Ref}(n)+g_D\mathrm{Targ}(n+N_1), \quad \text{Equation 2a}$$

$$M=\mathrm{Ref}(n)+\mathrm{Targ}(n+N_1), \quad \text{Equation 2b}$$

$$M=\mathrm{DMXFAC}*\mathrm{Ref}(n)+(1-\mathrm{DMXFAC})*g_D\mathrm{Targ}(n+N_1), \quad \text{Equation 2c}$$

$$M=\mathrm{DMXFAC}*\mathrm{Ref}(n)+(1-\mathrm{DMXFAC})*\mathrm{Targ}(n+N_1), \quad \text{Equation 2d}$$

where M corresponds to the mid channel signal, $g_D$ corresponds to the relative gain parameter 160 for downmix processing, Ref(n) corresponds to samples of the "reference" signal, $N_1$ corresponds to the non-causal shift value 162 of the first frame, and $\mathrm{Targ}(n+N_1)$ corresponds to samples of the "target" signal. DMXFAC may correspond to a downmix factor, as further described with reference to FIG. 19.

The temporal equalizer 108 may generate the side channel signal based on one of the following Equations:

$$S=\mathrm{Ref}(n)-g_D\mathrm{Targ}(n+N_1), \quad \text{Equation 3a}$$

$$S=g_D\mathrm{Ref}(n)-\mathrm{Targ}(n+N_1), \quad \text{Equation 3b}$$

$$S=(1-\mathrm{DMXFAC})*\mathrm{Ref}(n)-(\mathrm{DMXFAC})*g_D\mathrm{Targ}(n+N_1), \quad \text{Equation 3c}$$

$$S=(1-\mathrm{DMXFAC})*\mathrm{Ref}(n)-(\mathrm{DMXFAC})*\mathrm{Targ}(n+N_1), \quad \text{Equation 3d}$$

where S corresponds to the side channel signal, $g_D$ corresponds to the relative gain parameter 160 for downmix processing, Ref(n) corresponds to samples of the "reference" signal, $N_1$ corresponds to the non-causal shift value 162 of the first frame, and $\mathrm{Targ}(n+N_1)$ corresponds to samples of the "target" signal.

The transmitter 110 may transmit the encoded signals 102 (e.g., the mid channel signal, the side channel signal, or both), the reference signal indicator 164, the non-causal shift value 162, the gain parameter 160, or a combination thereof, via the network 120, to the second device 106. In some implementations, the transmitter 110 may store the encoded signals 102 (e.g., the mid channel signal, the side channel signal, or both), the reference signal indicator 164, the non-causal shift value 162, the gain parameter 160, or a combination thereof, at a device of the network 120 or a local device for further processing or decoding later.

The decoder 118 may decode the encoded signals 102. The temporal balancer 124 may perform upmixing to generate a first output signal 126 (e.g., corresponding to first audio signal 130), a second output signal 128 (e.g., corresponding to the second audio signal 132), or both. The second device 106 may output the first output signal 126 via the first loudspeaker 142. The second device 106 may output the second output signal 128 via the second loudspeaker 144.

The system 100 may thus enable the temporal equalizer 108 to encode the side channel signal using fewer bits than the mid signal. The first samples of the first frame of the first audio signal 130 and selected samples of the second audio signal 132 may correspond to the same sound emitted by the sound source 152 and hence a difference between the first samples and the selected samples may be lower than between the first samples and other samples of the second audio signal 132. The side channel signal may correspond to the difference between the first samples and the selected samples.

Figure 2:
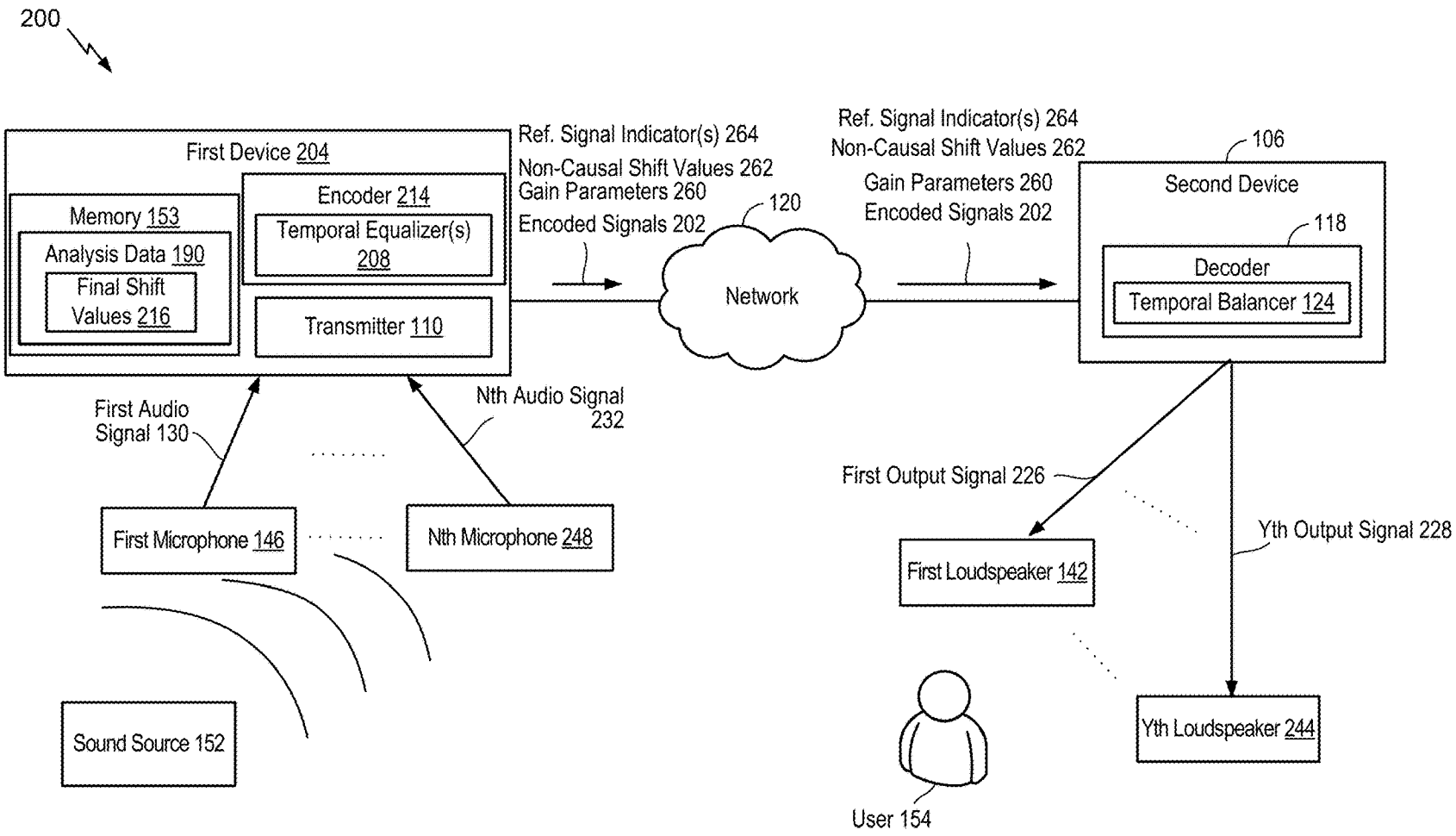
FIG. 2 is a diagram illustrating another example of a system that includes the device of FIG. 1.

Referring to FIG. 2, a particular illustrative implementation of a system is disclosed and generally designated 200. The system 200 includes a first device 204 coupled, via the network 120, to the second device 106. The first device 204 may correspond to the first device 104 of FIG. 1 The system 200 differs from the system 100 of FIG. 1 in that the first device 204 is coupled to more than two microphones. For example, the first device 204 may be coupled to the first microphone 146, an Nth microphone 248, and one or more additional microphones (e.g., the second microphone 148 of FIG. 1). The second device 106 may be coupled to the first loudspeaker 142, a Yth loudspeaker 244, one or more additional speakers (e.g., the second loudspeaker 144), or a combination thereof. The first device 204 may include an encoder 214. The encoder 214 may correspond to the encoder 114 of FIG. 1. The encoder 214 may include one or more temporal equalizers 208. For example, the temporal equalizer(s) 208 may include the temporal equalizer 108 of FIG. 1.

During operation, the first device 204 may receive more than two audio signals. For example, the first device 204 may receive the first audio signal 130 via the first microphone 146, an Nth audio signal 232 via the Nth microphone 248, and one or more additional audio signals (e.g., the second audio signal 132) via the additional microphones (e.g., the second microphone 148).

The temporal equalizer(s) 208 may generate one or more reference signal indicators 264, final shift values 216, non-causal shift values 262, gain parameters 260, encoded signals 202, or a combination thereof. For example, the temporal equalizer(s) 208 may determine that the first audio signal 130 is a reference signal and that each of the Nth audio signal 232 and the additional audio signals is a target signal. The temporal equalizer(s) 208 may generate the reference signal indicator 164, the final shift values 216, the non-causal shift values 262, the gain parameters 260, and the encoded signals 202 corresponding to the first audio signal 130 and each of the Nth audio signal 232 and the additional audio signals.

The reference signal indicators 264 may include the reference signal indicator 164. The final shift values 216 may include the final shift value 116 indicative of a shift of the second audio signal 132 relative to the first audio signal 130, a second final shift value indicative of a shift of the Nth audio signal 232 relative to the first audio signal 130, or both. The non-causal shift values 262 may include the non-causal shift value 162 corresponding to an absolute value of the final shift value 116, a second non-causal shift value corresponding to an absolute value of the second final shift value, or both. The gain parameters 260 may include the gain parameter 160 of selected samples of the second audio signal 132, a second gain parameter of selected samples of the Nth audio signal 232, or both. The encoded signals 202 may include at least one of the encoded signals 102. For example, the encoded signals 202 may include the side channel signal corresponding to first samples of the first audio signal 130 and selected samples of the second audio signal 132, a second side channel corresponding to the first samples and selected samples of the Nth audio signal 232, or both. The encoded signals 202 may include a mid channel signal corresponding to the first samples, the selected samples of the second audio signal 132, and the selected samples of the Nth audio signal 232.

In some implementations, the temporal equalizer(s) 208 may determine multiple reference signals and corresponding target signals, as described with reference to FIG. 15. For example, the reference signal indicators 264 may include a reference signal indicator corresponding to each pair of reference signal and target signal. To illustrate, the reference signal indicators 264 may include the reference signal indicator 164 corresponding to the first audio signal 130 and the second audio signal 132. The final shift values 216 may include a final shift value corresponding to each pair of reference signal and target signal. For example, the final shift values 216 may include the final shift value 116 corresponding to the first audio signal 130 and the second audio signal 132. The non-causal shift values 262 may include a non-causal shift value corresponding to each pair of reference signal and target signal. For example, the non-causal shift values 262 may include the non-causal shift value 162 corresponding to the first audio signal 130 and the second audio signal 132. The gain parameters 260 may include a gain parameter corresponding to each pair of reference signal and target signal. For example, the gain parameters 260 may include the gain parameter 160 corresponding to the first audio signal 130 and the second audio signal 132. The encoded signals 202 may include a mid channel signal and a side channel signal corresponding to each pair of reference signal and target signal. For example, the encoded signals 202 may include the encoded signals 102 corresponding to the first audio signal 130 and the second audio signal 132.

The transmitter 110 may transmit the reference signal indicators 264, the non-causal shift values 262, the gain parameters 260, the encoded signals 202, or a combination thereof, via the network 120, to the second device 106. The decoder 118 may generate one or more output signals based on the reference signal indicators 264, the non-causal shift values 262, the gain parameters 260, the encoded signals 202, or a combination thereof. For example, the decoder 118 may output a first output signal 226 via the first loudspeaker 142, a Yth output signal 228 via the Yth loudspeaker 244, one or more additional output signals (e.g., the second output signal 128) via one or more additional loudspeakers (e.g., the second loudspeaker 144), or a combination thereof.

The system 200 may thus enable the temporal equalizer(s) 208 to encode more than two audio signals. For example, the encoded signals 202 may include multiple side channel signals that are encoded using fewer bits than corresponding mid channels by generating the side channel signals based on the non-causal shift values 262.

Figure 3:
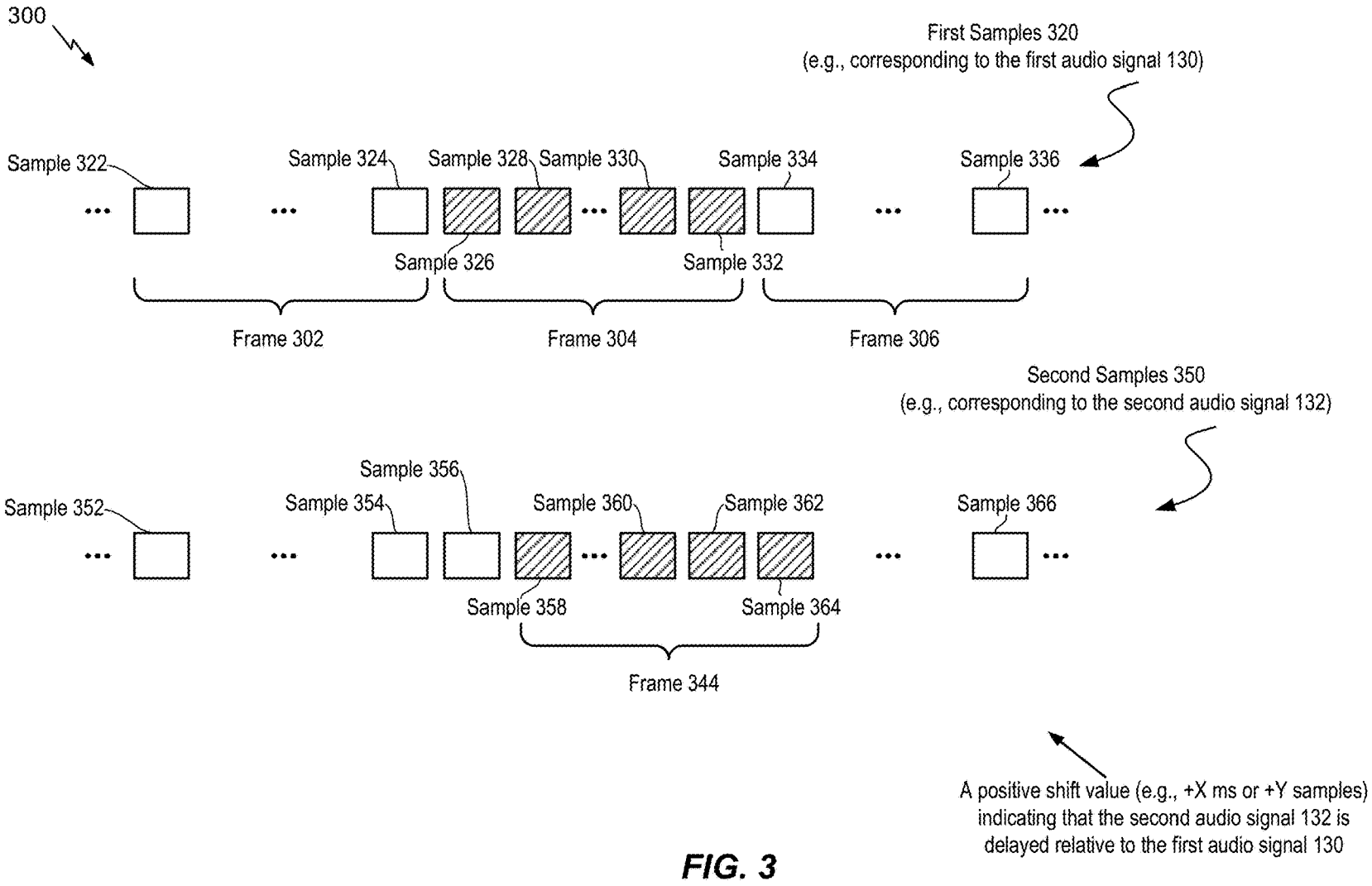
FIG. 3 is a diagram illustrating particular examples of samples that may be encoded by the device of FIG. 1.

Referring to FIG. 3, illustrative examples of samples are shown and generally designated 300. At least a subset of the samples 300 may be encoded by the first device 104, as described herein.

The samples 300 may include first samples 320 corresponding to the first audio signal 130, second samples 350 corresponding to the second audio signal 132, or both. The first samples 320 may include a sample 322, a sample 324, a sample 326, a sample 328, a sample 330, a sample 332, a sample 334, a sample 336, one or more additional samples, or a combination thereof. The second samples 350 may include a sample 352, a sample 354, a sample 356, a sample 358, a sample 360, a sample 362, a sample 364, a sample 366, one or more additional samples, or a combination thereof.

The first audio signal 130 may correspond to a plurality of frames (e.g., a frame 302, a frame 304, a frame 306, or a combination thereof). Each of the plurality of frames may correspond to a subset of samples (e.g., corresponding to 20 ms, such as 640 samples at 32 kHz or 960 samples at 48 kHz) of the first samples 320. For example, the frame 302 may correspond to the sample 322, the sample 324, one or more additional samples, or a combination thereof. The frame 304 may correspond to the sample 326, the sample 328, the sample 330, the sample 332, one or more additional samples, or a combination thereof. The frame 306 may correspond to the sample 334, the sample 336, one or more additional samples, or a combination thereof.

The sample 322 may be received at the input interface(s) 112 of FIG. 1 at approximately the same time as the sample 352. The sample 324 may be received at the input interface(s) 112 of FIG. 1 at approximately the same time as the sample 354. The sample 326 may be received at the input interface(s) 112 of FIG. 1 at approximately the same time as the sample 356. The sample 328 may be received at the input interface(s) 112 of FIG. 1 at approximately the same time as the sample 358. The sample 330 may be received at the input interface(s) 112 of FIG. 1 at approximately the same time as the sample 360. The sample 332 may be received at the input interface(s) 112 of FIG. 1 at approximately the same time as the sample 362. The sample 334 may be received at the input interface(s) 112 of FIG. 1 at approximately the same time as the sample 364. The sample 336 may be received at the input interface(s) 112 of FIG. 1 at approximately the same time as the sample 366.

A first value (e.g., a positive value) of the final shift value 116 may indicate that the second audio signal 132 is delayed relative to the first audio signal 130. For example, a first value (e.g., +X ms or +Y samples, where X and Y include positive real numbers) of the final shift value 116 may indicate that the frame 304 (e.g., the samples 326-332) correspond to the samples 358-364. The samples 326-332 and the samples 358-364 may correspond to the same sound emitted from the sound source 152. The samples 358-364 may correspond to a frame 344 of the second audio signal 132. Illustration of samples with cross-hatching in one or more of FIGS. 1-15 may indicate that the samples correspond to the same sound. For example, the samples 326-332 and the samples 358-364 are illustrated with cross-hatching in FIG. 3 to indicate that the samples 326-332 (e.g., the frame 304) and the samples 358-364 (e.g., the frame 344) correspond to the same sound emitted from the sound source 152.

It should be understood that a temporal offset of Y samples, as shown in FIG. 3, is illustrative. For example, the temporal offset may correspond to a number of samples, Y, that is greater than or equal to 0. In a first case where the temporal offset Y=0 samples, the samples 326-332 (e.g., corresponding to the frame 304) and the samples 356-362 (e.g., corresponding to the frame 344) may show high similarity without any frame offset. In a second case where the temporal offset Y=2 samples, the frame 304 and frame 344 may be offset by 2 samples. In this case, the first audio signal 130 may be received prior to the second audio signal 132 at the input interface(s) 112 by Y=2 samples or X=(2/Fs) ms, where Fs corresponds to the sample rate in kHz. In some cases, the temporal offset, Y, may include a non-integer value, e.g., Y=1.6 samples corresponding to X=0.05 ms at 32 kHz.

The temporal equalizer 108 of FIG. 1 may generate the encoded signals 102 by encoding the samples 326-332 and the samples 358-364, as described with reference to FIG. 1. The temporal equalizer 108 may determine that the first audio signal 130 corresponds to a reference signal and that the second audio signal 132 corresponds to a target signal.

Figure 4:
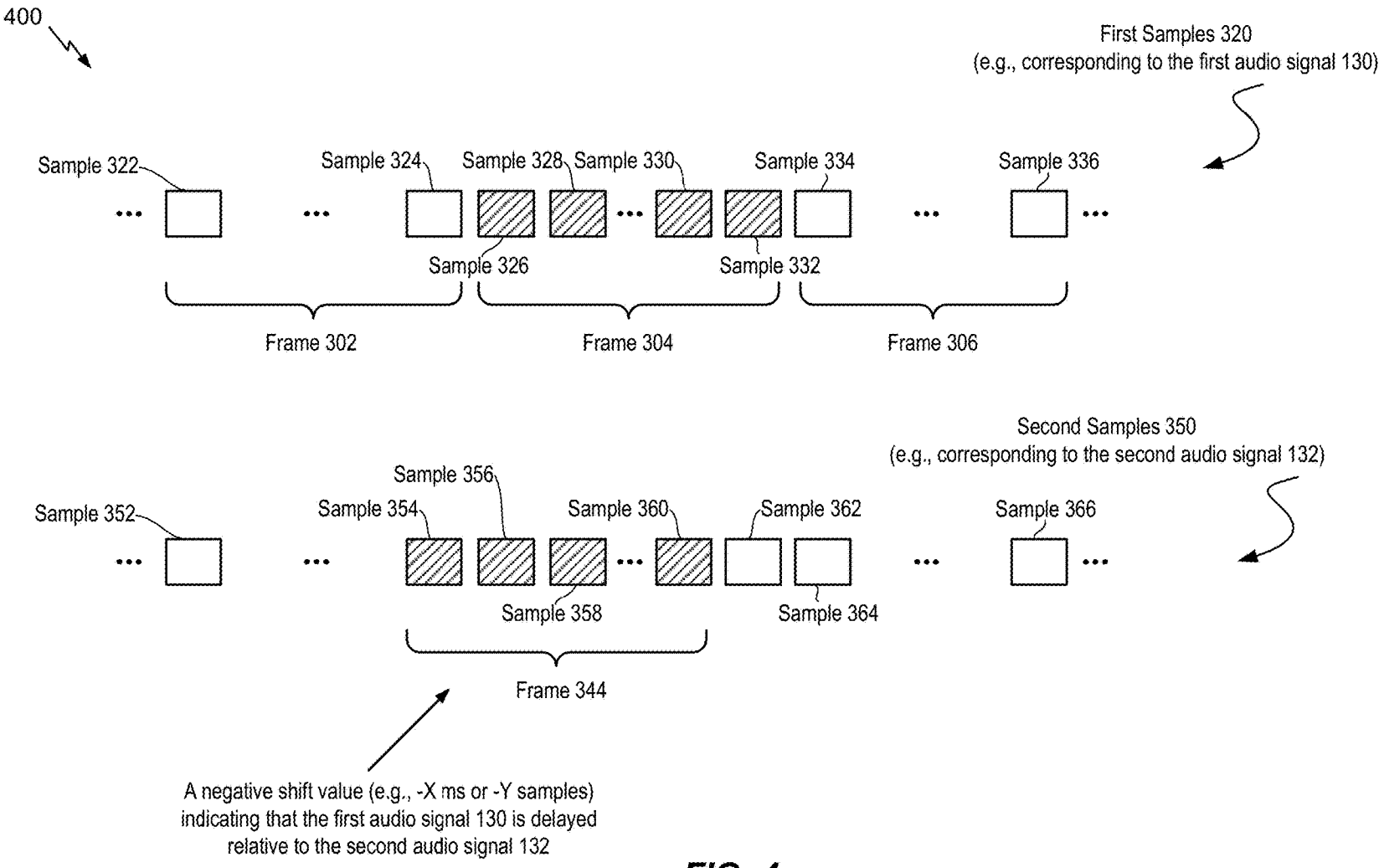
FIG. 4 is a diagram illustrating particular examples of samples that may be encoded by the device of FIG. 1.

Referring to FIG. 4, illustrative examples of samples are shown and generally designated as 400. The samples 400 differ from the samples 300 in that the first audio signal 130 is delayed relative to the second audio signal 132.

A second value (e.g., a negative value) of the final shift value 116 may indicate that the first audio signal 130 is delayed relative to the second audio signal 132. For example, the second value (e.g., −X ms or −Y samples, where X and Y include positive real numbers) of the final shift value 116 may indicate that the frame 304 (e.g., the samples 326-332) correspond to the samples 354-360. The samples 354-360 may correspond to the frame 344 of the second audio signal 132. The samples 354-360 (e.g., the frame 344) and the samples 326-332 (e.g., the frame 304) may correspond to the same sound emitted from the sound source 152.

It should be understood that a temporal offset of −Y samples, as shown in FIG. 4, is illustrative. For example, the temporal offset may correspond to a number of samples, −Y, that is less than or equal to 0. In a first case where the temporal offset Y=0 samples, the samples 326-332 (e.g., corresponding to the frame 304) and the samples 356-362 (e.g., corresponding to the frame 344) may show high similarity without any frame offset. In a second case where the temporal offset Y=−6 samples, the frame 304 and frame 344 may be offset by 6 samples. In this case, the first audio signal 130 may be received subsequent to the second audio signal 132 at the input interface(s) 112 by Y=−6 samples or X=(−6/Fs) ms, where Fs corresponds to the sample rate in kHz. In some cases, the temporal offset, Y, may include a non-integer value, e.g., Y=−3.2 samples corresponding to X=−0.1 ms at 32 kHz.

The temporal equalizer 108 of FIG. 1 may generate the encoded signals 102 by encoding the samples 354-360 and the samples 326-332, as described with reference to FIG. 1. The temporal equalizer 108 may determine that the second audio signal 132 corresponds to a reference signal and that the first audio signal 130 corresponds to a target signal. In particular, the temporal equalizer 108 may estimate the non-causal shift value 162 from the final shift value 116, as described with reference to FIG. 5. The temporal equalizer 108 may identify (e.g., designate) one of the first audio signal 130 or the second audio signal 132 as a reference signal and the other of the first audio signal 130 or the second audio signal 132 as a target signal based on a sign of the final shift value 116.

Figure 5:
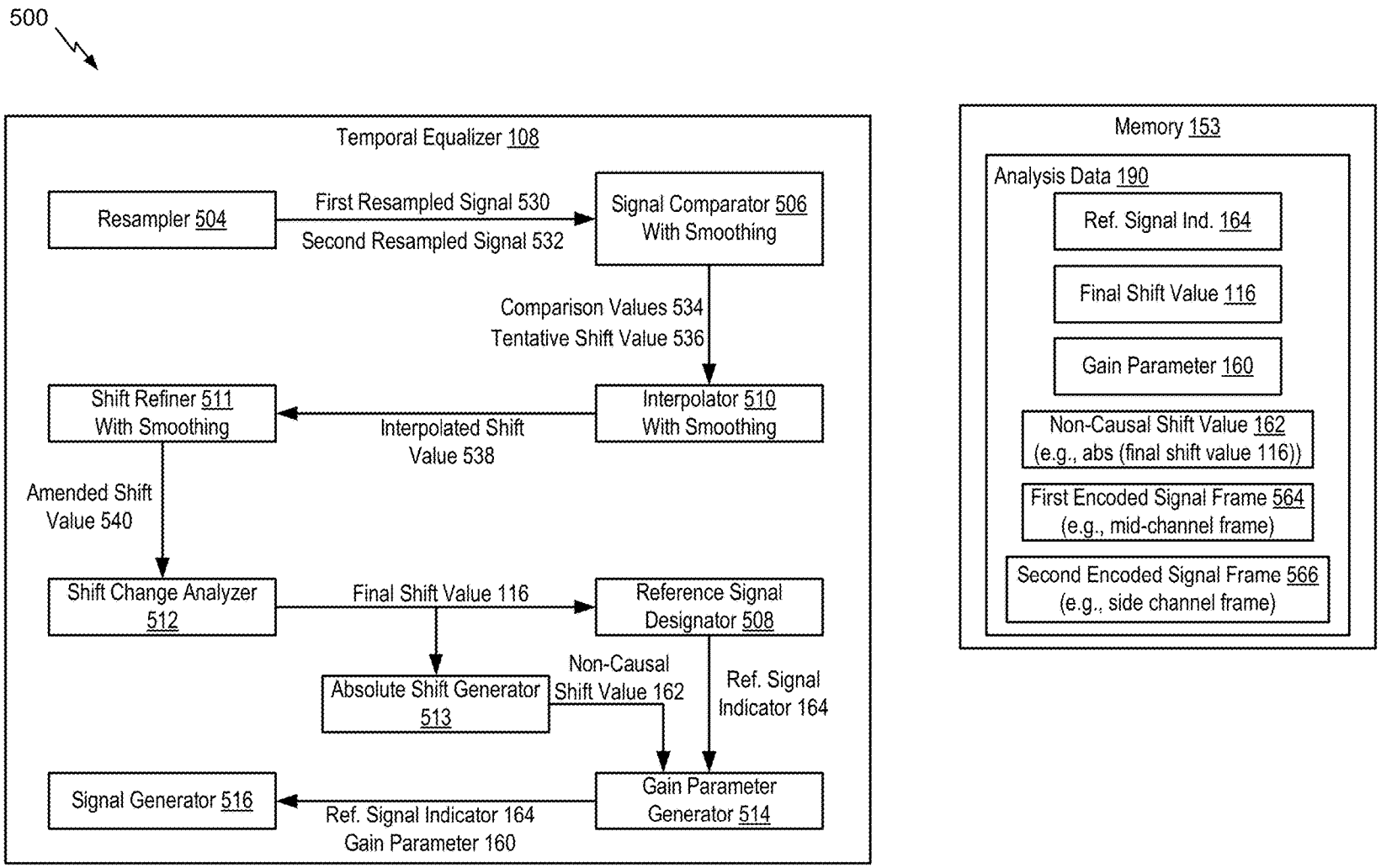
FIG. 5 is a diagram illustrating another example of a system operable to encode multiple audio signals.

Referring to FIG. 5, an illustrative example of a system is shown and generally designated 500. The system 500 may correspond to the system 100 of FIG. 1. For example, the system 100, the first device 104 of FIG. 1, or both, may include one or more components of the system 500. The temporal equalizer 108 may include a resampler 504, a signal comparator 506, an interpolator 510, a shift refiner 511, a shift change analyzer 512, an absolute shift generator 513, a reference signal designator 508, a gain parameter generator 514, a signal generator 516, or a combination thereof.

During operation, the resampler 504 may generate one or more resampled signals, as further described with reference to FIG. 6. For example, the resampler 504 may generate a first resampled signal 530 by resampling (e.g., downsampling or upsampling) the first audio signal 130 based on a resampling (e.g., downsampling or upsampling) factor (D) (e.g., ≥1). The resampler 504 may generate a second resampled signal 532 by resampling the second audio signal 132 based on the resampling factor (D). The resampler 504 may provide the first resampled signal 530, the second resampled signal 532, or both, to the signal comparator 506.

The signal comparator 506 may generate comparison values 534 (e.g., difference values, variation values, similarity values, coherence values, or cross-correlation values), a tentative shift value 536, or both, as further described with reference to FIG. 7. For example, the signal comparator 506 may generate the comparison values 534 based on the first resampled signal 530 and a plurality of shift values applied to the second resampled signal 532, as further described with reference to FIG. 7. The signal comparator 506 may determine the tentative shift value 536 based on the comparison values 534, as further described with reference to FIG. 7. According to one implementation, the signal comparator 506 may retrieve comparison values for previous frames of the resampled signals 530, 532 and may modify the comparison values 534 based on a long-term smoothing operation using the comparison values for previous frames. For example, the comparison values 534 may include the long-term comparison value $CompVal_{LT_N}(k)$ for a current frame (N) and may be represented by $CompVal_{LT_N}(k)=(1-\alpha)*CompVal_N(k), +(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of $\alpha$ increases, the amount of smoothing in the long-term comparison value increases.

The first resampled signal 530 may include fewer samples or more samples than the first audio signal 130. The second resampled signal 532 may include fewer samples or more samples than the second audio signal 132. Determining the comparison values 534 based on the fewer samples of the resampled signals (e.g., the first resampled signal 530 and the second resampled signal 532) may use fewer resources (e.g., time, number of operations, or both) than on samples of the original signals (e.g., the first audio signal 130 and the second audio signal 132). Determining the comparison values 534 based on the more samples of the resampled signals (e.g., the first resampled signal 530 and the second resampled signal 532) may increase precision than on samples of the original signals (e.g., the first audio signal 130 and the second audio signal 132). The signal comparator 506 may provide the comparison values 534, the tentative shift value 536, or both, to the interpolator 510.

The interpolator 510 may extend the tentative shift value 536. For example, the interpolator 510 may generate an interpolated shift value 538, as further described with reference to FIG. 8. For example, the interpolator 510 may generate interpolated comparison values corresponding to shift values that are proximate to the tentative shift value 536 by interpolating the comparison values 534. The interpolator 510 may determine the interpolated shift value 538 based on the interpolated comparison values and the comparison values 534. The comparison values 534 may be based on a coarser granularity of the shift values. For example, the comparison values 534 may be based on a first subset of a set of shift values so that a difference between a first shift value of the first subset and each second shift value of the first subset is greater than or equal to a threshold (e.g., ≥1). The threshold may be based on the resampling factor (D).

The interpolated comparison values may be based on a finer granularity of shift values that are proximate to the resampled tentative shift value 536. For example, the interpolated comparison values may be based on a second subset of the set of shift values so that a difference between a highest shift value of the second subset and the resampled tentative shift value 536 is less than the threshold (e.g., ≥1), and a difference between a lowest shift value of the second subset and the resampled tentative shift value 536 is less than the threshold. Determining the comparison values 534 based on the coarser granularity (e.g., the first subset) of the set of shift values may use fewer resources (e.g., time, operations, or both) than determining the comparison values 534 based on a finer granularity (e.g., all) of the set of shift values. Determining the interpolated comparison values corresponding to the second subset of shift values may extend the tentative shift value 536 based on a finer granularity of a smaller set of shift values that are proximate to the tentative shift value 536 without determining comparison values corresponding to each shift value of the set of shift values. Thus, determining the tentative shift value 536 based on the first subset of shift values and determining the interpolated shift value 538 based on the interpolated comparison values may balance resource usage and refinement of the estimated shift value. The interpolator 510 may provide the interpolated shift value 538 to the shift refiner 511.

According to one implementation, the interpolator 510 may retrieve interpolated shift values for previous frames and may modify the interpolated shift value 538 based on a long-term smoothing operation using the interpolated shift values for previous frames. For example, the interpolated shift value 538 may include a long-term interpolated shift value $InterVal_{LT_N}(k)$ for a current frame (N) and may be represented by $InterVal_{LT_N}(k)=(1-\alpha)*InterVal_N(k),+(\alpha)*InterVal_{LT_{N-1}}(k)$, where $\alpha\in(0, 1.0)$. Thus, the long-term interpolated shift value $InterVal_{LT_N}(k)$ may be based on a weighted mixture of the instantaneous interpolated shift value $InterVal_N(k)$ at frame N and the long-term interpolated shift values $InterVal_{LT_{N-1}}(k)$ for one or more previous frames. As the value of a increases, the amount of smoothing in the long-term comparison value increases.

The shift refiner 511 may generate an amended shift value 540 by refining the interpolated shift value 538, as further described with reference to FIGS. 9A-9C. For example, the shift refiner 511 may determine whether the interpolated shift value 538 indicates that a change in a shift between the first audio signal 130 and the second audio signal 132 is greater than a shift change threshold, as further described with reference to FIG. 9A. The change in the shift may be indicated by a difference (e.g., a variation) between the interpolated shift value 538 and a first shift value associated with the frame 302 of FIG. 3. The shift refiner 511 may, in response to determining that the difference is less than or equal to the threshold, set the amended shift value 540 to the interpolated shift value 538. Alternatively, the shift refiner 511 may, in response to determining that the difference is greater than the threshold, determine a plurality of shift values that correspond to a difference that is less than or equal to the shift change threshold, as further described with reference to FIG. 9A. The shift refiner 511 may determine comparison values based on the first audio signal 130 and the plurality of shift values applied to the second audio signal 132. The shift refiner 511 may determine the amended shift value 540 based on the comparison values, as further described with reference to FIG. 9A. For example, the shift refiner 511 may select a shift value of the plurality of shift values based on the comparison values and the interpolated shift value 538, as further described with reference to FIG. 9A. The shift refiner 511 may set the amended shift value 540 to indicate the selected shift value. A non-zero difference between the first shift value corresponding to the frame 302 and the interpolated shift value 538 may indicate that some samples of the second audio signal 132 correspond to both frames (e.g., the frame 302 and the frame 304). For example, some samples of the second audio signal 132 may be duplicated during encoding. Alternatively, the non-zero difference may indicate that some samples of the second audio signal 132 correspond to neither the frame 302 nor the frame 304. For example, some samples of the second audio signal 132 may be lost during encoding. Setting the amended shift value 540 to one of the plurality of shift values may prevent a large change in shifts between consecutive (or adjacent) frames, thereby reducing an amount of sample loss or sample duplication during encoding. The shift refiner 511 may provide the amended shift value 540 to the shift change analyzer 512.

According to one implementation, the shift refiner may retrieve amended shift values for previous frames and may modify the amended shift value 540 based on a long-term smoothing operation using the amended shift values for previous frames. For example, the amended shift value 540 may include a long-term amended shift value $AmendVal_{LT_N}(k)$ for a current frame (N) and may be represented by $AmendVal_{LT_N}(k)=(1-\alpha)*AmendVal_N(k),+(\alpha)*AmendVal_{LT_{N-1}}(k)$, where $\alpha\in(0, 1.0)$. Thus, the long-term amended shift value $AmendVal_{LT_N}(k)$ may be based on a weighted mixture of the instantaneous amended shift value $AmendVal_N(k)$ at frame N and the long-term amended shift values $AmendVal_{LT_{N-1}}(k)$ for one or more previous frames. As the value of a increases, the amount of smoothing in the long-term comparison value increases.

In some implementations, the shift refiner 511 may adjust the interpolated shift value 538, as described with reference to FIG. 9B. The shift refiner 511 may determine the amended shift value 540 based on the adjusted interpolated shift value 538. In some implementations, the shift refiner 511 may determine the amended shift value 540 as described with reference to FIG. 9C.

The shift change analyzer 512 may determine whether the amended shift value 540 indicates a switch or reverse in timing between the first audio signal 130 and the second audio signal 132, as described with reference to FIG. 1. In particular, a reverse or a switch in timing may indicate that, for the frame 302, the first audio signal 130 is received at the input interface(s) 112 prior to the second audio signal 132, and, for a subsequent frame (e.g., the frame 304 or the frame 306), the second audio signal 132 is received at the input interface(s) prior to the first audio signal 130. Alternatively, a reverse or a switch in timing may indicate that, for the frame 302, the second audio signal 132 is received at the input interface(s) 112 prior to the first audio signal 130, and, for a subsequent frame (e.g., the frame 304 or the frame 306), the first audio signal 130 is received at the input interface(s) prior to the second audio signal 132. In other words, a switch or reverse in timing may be indicate that a final shift value corresponding to the frame 302 has a first sign that is distinct from a second sign of the amended shift value 540 corresponding to the frame 304 (e.g., a positive to negative transition or vice-versa). The shift change analyzer 512 may determine whether delay between the first audio signal 130 and the second audio signal 132 has switched sign based on the amended shift value 540 and the first shift value associated with the frame 302, as further described with reference to FIG. 10A. The shift change analyzer 512 may, in response to determining that the delay between the first audio signal 130 and the second audio signal 132 has switched sign, set the final shift value 116 to a value (e.g., 0) indicating no time shift. Alternatively, the shift change analyzer 512 may set the final shift value 116 to the amended shift value 540 in response to determining that the delay between the first audio signal 130 and the second audio signal 132 has not switched sign, as further described with reference to FIG. 10A. The shift change analyzer 512 may generate an estimated shift value by refining the amended shift value 540, as further described with reference to FIGS. 10A,11. The shift change analyzer 512 may set the final shift value 116 to the estimated shift value. Setting the final shift value 116 to indicate no time shift may reduce distortion at a decoder by refraining from time shifting the first audio signal 130 and the second audio signal 132 in opposite directions for consecutive (or adjacent) frames of the first audio signal 130. The shift change analyzer 512 may provide the final shift value 116 to the reference signal designator 508, to the absolute shift generator 513, or both. In some implementations, the shift change analyzer 512 may determine the final shift value 116 as described with reference to FIG. 10B.

The absolute shift generator 513 may generate the non-causal shift value 162 by applying an absolute function to the final shift value 116. The absolute shift generator 513 may provide the non-causal shift value 162 to the gain parameter generator 514.

The reference signal designator 508 may generate the reference signal indicator 164, as further described with reference to FIGS. 12-13. For example, the reference signal indicator 164 may have a first value indicating that the first audio signal 130 is a reference signal or a second value indicating that the second audio signal 132 is the reference signal. The reference signal designator 508 may provide the reference signal indicator 164 to the gain parameter generator 514.

The gain parameter generator 514 may select samples of the target signal (e.g., the second audio signal 132) based on the non-causal shift value 162. To illustrate, the gain parameter generator 514 may select the samples 358-364 in response to determining that the non-causal shift value 162 has a first value (e.g., +X ms or +Y samples, where X and Y include positive real numbers). The gain parameter generator 514 may select the samples 354-360 in response to determining that the non-causal shift value 162 has a second value (e.g., −X ms or −Y samples). The gain parameter generator 514 may select the samples 356-362 in response to determining that the non-causal shift value 162 has a value (e.g., 0) indicating no time shift.

The gain parameter generator 514 may determine whether the first audio signal 130 is the reference signal or the second audio signal 132 is the reference signal based on the reference signal indicator 164. The gain parameter generator 514 may generate the gain parameter 160 based on the samples 326-332 of the frame 304 and the selected samples (e.g., the samples 354-360, the samples 356-362, or the samples 358-364) of the second audio signal 132, as described with reference to FIG. 1. For example, the gain parameter generator 514 may generate the gain parameter 160 based on one or more of Equation 1a-Equation 1f, where $g_D$ corresponds to the gain parameter 160, Ref(n) corresponds to samples of the reference signal, and Targ(n+$N_1$) corresponds to samples of the target signal. To illustrate, Ref(n) may correspond to the samples 326-332 of the frame 304 and Targ(n+t$N_1$) may correspond to the samples 358-364 of the frame 344 when the non-causal shift value 162 has a first value (e.g., +X ms or +Y samples, where X and Y include positive real numbers). In some implementations, Ref(n) may correspond to samples of the first audio signal 130 and Targ(n+$N_1$) may correspond to samples of the second audio signal 132, as described with reference to FIG. 1. In alternate implementations, Ref(n) may correspond to samples of the second audio signal 132 and Targ(n+$N_1$) may correspond to samples of the first audio signal 130, as described with reference to FIG. 1.

The gain parameter generator 514 may provide the gain parameter 160, the reference signal indicator 164, the non-causal shift value 162, or a combination thereof, to the signal generator 516. The signal generator 516 may generate the encoded signals 102, as described with reference to FIG. 1. For examples, the encoded signals 102 may include a first encoded signal frame 564 (e.g., a mid channel frame), a second encoded signal frame 566 (e.g., a side channel frame), or both. The signal generator 516 may generate the first encoded signal frame 564 based on Equation 2a or Equation 2b, where M corresponds to the first encoded signal frame 564, $g_D$ corresponds to the gain parameter 160, Ref(n) corresponds to samples of the reference signal, and Targ(n+$N_1$) corresponds to samples of the target signal. The signal generator 516 may generate the second encoded signal frame 566 based on Equation 3a or Equation 3b, where S corresponds to the second encoded signal frame 566, $g_D$ corresponds to the gain parameter 160, Ref(n) corresponds to samples of the reference signal, and Targ(n+$N_1$) corresponds to samples of the target signal.

The temporal equalizer 108 may store the first resampled signal 530, the second resampled signal 532, the comparison values 534, the tentative shift value 536, the interpolated shift value 538, the amended shift value 540, the non-causal shift value 162, the reference signal indicator 164, the final shift value 116, the gain parameter 160, the first encoded signal frame 564, the second encoded signal frame 566, or a combination thereof, in the memory 153. For example, the analysis data 190 may include the first resampled signal 530, the second resampled signal 532, the comparison values 534, the tentative shift value 536, the interpolated shift value 538, the amended shift value 540, the non-causal shift value 162, the reference signal indicator 164, the final shift value 116, the gain parameter 160, the first encoded signal frame 564, the second encoded signal frame 566, or a combination thereof.

The smoothing techniques described above may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

Figure 6:
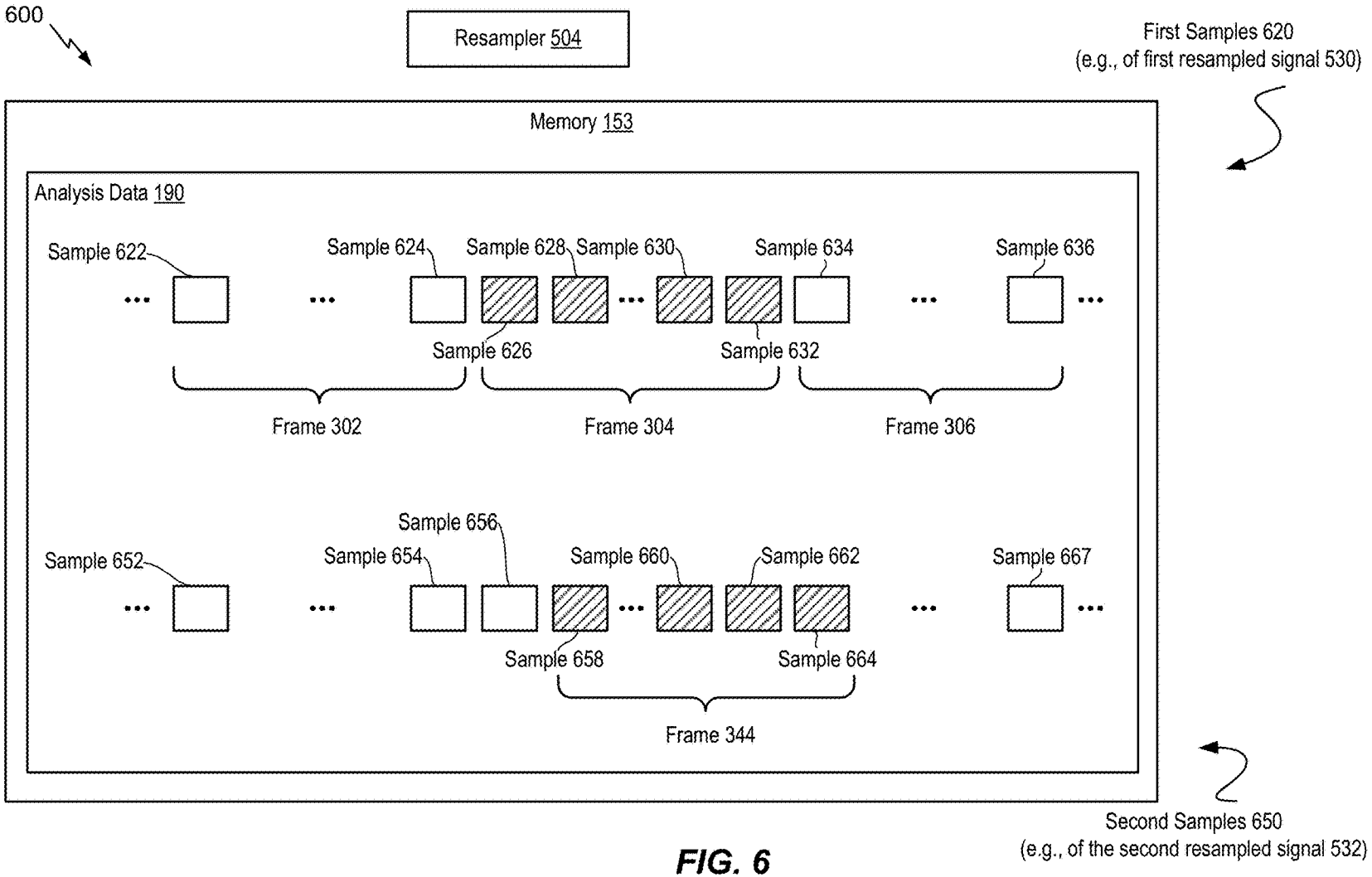
FIG. 6 is a diagram illustrating another example of a system operable to encode multiple audio signals.

Referring to FIG. 6, an illustrative example of a system is shown and generally designated 600. The system 600 may correspond to the system 100 of FIG. 1. For example, the system 100, the first device 104 of FIG. 1, or both, may include one or more components of the system 600.

The resampler 504 may generate first samples 620 of the first resampled signal 530 by resampling (e.g., downsampling or upsampling) the first audio signal 130 of FIG. 1. The resampler 504 may generate second samples 650 of the second resampled signal 532 by resampling (e.g., downsampling or upsampling) the second audio signal 132 of FIG. 1.

The first audio signal 130 may be sampled at a first sample rate (Fs) to generate the first samples 320 of FIG. 3. The first sample rate (Fs) may correspond to a first rate (e.g., 16 kilohertz (kHz)) associated with wideband (WB) bandwidth, a second rate (e.g., 32 kHz) associated with super wideband (SWB) bandwidth, a third rate (e.g., 48 kHz) associated with full band (FB) bandwidth, or another rate. The second audio signal 132 may be sampled at the first sample rate (Fs) to generate the second samples 350 of FIG. 3.

In some implementations, the resampler 504 may preprocess the first audio signal 130 (or the second audio signal 132) prior to resampling the first audio signal 130 (or the second audio signal 132). The resampler 504 may preprocess the first audio signal 130 (or the second audio signal 132) by filtering the first audio signal 130 (or the second audio signal 132) based on an infinite impulse response (IIR) filter (e.g., a first order IIR filter). The IIR filter may be based on the following Equation:

$$H_{pre}(z)=1/(1-\alpha z^{-1}), \quad \text{Equation 4}$$

where $\alpha$ is positive, such as 0.68 or 0.72. Performing the de-emphasis prior to resampling may reduce effects, such as aliasing, signal conditioning, or both. The first audio signal 130 (e.g., the pre-processed first audio signal 130) and the second audio signal 132 (e.g., the pre-processed second audio signal 132) may be resampled based on a resampling factor (D). The resampling factor (D) may be based on the first sample rate (Fs) (e.g., D=Fs/8, D=2Fs, etc.).

In alternate implementations, the first audio signal 130 and the second audio signal 132 may be low-pass filtered or decimated using an anti-aliasing filter prior to resampling. The decimation filter may be based on the resampling factor (D). In a particular example, the resampler 504 may select a decimation filter with a first cut-off frequency (e.g., $\pi$/D or $\pi$/4) in response to determining that the first sample rate (Fs) corresponds to a particular rate (e.g., 32 kHz). Reducing aliasing by de-emphasizing multiple signals (e.g., the first audio signal 130 and the second audio signal 132) may be computationally less expensive than applying a decimation filter to the multiple signals.

The first samples 620 may include a sample 622, a sample 624, a sample 626, a sample 628, a sample 630, a sample 632, a sample 634, a sample 636, one or more additional samples, or a combination thereof. The first samples 620 may include a subset (e.g., ⅛ th) of the first samples 320 of FIG. 3. The sample 622, the sample 624, one or more additional samples, or a combination thereof, may correspond to the frame 302. The sample 626, the sample 628, the sample 630, the sample 632, one or more additional samples, or a combination thereof, may correspond to the frame 304. The sample 634, the sample 636, one or more additional samples, or a combination thereof, may correspond to the frame 306.

The second samples 650 may include a sample 652, a sample 654, a sample 656, a sample 658, a sample 660, a sample 662, a sample 664, a sample 667, one or more additional samples, or a combination thereof. The second samples 650 may include a subset (e.g., ⅛ th) of the second samples 350 of FIG. 3. The samples 654-660 may correspond to the samples 354-360. For example, the samples 654-660 may include a subset (e.g., ⅛ th) of the samples 354-360. The samples 656-662 may correspond to the samples 356-362. For example, the samples 656-662 may include a subset (e.g., ⅛ th) of the samples 356-362. The samples 658-664 may correspond to the samples 358-364. For example, the samples 658-664 may include a subset (e.g., ⅛ th) of the samples 358-364. In some implementations, the resampling factor may correspond to a first value (e.g., 1) where samples 622-636 and samples 652-667 of FIG. 6 may be similar to samples 322-336 and samples 352-366 of FIG. 3, respectively.

The resampler 504 may store the first samples 620, the second samples 650, or both, in the memory 153. For example, the analysis data 190 may include the first samples 620, the second samples 650, or both.

Figure 7:
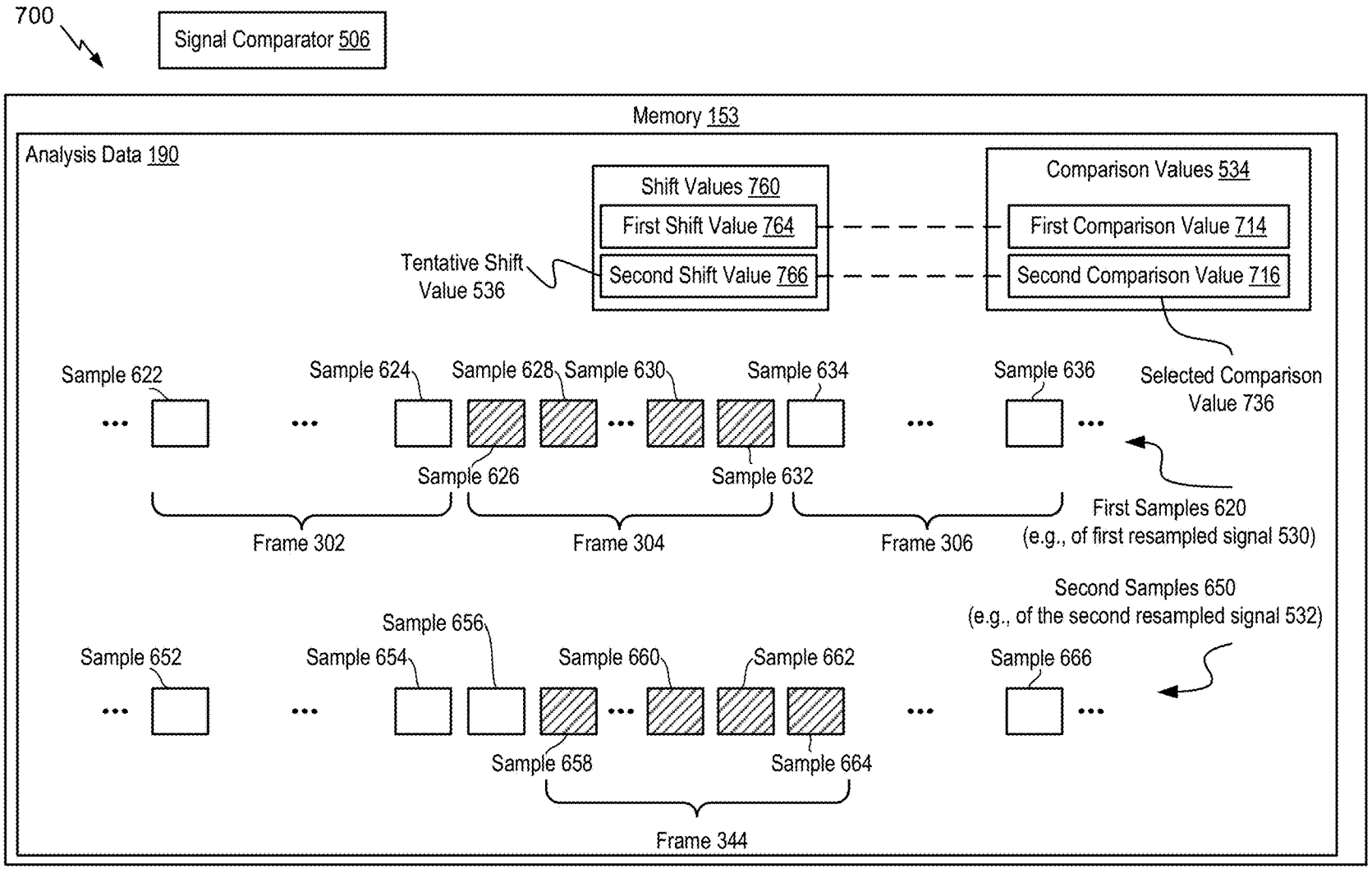
FIG. 7 is a diagram illustrating another example of a system operable to encode multiple audio signals.

Referring to FIG. 7, an illustrative example of a system is shown and generally designated 700. The system 700 may correspond to the system 100 of FIG. 1. For example, the system 100, the first device 104 of FIG. 1, or both, may include one or more components of the system 700.

The memory 153 may store a plurality of shift values 760. The shift values 760 may include a first shift value 764 (e.g., −X ms or −Y samples, where X and Y include positive real numbers), a second shift value 766 (e.g., +X ms or +Y samples, where X and Y include positive real numbers), or both. The shift values 760 may range from a lower shift value (e.g., a minimum shift value, T_MIN) to a higher shift value (e.g., a maximum shift value, T_MAX). The shift values 760 may indicate an expected temporal shift (e.g., a maximum expected temporal shift) between the first audio signal 130 and the second audio signal 132.

During operation, the signal comparator 506 may determine the comparison values 534 based on the first samples 620 and the shift values 760 applied to the second samples 650. For example, the samples 626-632 may correspond to a first time (t). To illustrate, the input interface(s) 112 of FIG. 1 may receive the samples 626-632 corresponding to the frame 304 at approximately the first time (t). The first shift value 764 (e.g., −X ms or −Y samples, where X and Y include positive real numbers) may correspond to a second time (t−1).

The samples 654-660 may correspond to the second time (t−1). For example, the input interface(s) 112 may receive the samples 654-660 at approximately the second time (t−1). The signal comparator 506 may determine a first comparison value 714 (e.g., a difference value, a variation value, or a cross-correlation value) corresponding to the first shift value 764 based on the samples 626-632 and the samples 654-660. For example, the first comparison value 714 may correspond to an absolute value of cross-correlation of the samples 626-632 and the samples 654-660. As another example, the first comparison value 714 may indicate a difference between the samples 626-632 and the samples 654-660.

The second shift value 766 (e.g., +X ms or +Y samples, where X and Y include positive real numbers) may correspond to a third time (t+1). The samples 658-664 may correspond to the third time (t+1). For example, the input interface(s) 112 may receive the samples 658-664 at approximately the third time (t+1). The signal comparator 506 may determine a second comparison value 716 (e.g., a difference value, a variation value, or a cross-correlation value) corresponding to the second shift value 766 based on the samples 626-632 and the samples 658-664. For example, the second comparison value 716 may correspond to an absolute value of cross-correlation of the samples 626-632 and the samples 658-664. As another example, the second comparison value 716 may indicate a difference between the samples 626-632 and the samples 658-664. The signal comparator 506 may store the comparison values 534 in the memory 153. For example, the analysis data 190 may include the comparison values 534.

The signal comparator 506 may identify a selected comparison value 736 of the comparison values 534 that has a higher (or lower) value than other values of the comparison values 534. For example, the signal comparator 506 may select the second comparison value 716 as the selected comparison value 736 in response to determining that the second comparison value 716 is greater than or equal to the first comparison value 714. In some implementations, the comparison values 534 may correspond to cross-correlation values. The signal comparator 506 may, in response to determining that the second comparison value 716 is greater than the first comparison value 714, determine that the samples 626-632 have a higher correlation with the samples 658-664 than with the samples 654-660. The signal comparator 506 may select the second comparison value 716 that indicates the higher correlation as the selected comparison value 736. In other implementations, the comparison values 534 may correspond to difference values (e.g., variation values). The signal comparator 506 may, in response to determining that the second comparison value 716 is lower than the first comparison value 714, determine that the samples 626-632 have a greater similarity with (e.g., a lower difference to) the samples 658-664 than the samples 654-660. The signal comparator 506 may select the second comparison value 716 that indicates a lower difference as the selected comparison value 736.

The selected comparison value 736 may indicate a higher correlation (or a lower difference) than the other values of the comparison values 534. The signal comparator 506 may identify the tentative shift value 536 of the shift values 760 that corresponds to the selected comparison value 736. For example, the signal comparator 506 may identify the second shift value 766 as the tentative shift value 536 in response to determining that the second shift value 766 corresponds to the selected comparison value 736 (e.g., the second comparison value 716).

The signal comparator 506 may determine the selected comparison value 736 based on the following Equation:

$$\max XCorr=\max(|\Sigma_{k=-K}^{K} w(n)l'(n)*w(n+k)r'(n+k)|), \quad \text{Equation 5}$$

where maxXCorr corresponds to the selected comparison value 736 and k corresponds to a shift value. w(n)*l' corresponds to de-emphasized, resampled, and windowed first audio signal 130, and w(n)*r' corresponds to de-emphasized, resampled, and windowed second audio signal 132. For example, w(n)*l' may correspond to the samples 626-632, w(n−l)*r' may correspond to the samples 654-660, w(n)*r' may correspond to the samples 656-662, and w(n+l)*r' may correspond to the samples 658-664. −K may correspond to a lower shift value (e.g., a minimum shift value) of the shift values 760, and K may correspond to a higher shift value (e.g., a maximum shift value) of the shift values 760. In Equation 5, w(n)*l' corresponds to the first audio signal 130 independently of whether the first audio signal 130 corresponds to a right (r) channel signal or a left (l) channel signal. In Equation 5, w(n)*r' corresponds to the second audio signal 132 independently of whether the second audio signal 132 corresponds to the right (r) channel signal or the left (l) channel signal.

The signal comparator 506 may determine the tentative shift value 536 based on the following Equation:

$$T=_{k}^{argmax}(|\Sigma_{k=-K}^{K} w(n)l'(n)*w(n+k)r'(n+k)|), \quad \text{Equation 6}$$

where T corresponds to the tentative shift value 536.

The signal comparator 506 may map the tentative shift value 536 from the resampled samples to the original samples based on the resampling factor (D) of FIG. 6. For example, the signal comparator 506 may update the tentative shift value 536 based on the resampling factor (D). To illustrate, the signal comparator 506 may set the tentative shift value 536 to a product (e.g., 12) of the tentative shift value 536 (e.g., 3) and the resampling factor (D) (e.g., 4).

Figure 8:
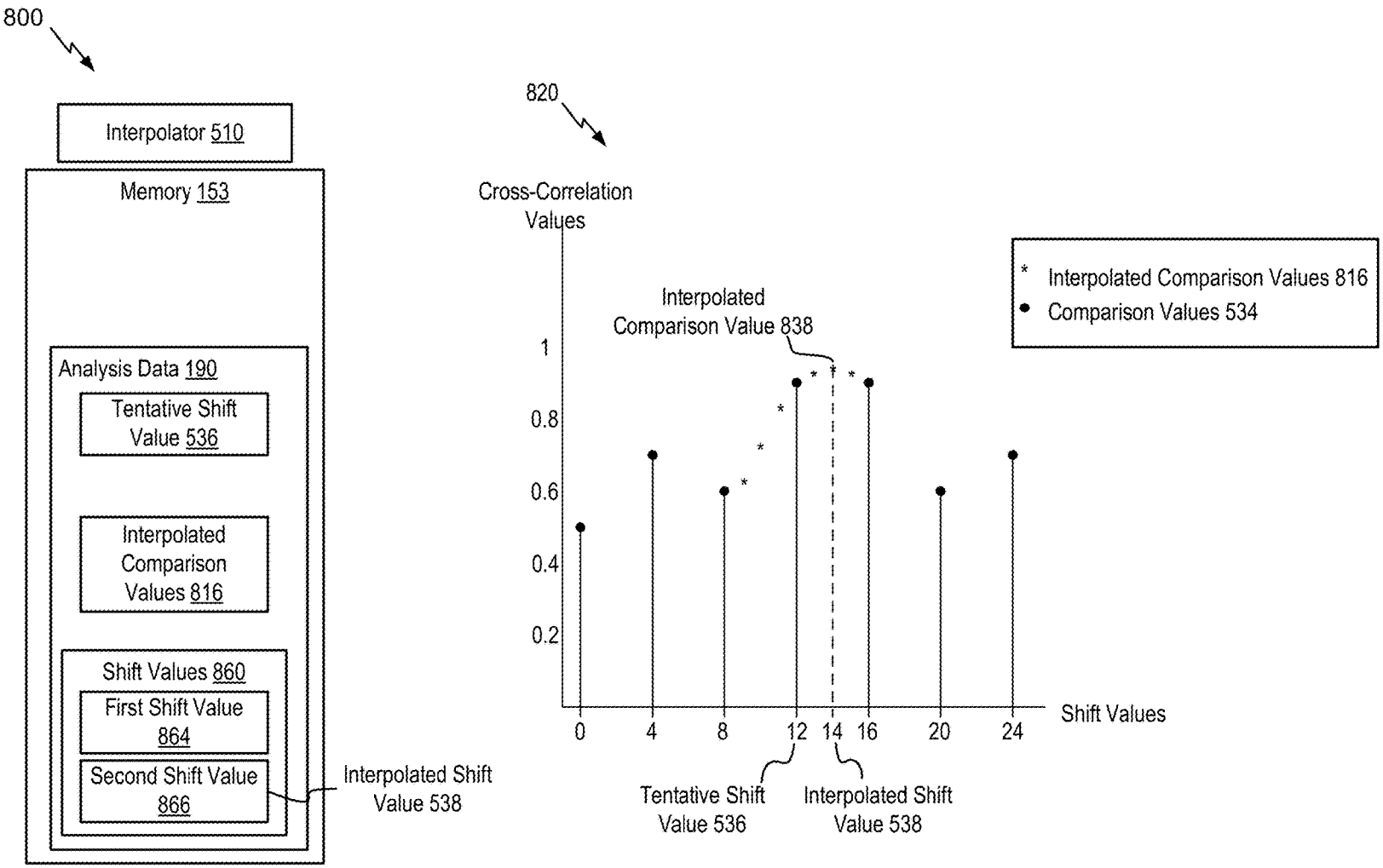
FIG. 8 is a diagram illustrating another example of a system operable to encode multiple audio signals.

Referring to FIG. 8, an illustrative example of a system is shown and generally designated 800. The system 800 may correspond to the system 100 of FIG. 1. For example, the system 100, the first device 104 of FIG. 1, or both, may include one or more components of the system 800. The memory 153 may be configured to store shift values 860. The shift values 860 may include a first shift value 864, a second shift value 866, or both.

During operation, the interpolator 510 may generate the shift values 860 proximate to the tentative shift value 536 (e.g., 12), as described herein. Mapped shift values may correspond to the shift values 760 mapped from the resampled samples to the original samples based on the resampling factor (D). For example, a first mapped shift value of the mapped shift values may correspond to a product of the first shift value 764 and the resampling factor (D). A difference between a first mapped shift value of the mapped shift values and each second mapped shift value of the mapped shift values may be greater than or equal to a threshold value (e.g., the resampling factor (D), such as 4). The shift values 860 may have finer granularity than the shift values 760. For example, a difference between a lower value (e.g., a minimum value) of the shift values 860 and the tentative shift value 536 may be less than the threshold value (e.g., 4). The threshold value may correspond to the resampling factor (D) of FIG. 6. The shift values 860 may range from a first value (e.g., the tentative shift value 536−(the threshold value−1)) to a second value (e.g., the tentative shift value 536+(threshold value−1)).

The interpolator 510 may generate interpolated comparison values 816 corresponding to the shift values 860 by performing interpolation on the comparison values 534, as described herein. Comparison values corresponding to one or more of the shift values 860 may be excluded from the comparison values 534 because of the lower granularity of the comparison values 534. Using the interpolated comparison values 816 may enable searching of interpolated comparison values corresponding to the one or more of the shift values 860 to determine whether an interpolated comparison value corresponding to a particular shift value proximate to the tentative shift value 536 indicates a higher correlation (or lower difference) than the second comparison value 716 of FIG. 7.

FIG. 8 includes a graph 820 illustrating examples of the interpolated comparison values 816 and the comparison values 534 (e.g., cross-correlation values). The interpolator 510 may perform the interpolation based on a hanning windowed sinc interpolation, IIR filter based interpolation, spline interpolation, another form of signal interpolation, or a combination thereof. For example, the interpolator 510 may perform the hanning windowed sinc interpolation based on the following Equation:

$$R(k)_{32\ kHz}=\Sigma_{i=-4}^{4} R(\hat{t}_{N2}-i)_{8\ kHz}*b(3i+t), \quad \text{Equation 7}$$

where t=b corresponds to a windowed sinc function, $\hat{t}_{N2}$ corresponds to the tentative shift value 536. $R(\hat{t}_{N2}-i)_{8\ kHz}$ may correspond to a particular comparison value of the comparison values 534. For example, $R(\hat{t}_{N2}-i)_{8\ kHz}$ may indicate a first comparison value of the comparison values 534 that corresponds to a first shift value (e.g., 8) when i corresponds to 4. $R(\hat{t}_{N2}-i)_{8\ kHz}$ may indicate the second comparison value 716 that corresponds to the tentative shift value 536 (e.g., 12) when i corresponds to 0. $R(\hat{t}_{N2}-i)_{8\ kHz}$ may indicate a third comparison value of the comparison values 534 that corresponds to a third shift value (e.g., 16) when i corresponds to −4.

$R(k)_{32\ kHz}$ may correspond to a particular interpolated value of the interpolated comparison values 816. Each interpolated value of the interpolated comparison values 816 may correspond to a sum of a product of the windowed sinc function (b) and each of the first comparison value, the second comparison value 716, and the third comparison value. For example, the interpolator 510 may determine a first product of the windowed sinc function (b) and the first comparison value, a second product of the windowed sinc function (b) and the second comparison value 716, and a third product of the windowed sinc function (b) and the third comparison value. The interpolator 510 may determine a particular interpolated value based on a sum of the first product, the second product, and the third product. A first interpolated value of the interpolated comparison values 816 may correspond to a first shift value (e.g., 9). The windowed sinc function (b) may have a first value corresponding to the first shift value. A second interpolated value of the interpolated comparison values 816 may correspond to a second shift value (e.g., 10). The windowed sinc function (b) may have a second value corresponding to the second shift value. The first value of the windowed sinc function (b) may be distinct from the second value. The first interpolated value may thus be distinct from the second interpolated value.

In Equation 7, 8 kHz may correspond to a first rate of the comparison values 534. For example, the first rate may indicate a number (e.g., 8) of comparison values corresponding to a frame (e.g., the frame 304 of FIG. 3) that are included in the comparison values 534. 32 kHz may correspond to a second rate of the interpolated comparison values 816. For example, the second rate may indicate a number (e.g., 32) of interpolated comparison values corresponding to a frame (e.g., the frame 304 of FIG. 3) that are included in the interpolated comparison values 816.

The interpolator 510 may select an interpolated comparison value 838 (e.g., a maximum value or a minimum value) of the interpolated comparison values 816. The interpolator 510 may select a shift value (e.g., 14) of the shift values 860 that corresponds to the interpolated comparison value 838. The interpolator 510 may generate the interpolated shift value 538 indicating the selected shift value (e.g., the second shift value 866).

Using a coarse approach to determine the tentative shift value 536 and searching around the tentative shift value 536 to determine the interpolated shift value 538 may reduce search complexity without compromising search efficiency or accuracy.

Figure 9A:
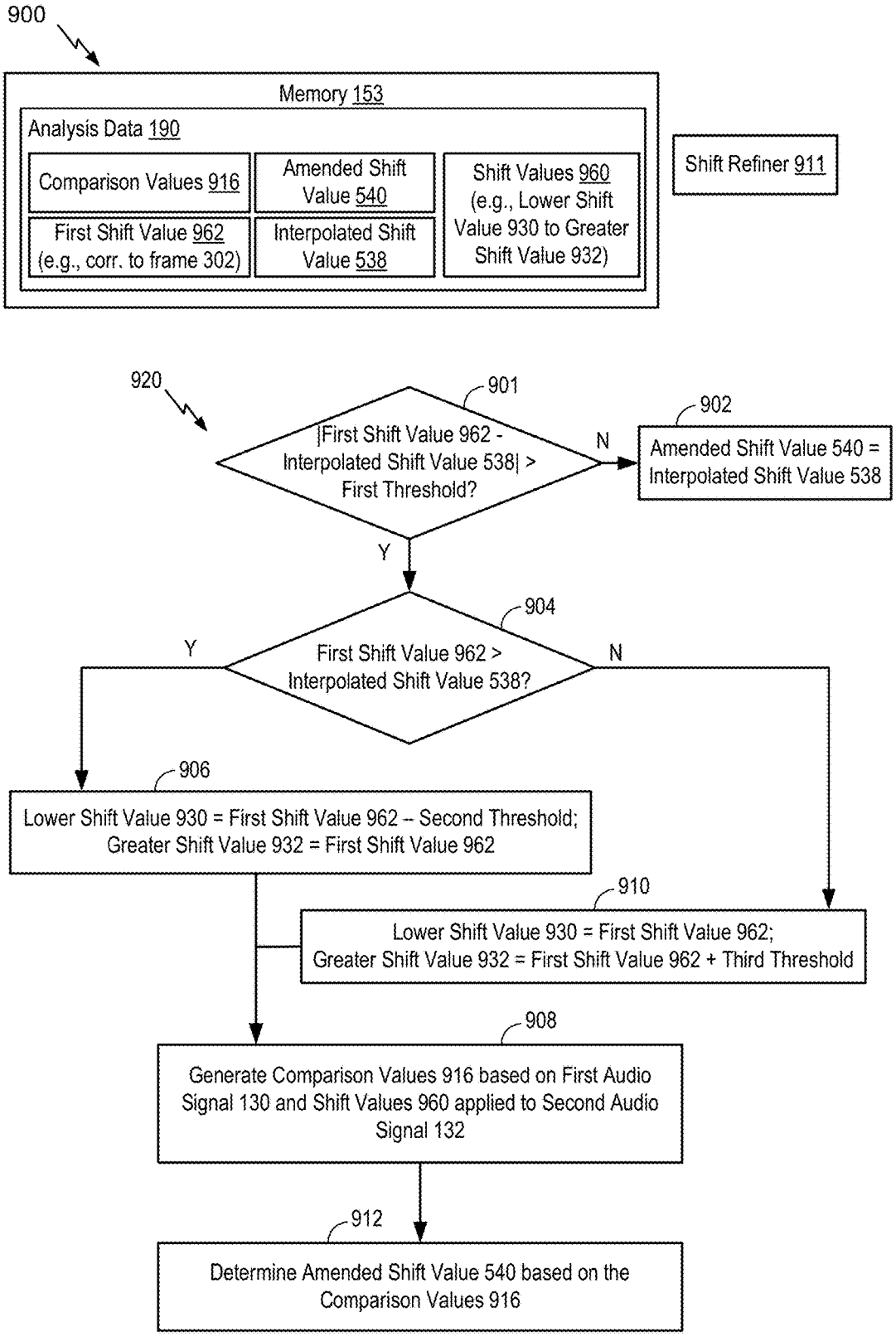
FIG. 9A is a diagram illustrating another example of a system operable to encode multiple audio signals.

Referring to FIG. 9A, an illustrative example of a system is shown and generally designated 900. The system 900 may correspond to the system 100 of FIG. 1. For example, the system 100, the first device 104 of FIG. 1, or both, may include one or more components of the system 900. The system 900 may include the memory 153, a shift refiner 911, or both. The memory 153 may be configured to store a first shift value 962 corresponding to the frame 302. For example, the analysis data 190 may include the first shift value 962. The first shift value 962 may correspond to a tentative shift value, an interpolated shift value, an amended shift value, a final shift value, or a non-causal shift value associated with the frame 302. The frame 302 may precede the frame 304 in the first audio signal 130. The shift refiner 911 may correspond to the shift refiner 511 of FIG. 1.

FIG. 9A also includes a flow chart of an illustrative method of operation generally designated 920. The method 920 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911, or a combination thereof.

The method 920 includes determining whether an absolute value of a difference between the first shift value 962 and the interpolated shift value 538 is greater than a first threshold, at 901. For example, the shift refiner 911 may determine whether an absolute value of a difference between the first shift value 962 and the interpolated shift value 538 is greater than a first threshold (e.g., a shift change threshold).

The method 920 also includes, in response to determining that the absolute value is less than or equal to the first threshold, at 901, setting the amended shift value 540 to indicate the interpolated shift value 538, at 902. For example, the shift refiner 911 may, in response to determining that the absolute value is less than or equal to the shift change threshold, set the amended shift value 540 to indicate the interpolated shift value 538. In some implementations, the shift change threshold may have a first value (e.g., 0) indicating that the amended shift value 540 is to be set to the interpolated shift value 538 when the first shift value 962 is equal to the interpolated shift value 538. In alternate implementations, the shift change threshold may have a second value (e.g., ≥1) indicating that the amended shift value 540 is to be set to the interpolated shift value 538, at 902, with a greater degree of freedom. For example, the amended shift value 540 may be set to the interpolated shift value 538 for a range of differences between the first shift value 962 and the interpolated shift value 538. To illustrate, the amended shift value 540 may be set to the interpolated shift value 538 when an absolute value of a difference (e.g., −2, −1, 0, 1, 2) between the first shift value 962 and the interpolated shift value 538 is less than or equal to the shift change threshold (e.g., 2).

The method 920 further includes, in response to determining that the absolute value is greater than the first threshold, at 901, determining whether the first shift value 962 is greater than the interpolated shift value 538, at 904. For example, the shift refiner 911 may, in response to determining that the absolute value is greater than the shift change threshold, determine whether the first shift value 962 is greater than the interpolated shift value 538.

The method 920 also includes, in response to determining that the first shift value 962 is greater than the interpolated shift value 538, at 904, setting a lower shift value 930 to a difference between the first shift value 962 and a second threshold, and setting a greater shift value 932 to the first shift value 962, at 906. For example, the shift refiner 911 may, in response to determining that the first shift value 962 (e.g., 20) is greater than the interpolated shift value 538 (e.g., 14), set the lower shift value 930 (e.g., 17) to a difference between the first shift value 962 (e.g., 20) and a second threshold (e.g., 3). Additionally, or in the alternative, the shift refiner 911 may, in response to determining that the first shift value 962 is greater than the interpolated shift value 538, set the greater shift value 932 (e.g., 20) to the first shift value 962. The second threshold may be based on the difference between the first shift value 962 and the interpolated shift value 538. In some implementations, the lower shift value 930 may be set to a difference between the interpolated shift value 538 offset and a threshold (e.g., the second threshold) and the greater shift value 932 may be set to a difference between the first shift value 962 and a threshold (e.g., the second threshold).

The method 920 further includes, in response to determining that the first shift value 962 is less than or equal to the interpolated shift value 538, at 904, setting the lower shift value 930 to the first shift value 962, and setting a greater shift value 932 to a sum of the first shift value 962 and a third threshold, at 910. For example, the shift refiner 911 may, in response to determining that the first shift value 962 (e.g., 10) is less than or equal to the interpolated shift value 538 (e.g., 14), set the lower shift value 930 to the first shift value 962 (e.g., 10). Additionally, or in the alternative, the shift refiner 911 may, in response to determining that the first shift value 962 is less than or equal to the interpolated shift value 538, set the greater shift value 932 (e.g., 13) to a sum of the first shift value 962 (e.g., 10) and a third threshold (e.g., 3). The third threshold may be based on the difference between the first shift value 962 and the interpolated shift value 538. In some implementations, the lower shift value 930 may be set to a difference between the first shift value 962 offset and a threshold (e.g., the third threshold) and the greater shift value 932 may be set to a difference between the interpolated shift value 538 and a threshold (e.g., the third threshold).

The method 920 also includes determining comparison values 916 based on the first audio signal 130 and shift values 960 applied to the second audio signal 132, at 908. For example, the shift refiner 911 (or the signal comparator 506) may generate the comparison values 916, as described with reference to FIG. 7, based on the first audio signal 130 and the shift values 960 applied to the second audio signal 132. To illustrate, the shift values 960 may range from the lower shift value 930 (e.g., 17) to the greater shift value 932 (e.g., 20). The shift refiner 911 (or the signal comparator 506) may generate a particular comparison value of the comparison values 916 based on the samples 326-332 and a particular subset of the second samples 350. The particular subset of the second samples 350 may correspond to a particular shift value (e.g., 17) of the shift values 960. The particular comparison value may indicate a difference (or a correlation) between the samples 326-332 and the particular subset of the second samples 350.

The method 920 further includes determining the amended shift value 540 based on the comparison values 916 generated based on the first audio signal 130 and the second audio signal 132, at 912. For example, the shift refiner 911 may determine the amended shift value 540 based on the comparison values 916. To illustrate, in a first case, when the comparison values 916 correspond to cross-correlation values, the shift refiner 911 may determine that the interpolated comparison value 838 of FIG. 8 corresponding to the interpolated shift value 538 is greater than or equal to a highest comparison value of the comparison values 916. Alternatively, when the comparison values 916 correspond to difference values (e.g., variation values), the shift refiner 911 may determine that the interpolated comparison value 838 is less than or equal to a lowest comparison value of the comparison values 916. In this case, the shift refiner 911 may, in response to determining that the first shift value 962 (e.g., 20) is greater than the interpolated shift value 538 (e.g., 14), set the amended shift value 540 to the lower shift value 930 (e.g., 17). Alternatively, the shift refiner 911 may, in response to determining that the first shift value 962 (e.g., 10) is less than or equal to the interpolated shift value 538 (e.g., 14), set the amended shift value 540 to the greater shift value 932 (e.g., 13).

In a second case, when the comparison values 916 correspond to cross-correlation values, the shift refiner 911 may determine that the interpolated comparison value 838 is less than the highest comparison value of the comparison values 916 and may set the amended shift value 540 to a particular shift value (e.g., 18) of the shift values 960 that corresponds to the highest comparison value. Alternatively, when the comparison values 916 correspond to difference values (e.g., variation values), the shift refiner 911 may determine that the interpolated comparison value 838 is greater than the lowest comparison value of the comparison values 916 and may set the amended shift value 540 to a particular shift value (e.g., 18) of the shift values 960 that corresponds to the lowest comparison value.

The comparison values 916 may be generated based on the first audio signal 130, the second audio signal 132, and the shift values 960. The amended shift value 540 may be generated based on comparison values 916 using a similar procedure as performed by the signal comparator 506, as described with reference to FIG. 7.

The method 920 may thus enable the shift refiner 911 to limit a change in a shift value associated with consecutive (or adjacent) frames. The reduced change in the shift value may reduce sample loss or sample duplication during encoding.

Figure 9B:
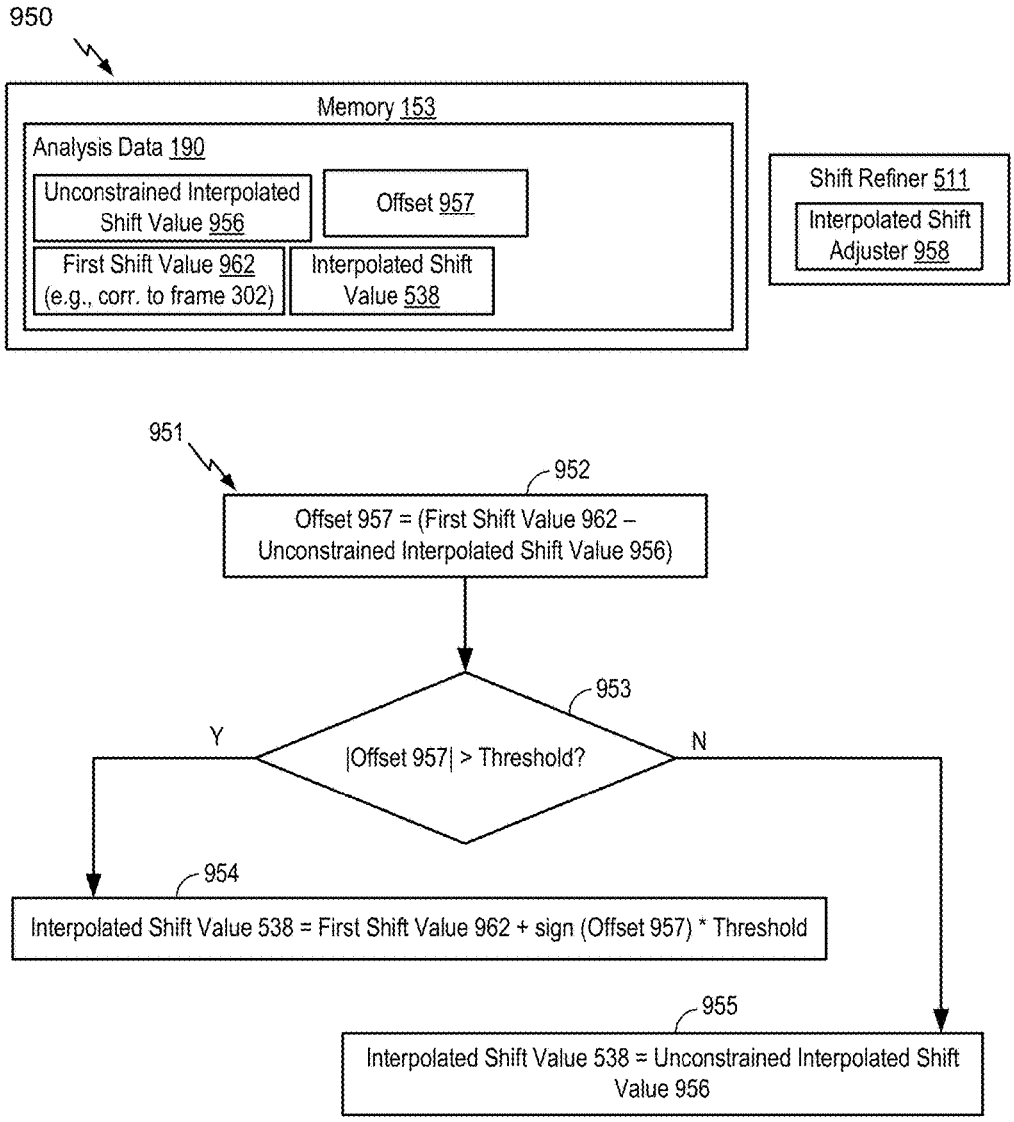
FIG. 9B is a diagram illustrating another example of a system operable to encode multiple audio signals.

Referring to FIG. 9B, an illustrative example of a system is shown and generally designated 950. The system 950 may correspond to the system 100 of FIG. 1. For example, the system 100, the first device 104 of FIG. 1, or both, may include one or more components of the system 950. The system 950 may include the memory 153, the shift refiner 511, or both. The shift refiner 511 may include an interpolated shift adjuster 958. The interpolated shift adjuster 958 may be configured to selectively adjust the interpolated shift value 538 based on the first shift value 962, as described herein. The shift refiner 511 may determine the amended shift value 540 based on the interpolated shift value 538 (e.g., the adjusted interpolated shift value 538), as described with reference to FIGS. 9A, 9C.

FIG. 9B also includes a flow chart of an illustrative method of operation generally designated 951. The method 951 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911 of FIG. 9A, the interpolated shift adjuster 958, or a combination thereof.

The method 951 includes generating an offset 957 based on a difference between the first shift value 962 and an unconstrained interpolated shift value 956, at 952. For example, the interpolated shift adjuster 958 may generate the offset 957 based on a difference between the first shift value 962 and an unconstrained interpolated shift value 956. The unconstrained interpolated shift value 956 may correspond to the interpolated shift value 538 (e.g., prior to adjustment by the interpolated shift adjuster 958). The interpolated shift adjuster 958 may store the unconstrained interpolated shift value 956 in the memory 153. For example, the analysis data 190 may include the unconstrained interpolated shift value 956.

The method 951 also includes determining whether an absolute value of the offset 957 is greater than a threshold, at 953. For example, the interpolated shift adjuster 958 may determine whether an absolute value of the offset 957 satisfies a threshold. The threshold may correspond to an interpolated shift limitation MAX_SHIFT_CHANGE (e.g., 4).

The method 951 includes, in response to determining that the absolute value of the offset 957 is greater than the threshold, at 953, setting the interpolated shift value 538 based on the first shift value 962, a sign of the offset 957, and the threshold, at 954. For example, the interpolated shift adjuster 958 may in response to determining that the absolute value of the offset 957 fails to satisfy (e.g., is greater than) the threshold, constrain the interpolated shift value 538. To illustrate, the interpolated shift adjuster 958 may adjust the interpolated shift value 538 based on the first shift value 962, a sign (e.g., +1 or −1) of the offset 957, and the threshold (e.g., the interpolated shift value 538=the first shift value 962+sign (the offset 957)*Threshold).

The method 951 includes, in response to determining that the absolute value of the offset 957 is less than or equal to the threshold, at 953, set the interpolated shift value 538 to the unconstrained interpolated shift value 956, at 955. For example, the interpolated shift adjuster 958 may in response to determining that the absolute value of the offset 957 satisfies (e.g., is less than or equal to) the threshold, refrain from changing the interpolated shift value 538.

The method 951 may thus enable constraining the interpolated shift value 538 such that a change in the interpolated shift value 538 relative to the first shift value 962 satisfies an interpolation shift limitation.

Figure 9C:
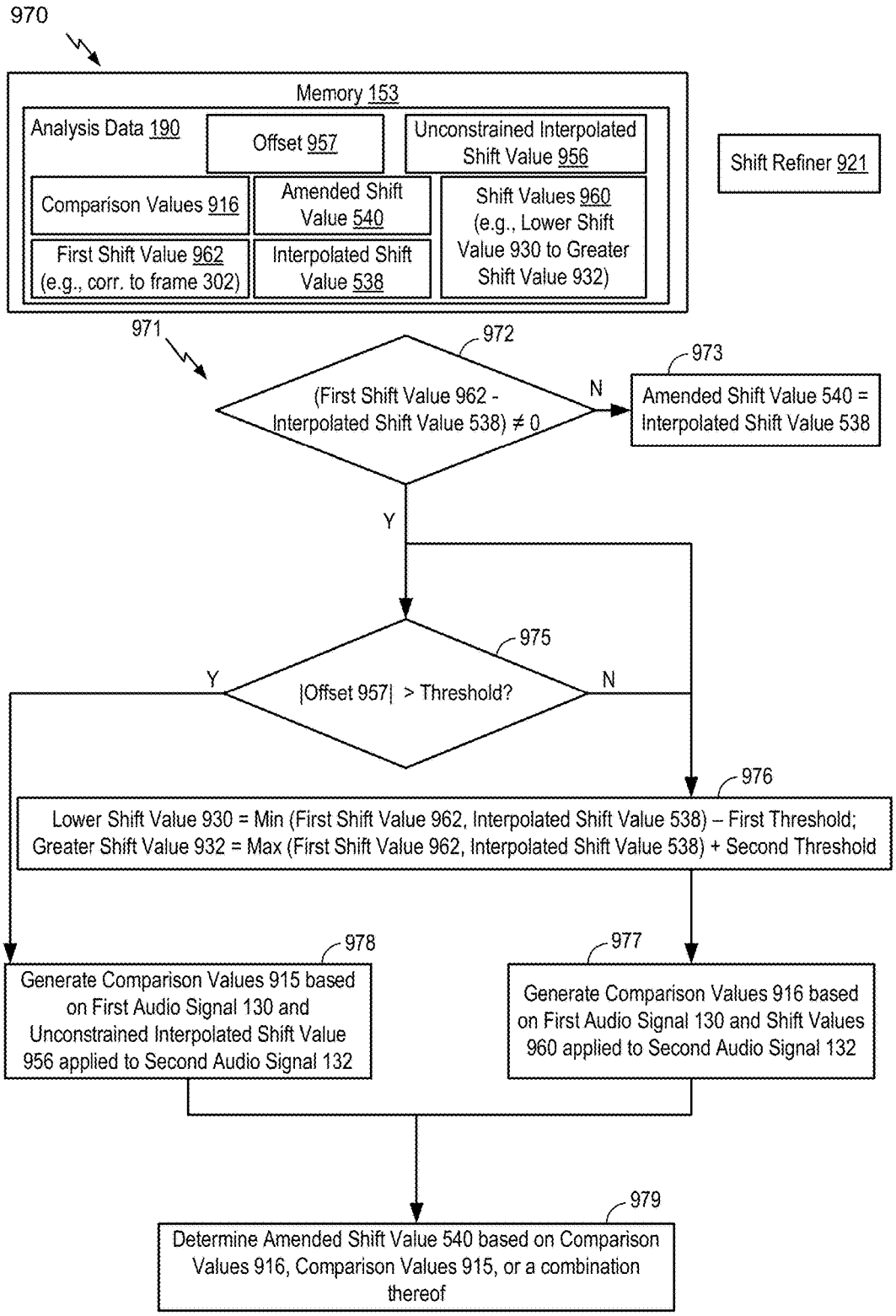
FIG. 9C is a diagram illustrating another example of a system operable to encode multiple audio signals.

Referring to FIG. 9C, an illustrative example of a system is shown and generally designated 970. The system 970 may correspond to the system 100 of FIG. 1. For example, the system 100, the first device 104 of FIG. 1, or both, may include one or more components of the system 970. The system 970 may include the memory 153, a shift refiner 921, or both. The shift refiner 921 may correspond to the shift refiner 511 of FIG. 5.

FIG. 9C also includes a flow chart of an illustrative method of operation generally designated 971. The method 971 may be performed by the temporal equalizer 108, the encoder 114, the first device 104 of FIG. 1, the temporal equalizer(s) 208, the encoder 214, the first device 204 of FIG. 2, the shift refiner 511 of FIG. 5, the shift refiner 911 of FIG. 9A, the shift refiner 921, or a combination thereof.

The method 971 includes determining whether a difference between the first shift value 962 and the interpolated shift value 538 is non-zero, at 972. For example, the shift refiner 921 may determine whether a difference between the first shift value 962 and the interpolated shift value 538 is non-zero.

The method 971 includes, in response to determining that the difference between the first shift value 962 and the interpolated shift value 538 is zero, at 972, setting the amended shift value 540 to the interpolated shift value 538, at 973. For example, the shift refiner 921 may, in response to determining that the difference between the first shift value 962 and the interpolated shift value 538 is zero, determine the amended shift value 540 based on the interpolated shift value 538 (e.g., the amended shift value 540=the interpolated shift value 538).

The method 971 includes, in response to determining that the difference between the first shift value 962 and the interpolated shift value 538 is non-zero, at 972, determining whether an absolute value of the offset 957 is greater than a threshold, at 975. For example, the shift refiner 921 may, in response to determining that the difference between the first shift value 962 and the interpolated shift value 538 is non-zero, determine whether an absolute value of the offset 957 is greater than a threshold. The offset 957 may correspond to a difference between the first shift value 962 and the unconstrained interpolated shift value 956, as described with reference to FIG. 9B. The threshold may correspond to an interpolated shift limitation MAX_SHIFT_CHANGE (e.g., 4).

The method 971 includes, in response to determining that a difference between the first shift value 962 and the interpolated shift value 538 is non-zero, at 972, or determining that the absolute value of the offset 957 is less than or equal to the threshold, at 975, setting the lower shift value 930 to a difference between a first threshold and a minimum of the first shift value 962 and the interpolated shift value 538, and setting the greater shift value 932 to a sum of a second threshold and a maximum of the first shift value 962 and the interpolated shift value 538, at 976. For example, the shift refiner 921 may, in response to determining that the absolute value of the offset 957 is less than or equal to the threshold, determine the lower shift value 930 based on a difference between a first threshold and a minimum of the first shift value 962 and the interpolated shift value 538. The shift refiner 921 may also determine the greater shift value 932 based on a sum of a second threshold and a maximum of the first shift value 962 and the interpolated shift value 538.

The method 971 also includes generating the comparison values 916 based on the first audio signal 130 and the shift values 960 applied to the second audio signal 132, at 977. For example, the shift refiner 921 (or the signal comparator 506) may generate the comparison values 916, as described with reference to FIG. 7, based on the first audio signal 130 and the shift values 960 applied to the second audio signal 132. The shift values 960 may range from the lower shift value 930 to the greater shift value 932. The method 971 may proceed to 979.

The method 971 includes, in response to determining that the absolute value of the offset 957 is greater than the threshold, at 975, generating a comparison value 915 based on the first audio signal 130 and the unconstrained interpolated shift value 956 applied to the second audio signal 132, at 978. For example, the shift refiner 921 (or the signal comparator 506) may generate the comparison value 915, as described with reference to FIG. 7, based on the first audio signal 130 and the unconstrained interpolated shift value 956 applied to the second audio signal 132.

The method 971 also includes determining the amended shift value 540 based on the comparison values 916, the comparison value 915, or a combination thereof, at 979. For example, the shift refiner 921 may determine the amended shift value 540 based on the comparison values 916, the comparison value 915, or a combination thereof, as described with reference to FIG. 9A. In some implementations, the shift refiner 921 may determine the amended shift value 540 based on a comparison of the comparison value 915 and the comparison values 916 to avoid local maxima due to shift variation.

In some cases, an inherent pitch of the first audio signal 130, the first resampled signal 530, the second audio signal 132, the second resampled signal 532, or a combination thereof, may interfere with the shift estimation process. In such cases, pitch de-emphasis or pitch filtering may be performed to reduce the interference due to pitch and to improve reliability of shift estimation between multiple channels. In some cases, background noise may be present in the first audio signal 130, the first resampled signal 530, the second audio signal 132, the second resampled signal 532, or a combination thereof, that may interfere with the shift estimation process. In such cases, noise suppression or noise cancellation may be used to improve reliability of shift estimation between multiple channels.

Figure 10A:
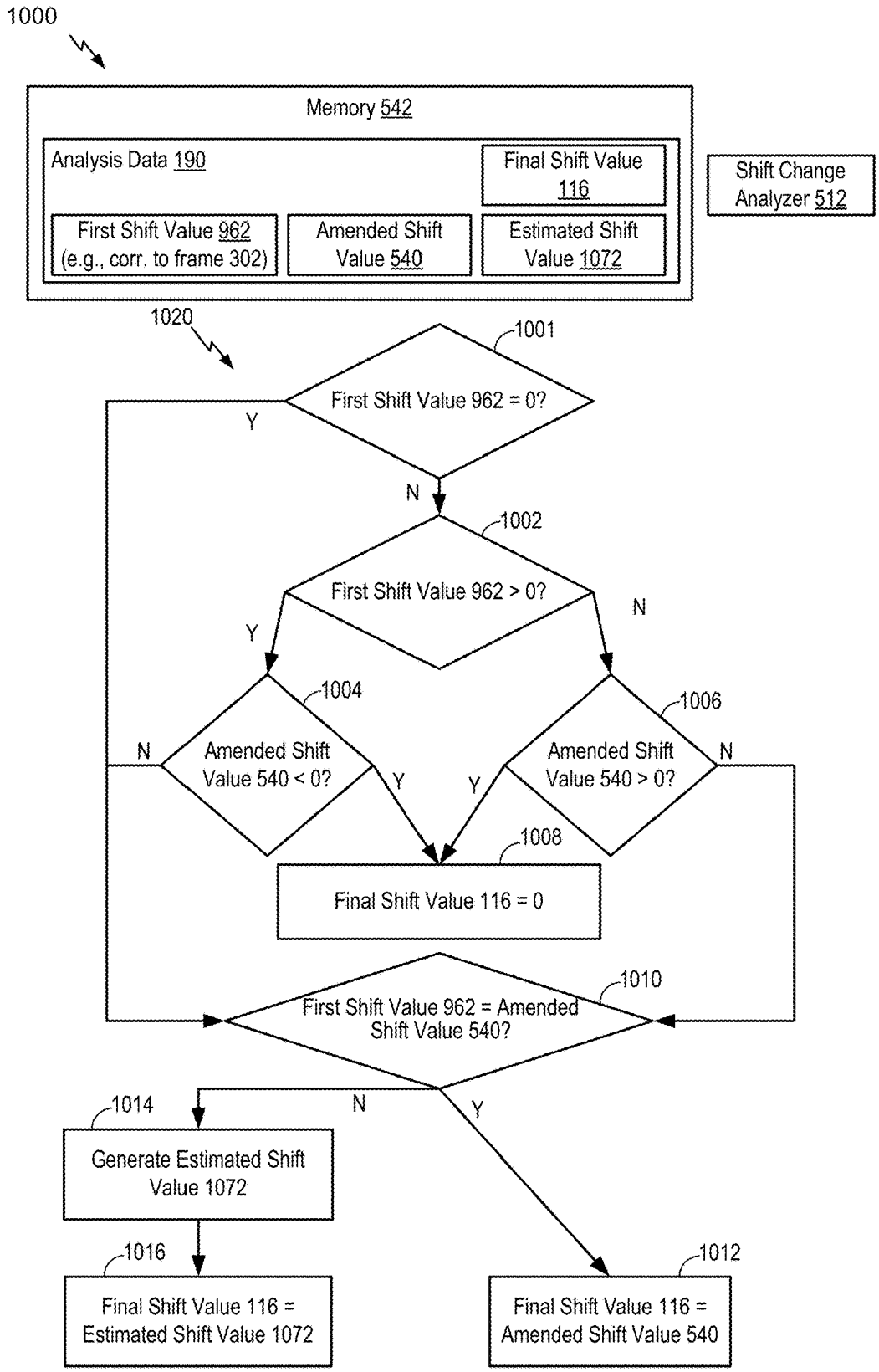
FIG. 10A is a diagram illustrating another example of a system operable to encode multiple audio signals.

Referring to FIG. 10A, an illustrative example of a system is shown and generally designated 1000. The system 1000 may correspond to the system 100 of FIG. 1. For example, the system 100, the first device 104 of FIG. 1, or both, may include one or more components of the system 1000.

FIG. 10A also includes a flow chart of an illustrative method of operation generally designated 1020. The method 1020 may be performed by the shift change analyzer 512, the temporal equalizer 108, the encoder 114, the first device 104, or a combination thereof.

The method 1020 includes determining whether the first shift value 962 is equal to 0, at 1001. For example, the shift change analyzer 512 may determine whether the first shift value 962 corresponding to the frame 302 has a first value (e.g., 0) indicating no time shift. The method 1020 includes, in response to determining that the first shift value 962 is equal to 0, at 1001, proceeding to 1010.

The method 1020 includes, in response to determining that the first shift value 962 is non-zero, at 1001, determining whether the first shift value 962 is greater than 0, at 1002. For example, the shift change analyzer 512 may determine whether the first shift value 962 corresponding to the frame 302 has a first value (e.g., a positive value) indicating that the second audio signal 132 is delayed in time relative to the first audio signal 130.

The method 1020 includes, in response to determining that the first shift value 962 is greater than 0, at 1002, determining whether the amended shift value 540 is less than 0, at 1004. For example, the shift change analyzer 512 may, in response to determining that the first shift value 962 has the first value (e.g., a positive value), determine whether the amended shift value 540 has a second value (e.g., a negative value) indicating that the first audio signal 130 is delayed in time relative to the second audio signal 132. The method 1020 includes, in response to determining that the amended shift value 540 is less than 0, at 1004, proceeding to 1008. The method 1020 includes, in response to determining that the amended shift value 540 is greater than or equal to 0, at 1004, proceeding to 1010.

The method 1020 includes, in response to determining that the first shift value 962 is less than 0, at 1002, determining whether the amended shift value 540 is greater than 0, at 1006. For example, the shift change analyzer 512 may in response to determining that the first shift value 962 has the second value (e.g., a negative value), determine whether the amended shift value 540 has a first value (e.g., a positive value) indicating that the second audio signal 132 is delayed in time with respect to the first audio signal 130. The method 1020 includes, in response to determining that the amended shift value 540 is greater than 0, at 1006, proceeding to 1008. The method 1020 includes, in response to determining that the amended shift value 540 is less than or equal to 0, at 1006, proceeding to 1010.

The method 1020 includes setting the final shift value 116 to 0, at 1008. For example, the shift change analyzer 512 may set the final shift value 116 to a particular value (e.g., 0) that indicates no time shift.

The method 1020 includes determining whether the first shift value 962 is equal to the amended shift value 540, at 1010. For example, the shift change analyzer 512 may determine whether the first shift value 962 and the amended shift value 540 indicate the same time delay between the first audio signal 130 and the second audio signal 132.

The method 1020 includes, in response to determining that the first shift value 962 is equal to the amended shift value 540, at 1010, setting the final shift value 116 to the amended shift value 540, at 1012. For example, the shift change analyzer 512 may set the final shift value 116 to the amended shift value 540.

The method 1020 includes, in response to determining that the first shift value 962 is not equal to the amended shift value 540, at 1010, generating an estimated shift value 1072, at 1014. For example, the shift change analyzer 512 may determine the estimated shift value 1072 by refining the amended shift value 540, as further described with reference to FIG. 11.

The method 1020 includes setting the final shift value 116 to the estimated shift value 1072, at 1016. For example, the shift change analyzer 512 may set the final shift value 116 to the estimated shift value 1072.

In some implementations, the shift change analyzer 512 may set the non-causal shift value 162 to indicate the second estimated shift value in response to determining that the delay between the first audio signal 130 and the second audio signal 132 did not switch. For example, the shift change analyzer 512 may set the non-causal shift value 162 to indicate the amended shift value 540 in response to determining that the first shift value 962 is equal to 0, 1001, that the amended shift value 540 is greater than or equal to 0, at 1004, or that the amended shift value 540 is less than or equal to 0, at 1006.

The shift change analyzer 512 may thus set the non-causal shift value 162 to indicate no time shift in response to determining that delay between the first audio signal 130 and the second audio signal 132 switched between the frame 302 and the frame 304 of FIG. 3. Preventing the non-causal shift value 162 from switching directions (e.g., positive to negative or negative to positive) between consecutive frames may reduce distortion in down mix signal generation at the encoder 114, avoid use of additional delay for upmix synthesis at a decoder, or both.

Figure 10B:
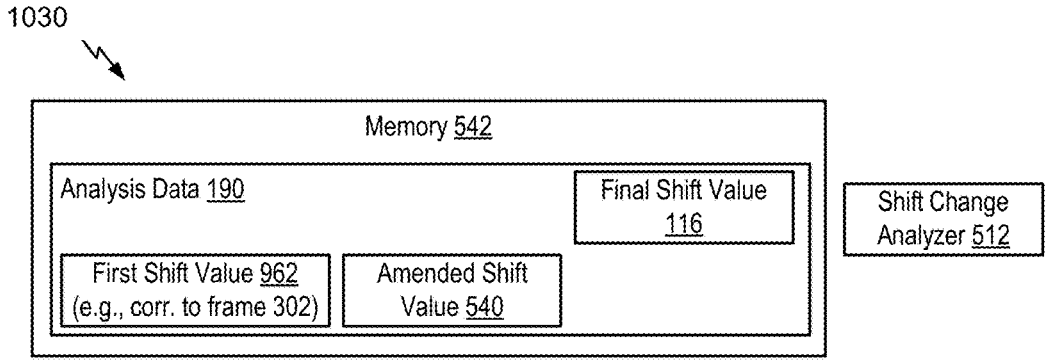
FIG. 10B is a diagram illustrating another example of a system operable to encode multiple audio signals.
Figure 10B:
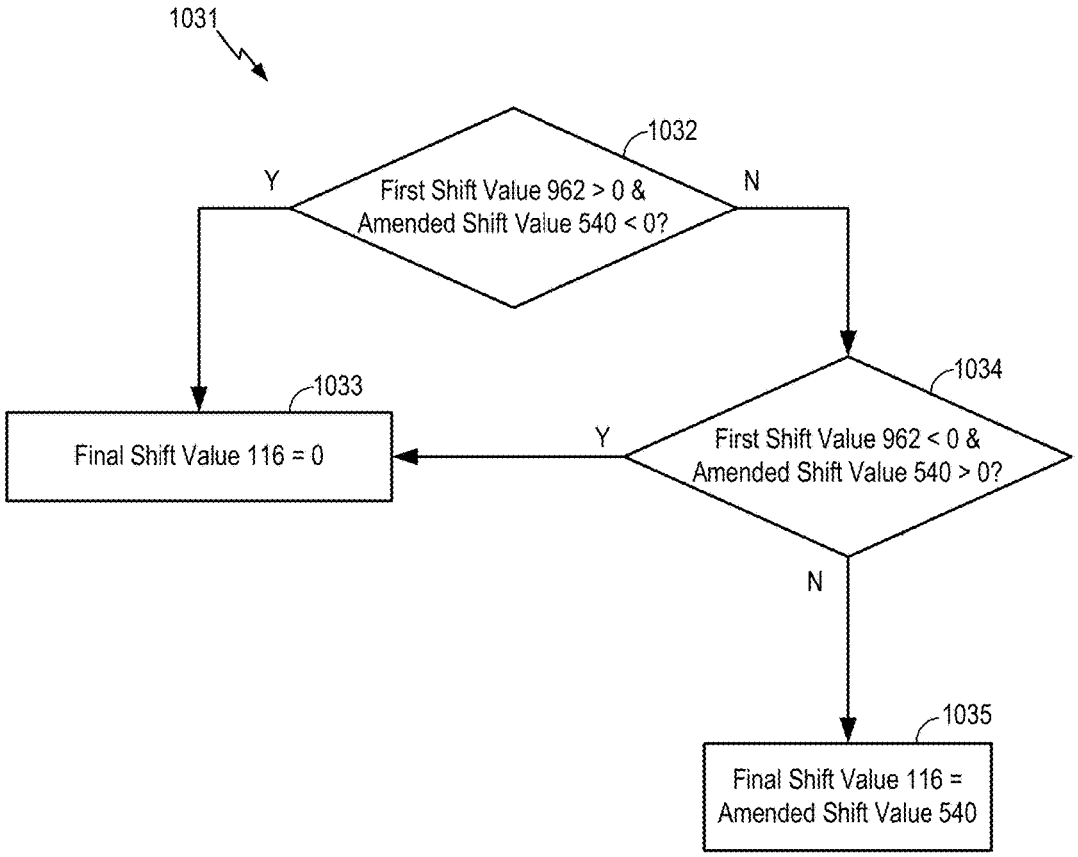

Referring to FIG. 10B, an illustrative example of a system is shown and generally designated 1030. The system 1030 may correspond to the system 100 of FIG. 1. For example, the system 100, the first device 104 of FIG. 1, or both, may include one or more components of the system 1030.

FIG. 10B also includes a flow chart of an illustrative method of operation generally designated 1031. The method 1031 may be performed by the shift change analyzer 512, the temporal equalizer 108, the encoder 114, the first device 104, or a combination thereof.

The method 1031 includes determining whether the first shift value 962 is greater than zero and the amended shift value 540 is less than zero, at 1032. For example, the shift change analyzer 512 may determine whether the first shift value 962 is greater than zero and whether the amended shift value 540 is less than zero.

The method 1031 includes, in response to determining that the first shift value 962 is greater than zero and that the amended shift value 540 is less than zero, at 1032, setting the final shift value 116 to zero, at 1033. For example, the shift change analyzer 512 may, in response to determining that the first shift value 962 is greater than zero and that the amended shift value 540 is less than zero, set the final shift value 116 to a first value (e.g., 0) that indicates no time shift.

The method 1031 includes, in response to determining that the first shift value 962 is less than or equal to zero or that the amended shift value 540 is greater than or equal to zero, at 1032, determining whether the first shift value 962 is less than zero and whether the amended shift value 540 is greater than zero, at 1034. For example, the shift change analyzer 512 may, in response to determining that the first shift value 962 is less than or equal to zero or that the amended shift value 540 is greater than or equal to zero, determine whether the first shift value 962 is less than zero and whether the amended shift value 540 is greater than zero.

The method 1031 includes, in response to determining that the first shift value 962 is less than zero and that the amended shift value 540 is greater than zero, proceeding to 1033. The method 1031 includes, in response to determining that the first shift value 962 is greater than or equal to zero or that the amended shift value 540 is less than or equal to zero, setting the final shift value 116 to the amended shift value 540, at 1035. For example, the shift change analyzer 512 may, in response to determining that the first shift value 962 is greater than or equal to zero or that the amended shift value 540 is less than or equal to zero, set the final shift value 116 to the amended shift value 540.

Figure 11:
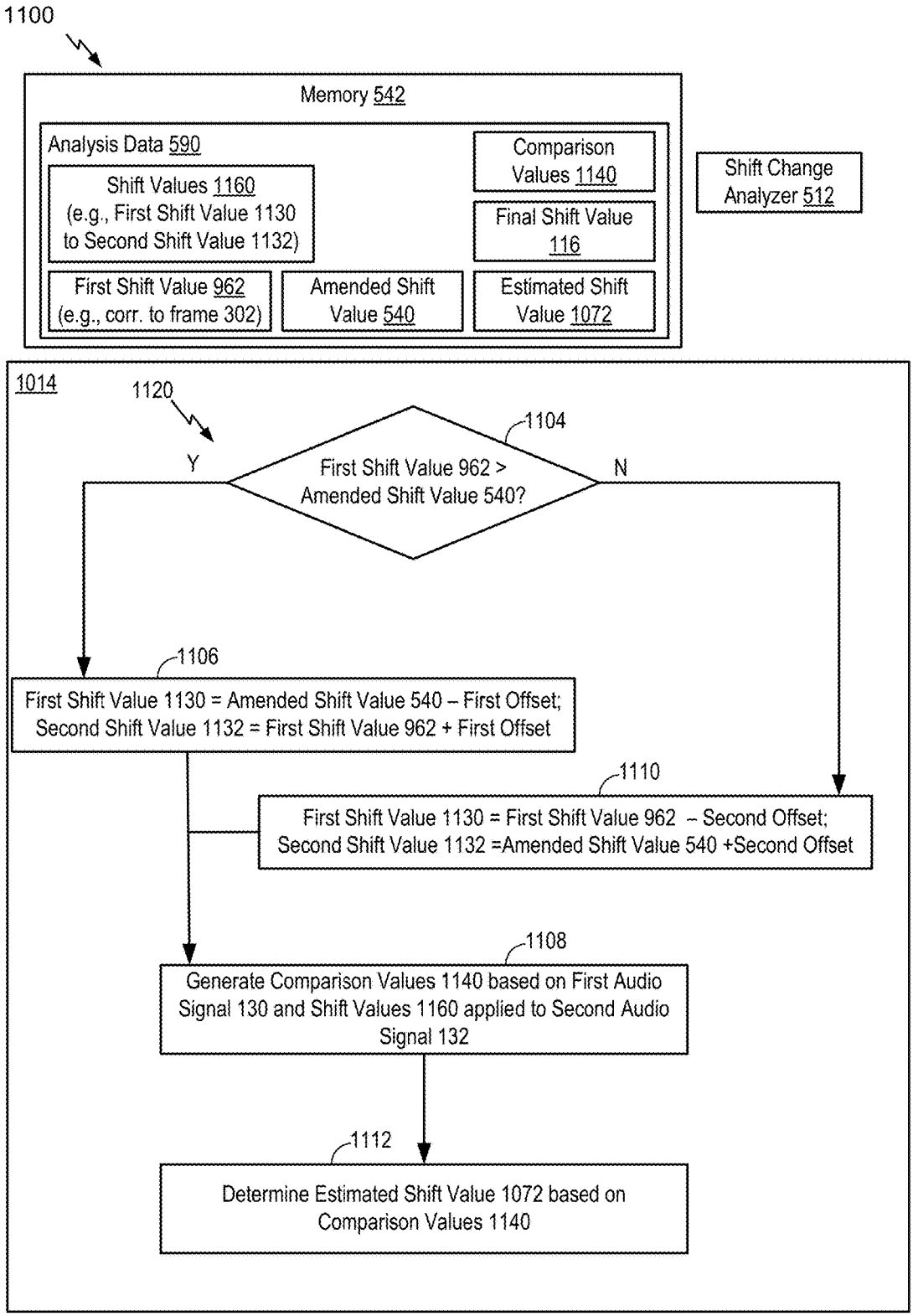
FIG. 11 is a diagram illustrating another example of a system operable to encode multiple audio signals.

Referring to FIG. 11, an illustrative example of a system is shown and generally designated 1100. The system 1100 may correspond to the system 100 of FIG. 1. For example, the system 100, the first device 104 of FIG. 1, or both, may include one or more components of the system 1100. FIG. 11 also includes a flow chart illustrating a method of operation that is generally designated 1120. The method 1120 may be performed by the shift change analyzer 512, the temporal equalizer 108, the encoder 114, the first device 104, or a combination thereof. The method 1120 may correspond to the step 1014 of FIG. 10A.

The method 1120 includes determining whether the first shift value 962 is greater than the amended shift value 540, at 1104. For example, the shift change analyzer 512 may determine whether the first shift value 962 is greater than the amended shift value 540.

The method 1120 also includes, in response to determining that the first shift value 962 is greater than the amended shift value 540, at 1104, setting a first shift value 1130 to a difference between the amended shift value 540 and a first offset, and setting a second shift value 1132 to a sum of the first shift value 962 and the first offset, at 1106. For example, the shift change analyzer 512 may, in response to determining that the first shift value 962 (e.g., 20) is greater than the amended shift value 540 (e.g., 18), determine the first shift value 1130 (e.g., 17) based on the amended shift value 540 (e.g., amended shift value 540—a first offset). Alternatively, or in addition, the shift change analyzer 512 may determine the second shift value 1132 (e.g., 21) based on the first shift value 962 (e.g., the first shift value 962+the first offset). The method 1120 may proceed to 1108.

The method 1120 further includes, in response to determining that the first shift value 962 is less than or equal to the amended shift value 540, at 1104, setting the first shift value 1130 to a difference between the first shift value 962 and a second offset, and setting the second shift value 1132 to a sum of the amended shift value 540 and the second offset. For example, the shift change analyzer 512 may, in response to determining that the first shift value 962 (e.g., 10) is less than or equal to the amended shift value 540 (e.g., 12), determine the first shift value 1130 (e.g., 9) based on the first shift value 962 (e.g., first shift value 962—a second offset). Alternatively, or in addition, the shift change analyzer 512 may determine the second shift value 1132 (e.g., 13) based on the amended shift value 540 (e.g., the amended shift value 540+the second offset). The first offset (e.g., 2) may be distinct from the second offset (e.g., 3). In some implementations, the first offset may be the same as the second offset. A higher value of the first offset, the second offset, or both, may improve a search range.

The method 1120 also includes generating comparison values 1140 based on the first audio signal 130 and shift values 1160 applied to the second audio signal 132, at 1108. For example, the shift change analyzer 512 may generate the comparison values 1140, as described with reference to FIG. 7, based on the first audio signal 130 and the shift values 1160 applied to the second audio signal 132. To illustrate, the shift values 1160 may range from the first shift value 1130 (e.g., 17) to the second shift value 1132 (e.g., 21). The shift change analyzer 512 may generate a particular comparison value of the comparison values 1140 based on the samples 326-332 and a particular subset of the second samples 350. The particular subset of the second samples 350 may correspond to a particular shift value (e.g., 17) of the shift values 1160. The particular comparison value may indicate a difference (or a correlation) between the samples 326-332 and the particular subset of the second samples 350.

The method 1120 further includes determining the estimated shift value 1072 based on the comparison values 1140, at 1112. For example, the shift change analyzer 512 may, when the comparison values 1140 correspond to cross-correlation values, select a highest comparison value of the comparison values 1140 as the estimated shift value 1072. Alternatively, the shift change analyzer 512 may, when the comparison values 1140 correspond to difference values (e.g., variation values), select a lowest comparison value of the comparison values 1140 as the estimated shift value 1072.

The method 1120 may thus enable the shift change analyzer 512 to generate the estimated shift value 1072 by refining the amended shift value 540. For example, the shift change analyzer 512 may determine the comparison values 1140 based on original samples and may select the estimated shift value 1072 corresponding to a comparison value of the comparison values 1140 that indicates a highest correlation (or lowest difference).

Figure 12:
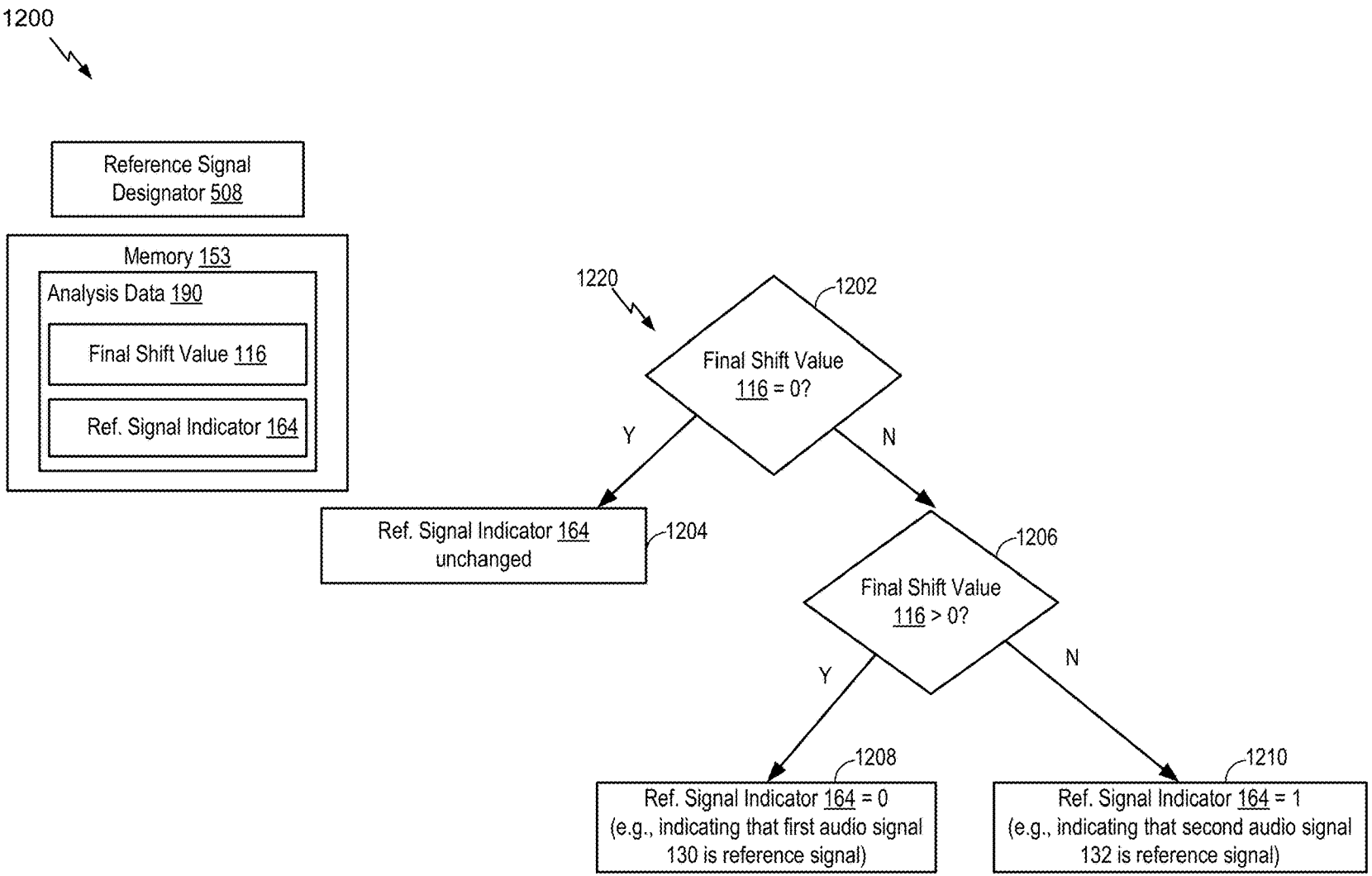
FIG. 12 is a diagram illustrating another example of a system operable to encode multiple audio signals.

Referring to FIG. 12, an illustrative example of a system is shown and generally designated 1200. The system 1200 may correspond to the system 100 of FIG. 1. For example, the system 100, the first device 104 of FIG. 1, or both, may include one or more components of the system 1200. FIG. 12 also includes a flow chart illustrating a method of operation that is generally designated 1220. The method 1220 may be performed by the reference signal designator 508, the temporal equalizer 108, the encoder 114, the first device 104, or a combination thereof.

The method 1220 includes determining whether the final shift value 116 is equal to 0, at 1202. For example, the reference signal designator 508 may determine whether the final shift value 116 has a particular value (e.g., 0) indicating no time shift.

The method 1220 includes, in response to determining that the final shift value 116 is equal to 0, at 1202, leaving the reference signal indicator 164 unchanged, at 1204. For example, the reference signal designator 508 may, in response to determining that the final shift value 116 has the particular value (e.g., 0) indicating no time shift, leave the reference signal indicator 164 unchanged. To illustrate, the reference signal indicator 164 may indicate that the same audio signal (e.g., the first audio signal 130 or the second audio signal 132) is a reference signal associated with the frame 304 as with the frame 302.

The method 1220 includes, in response to determining that the final shift value 116 is non-zero, at 1202, determining whether the final shift value 116 is greater than 0, at 1206. For example, the reference signal designator 508 may, in response to determining that the final shift value 116 has a particular value (e.g., a non-zero value) indicating a time shift, determine whether the final shift value 116 has a first value (e.g., a positive value) indicating that the second audio signal 132 is delayed relative to the first audio signal 130 or a second value (e.g., a negative value) indicating that the first audio signal 130 is delayed relative to the second audio signal 132.

The method 1220 includes, in response to determining that the final shift value 116 has the first value (e.g., a positive value), set the reference signal indicator 164 to have a first value (e.g., 0) indicating that the first audio signal 130 is a reference signal, at 1208. For example, the reference signal designator 508 may, in response to determining that the final shift value 116 has the first value (e.g., a positive value), set the reference signal indicator 164 to a first value (e.g., 0) indicating that the first audio signal 130 is a reference signal. The reference signal designator 508 may, in response to determining that the final shift value 116 has the first value (e.g., the positive value), determine that the second audio signal 132 corresponds to a target signal.

The method 1220 includes, in response to determining that the final shift value 116 has the second value (e.g., a negative value), set the reference signal indicator 164 to have a second value (e.g., 1) indicating that the second audio signal 132 is a reference signal, at 1210. For example, the reference signal designator 508 may, in response to determining that the final shift value 116 has the second value (e.g., a negative value) indicating that the first audio signal 130 is delayed relative to the second audio signal 132, set the reference signal indicator 164 to a second value (e.g., 1) indicating that the second audio signal 132 is a reference signal. The reference signal designator 508 may, in response to determining that the final shift value 116 has the second value (e.g., the negative value), determine that the first audio signal 130 corresponds to a target signal.

The reference signal designator 508 may provide the reference signal indicator 164 to the gain parameter generator 514. The gain parameter generator 514 may determine a gain parameter (e.g., a gain parameter 160) of a target signal based on a reference signal, as described with reference to FIG. 5.

A target signal may be delayed in time relative to a reference signal. The reference signal indicator 164 may indicate whether the first audio signal 130 or the second audio signal 132 corresponds to the reference signal. The reference signal indicator 164 may indicate whether the gain parameter 160 corresponds to the first audio signal 130 or the second audio signal 132.

Figure 13:
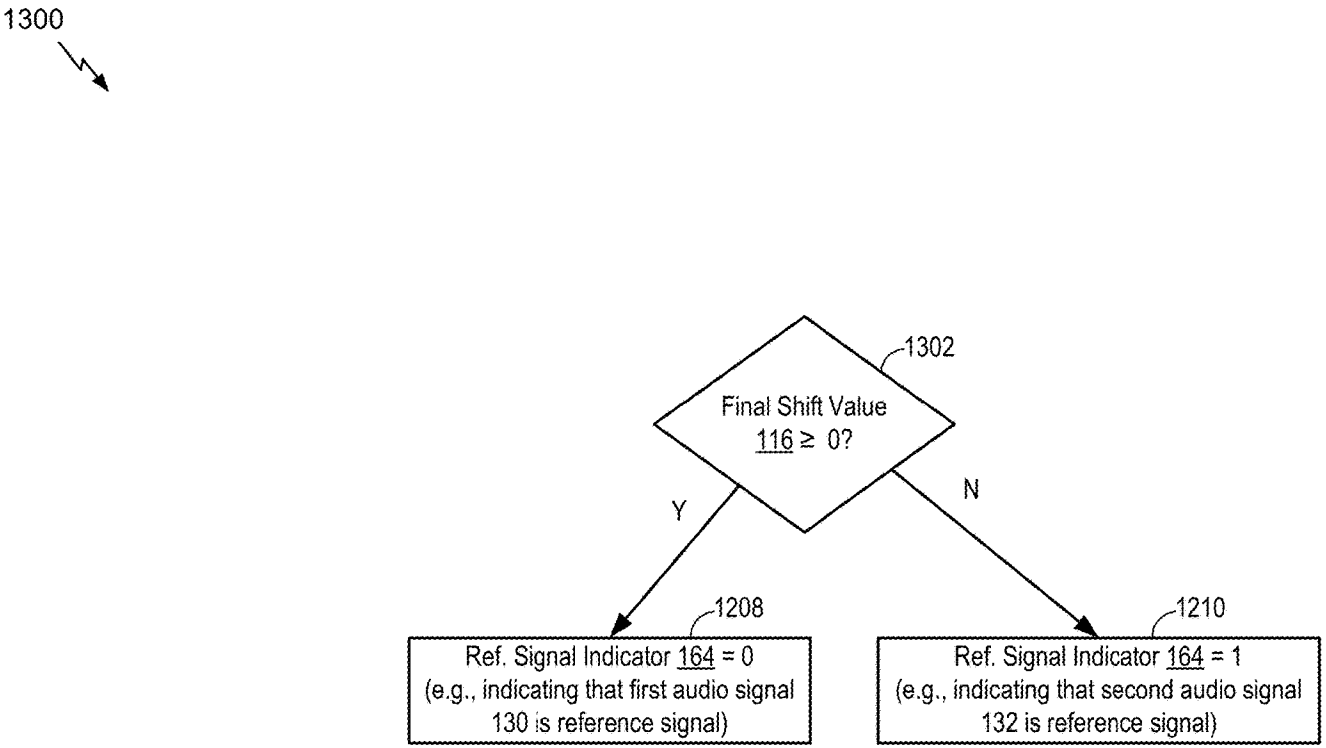
FIG. 13 is a flow chart illustrating a particular method of encoding multiple audio signals.

Referring to FIG. 13, a flow chart illustrating a particular method of operation is shown and generally designated 1300. The method 1300 may be performed by the reference signal designator 508, the temporal equalizer 108, the encoder 114, the first device 104, or a combination thereof.

The method 1300 includes determining whether the final shift value 116 is greater than or equal to zero, at 1302. For example, the reference signal designator 508 may determine whether the final shift value 116 is greater than or equal to zero. The method 1300 also includes, in response to determining that the final shift value 116 is greater than or equal to zero, at 1302, proceeding to 1208. The method 1300 further includes, in response to determining that the final shift value 116 is less than zero, at 1302, proceeding to 1210. The method 1300 differs from the method 1220 of FIG. 12 in that, in response to determining that the final shift value 116 has a particular value (e.g., 0) indicating no time shift, the reference signal indicator 164 is set to a first value (e.g., 0) indicating that the first audio signal 130 corresponds to a reference signal. In some implementations, the reference signal designator 508 may perform the method 1220. In other implementations, the reference signal designator 508 may perform the method 1300.

The method 1300 may thus enable setting the reference signal indicator 164 to a particular value (e.g., 0) indicating that the first audio signal 130 corresponds to a reference signal when the final shift value 116 indicates no time shift independently of whether the first audio signal 130 corresponds to the reference signal for the frame 302.

Figure 14:
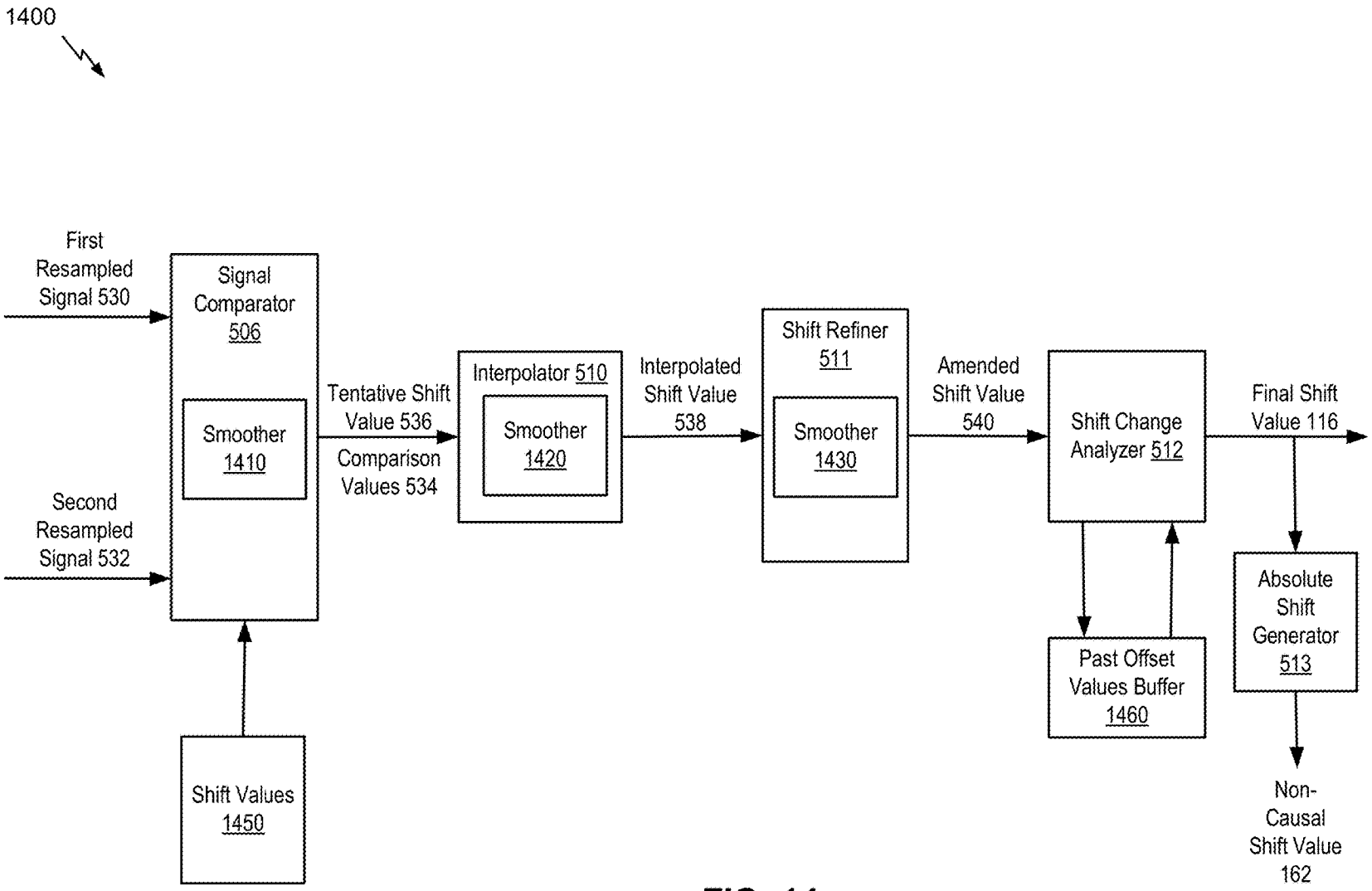
FIG. 14 is a diagram illustrating another example of a system operable to encode multiple audio signals.

Referring to FIG. 14, an illustrative example of a system is shown and generally designated 1400. The system 1400 includes the signal comparator 506 of FIG. 5, the interpolator 510 of FIG. 5, the shift refiner 511 of FIG. 5, and the shift change analyzer 512 of FIG. 5.

The signal comparator 506 may generate the comparison values 534 (e.g., difference values, variance values, similarity values, coherence values, or cross-correlation values), the tentative shift value 536, or both. For example, the signal comparator 506 may generate the comparison values 534 based on the first resampled signal 530 and a plurality of shift values 1450 applied to the second resampled signal 532. The signal comparator 506 may determine the tentative shift value 536 based on the comparison values 534. The signal comparator 506 includes a smoother 1410 configured to retrieve comparison values for previous frames of the resampled signals 530, 532 and may modify the comparison values 534 based on a long-term smoothing operation using the comparison values for previous frames. For example, the comparison values 534 may include the long-term comparison value $CompVal_{LT_N}(k)$ for a current frame (N) and may be represented by $CompVal_{LT_N}(k)=(1-\alpha)*CompVal_N(k),+(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of a increases, the amount of smoothing in the long-term comparison value increases. The signal comparator 506 may provide the comparison values 534, the tentative shift value 536, or both, to the interpolator 510.

The interpolator 510 may extend the tentative shift value 536 to generate the interpolated shift value 538. For example, the interpolator 510 may generate interpolated comparison values corresponding to shift values that are proximate to the tentative shift value 536 by interpolating the comparison values 534. The interpolator 510 may determine the interpolated shift value 538 based on the interpolated comparison values and the comparison values 534. The comparison values 534 may be based on a coarser granularity of the shift values. The interpolated comparison values may be based on a finer granularity of shift values that are proximate to the resampled tentative shift value 536. Determining the comparison values 534 based on the coarser granularity (e.g., the first subset) of the set of shift values may use fewer resources (e.g., time, operations, or both) than determining the comparison values 534 based on a finer granularity (e.g., all) of the set of shift values. Determining the interpolated comparison values corresponding to the second subset of shift values may extend the tentative shift value 536 based on a finer granularity of a smaller set of shift values that are proximate to the tentative shift value 536 without determining comparison values corresponding to each shift value of the set of shift values. Thus, determining the tentative shift value 536 based on the first subset of shift values and determining the interpolated shift value 538 based on the interpolated comparison values may balance resource usage and refinement of the estimated shift value. The interpolator 510 may provide the interpolated shift value 538 to the shift refiner 511.

The interpolator 510 includes a smoother 1420 configured to retrieve interpolated shift values for previous frames and may modify the interpolated shift value 538 based on a long-term smoothing operation using the interpolated shift values for previous frames. For example, the interpolated shift value 538 may include a long-term interpolated shift value $InterVal_{LT_N}(k)$ for a current frame (N) and may be represented by $InterVal_{LT_N}(k)=(1-\alpha)*InterVal_N(k),+(\alpha)*InterVal_{LT_{N-1}}(k)$, where $\alpha\in(0, 1.0)$. Thus, the long-term interpolated shift value $InterVal_{LT_N}(k)$ may be based on a weighted mixture of the instantaneous interpolated shift value $InterVal_N(k)$ at frame N and the long-term interpolated shift values $InterVal_{LT_{N-1}}(k)$ for one or more previous frames. As the value of $\alpha$ increases, the amount of smoothing in the long-term comparison value increases.

The shift refiner 511 may generate the amended shift value 540 by refining the interpolated shift value 538. For example, the shift refiner 511 may determine whether the interpolated shift value 538 indicates that a change in a shift between the first audio signal 130 and the second audio signal 132 is greater than a shift change threshold. The change in the shift may be indicated by a difference between the interpolated shift value 538 and a first shift value associated with the frame 302 of FIG. 3. The shift refiner 511 may, in response to determining that the difference is less than or equal to the threshold, set the amended shift value 540 to the interpolated shift value 538. Alternatively, the shift refiner 511 may, in response to determining that the difference is greater than the threshold, determine a plurality of shift values that correspond to a difference that is less than or equal to the shift change threshold. The shift refiner 511 may determine comparison values based on the first audio signal 130 and the plurality of shift values applied to the second audio signal 132. The shift refiner 511 may determine the amended shift value 540 based on the comparison values. For example, the shift refiner 511 may select a shift value of the plurality of shift values based on the comparison values and the interpolated shift value 538. The shift refiner 511 may set the amended shift value 540 to indicate the selected shift value. A non-zero difference between the first shift value corresponding to the frame 302 and the interpolated shift value 538 may indicate that some samples of the second audio signal 132 correspond to both frames (e.g., the frame 302 and the frame 304). For example, some samples of the second audio signal 132 may be duplicated during encoding. Alternatively, the non-zero difference may indicate that some samples of the second audio signal 132 correspond to neither the frame 302 nor the frame 304. For example, some samples of the second audio signal 132 may be lost during encoding. Setting the amended shift value 540 to one of the plurality of shift values may prevent a large change in shifts between consecutive (or adjacent) frames, thereby reducing an amount of sample loss or sample duplication during encoding. The shift refiner 511 may provide the amended shift value 540 to the shift change analyzer 512.

The shift refiner 511 includes a smoother 1430 configured to retrieve amended shift values for previous frames and may modify the amended shift value 540 based on a long-term smoothing operation using the amended shift values for previous frames. For example, the amended shift value 540 may include a long-term amended shift value $AmendVal_{LT_N}(k)$ for a current frame (N) and may be represented by $AmendVal_{LT_N}(k)=(1-\alpha)*AmendVal_N(k),+(\alpha)*AmendVal_{LT_{N-1}}(k)$, where $\alpha\in(0, 1.0)$. Thus, the long-term amended shift value $AmendVal_{LT_N}(k)$ may be based on a weighted mixture of the instantaneous amended shift value $AmendVal_N(k)$ at frame N and the long-term amended shift values $AmendVal_{LT_{N-1}}(k)$ for one or more previous frames. As the value of a increases, the amount of smoothing in the long-term comparison value increases.

The shift change analyzer 512 may determine whether the amended shift value 540 indicates a switch or reverse in timing between the first audio signal 130 and the second audio signal 132. The shift change analyzer 512 may determine whether the delay between the first audio signal 130 and the second audio signal 132 has switched sign based on the amended shift value 540 and the first shift value associated with the frame 302. The shift change analyzer 512 may, in response to determining that the delay between the first audio signal 130 and the second audio signal 132 has switched sign, set the final shift value 116 to a value (e.g., 0) indicating no time shift. Alternatively, the shift change analyzer 512 may set the final shift value 116 to the amended shift value 540 in response to determining that the delay between the first audio signal 130 and the second audio signal 132 has not switched sign.

The shift change analyzer 512 may generate an estimated shift value by refining the amended shift value 540. The shift change analyzer 512 may set the final shift value 116 to the estimated shift value. Setting the final shift value 116 to indicate no time shift may reduce distortion at a decoder by refraining from time shifting the first audio signal 130 and the second audio signal 132 in opposite directions for consecutive (or adjacent) frames of the first audio signal 130. The shift change analyzer 512 may provide the final shift value 116 to the absolute shift generator 513. The absolute shift generator 513 may generate the non-causal shift value 162 by applying an absolute function to the final shift value 116.

The smoothing techniques described above may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

As described with respect to FIG. 14, smoothing may be performed at the signal comparator 506, the interpolator 510, the shift refiner 511, or a combination thereof. If the interpolated shift is consistently different from the tentative shift at an input sampling rate (FSin), smoothing of the interpolated shift value 538 may be performed in addition to smoothing of the comparison values 534 or in alternative to smoothing of the comparison values 534. During estimation of the interpolated shift value 538, the interpolation process may be performed on smoothed long-term comparison values generated at the signal comparator 506, on un-smoothed comparison values generated at the signal comparator 506, or on a weighted mixture of interpolated smoothed comparison values and interpolated un-smoothed comparison values. If smoothing is performed at the interpolator 510, the interpolation may be extended to be performed at the proximity of multiple samples in addition to the tentative shift estimated in a current frame. For example, interpolation may be performed in proximity to a previous frame's shift (e.g., one or more of the previous tentative shift, the previous interpolated shift, the previous amended shift, or the previous final shift) and in proximity to the current frame's tentative shift. As a result, smoothing may be performed on additional samples for the interpolated shift values which may improve the interpolated shift estimate.

Figure 15:
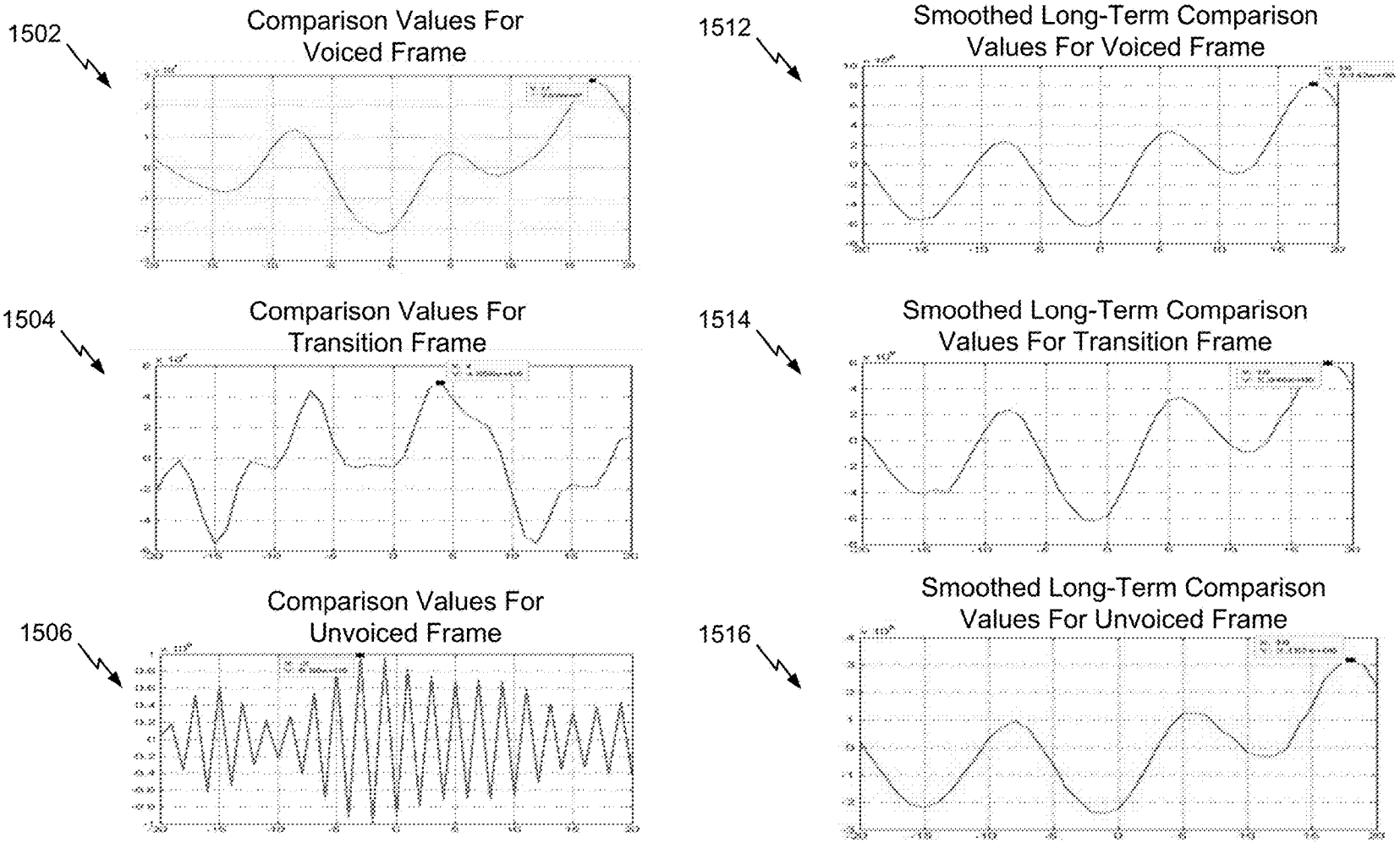
FIG. 15 depicts graphs illustrating comparison values for voiced frames, transition frames, and unvoiced frames.

Referring to FIG. 15, graphs illustrating comparison values for voiced frames, transition frames, and unvoiced frames are shown. According to FIG. 15, the graph 1502 illustrates comparison values (e.g., cross-correlation values) for a voiced frame processed without using the long-term smoothing techniques described, the graph 1504 illustrates comparison values for a transition frame processed without using the long-term smoothing techniques described, and the graph 1506 illustrates comparison values for an unvoiced frame processed without using the long-term smoothing techniques described.

The cross-correlation represented in each graph 1502, 1504, 1506 may be substantially different. For example, the graph 1502 illustrates that a peak cross-correlation between a voiced frame captured by the first microphone 146 of FIG. 1 and a corresponding voiced frame captured by the second microphone 148 of FIG. 1 occurs at approximately a 17 sample shift. However, the graph 1504 illustrates that a peak cross-correlation between a transition frame captured by the first microphone 146 and a corresponding transition frame captured by the second microphone 148 occurs at approximately a 4 sample shift. Moreover, the graph 1506 illustrates that a peak cross-correlation between an unvoiced frame captured by the first microphone 146 and a corresponding unvoiced frame captured by the second microphone 148 occurs at approximately a −3 sample shift. Thus, the shift estimate may be inaccurate for transition frames and unvoiced frames due to a relatively high level of noise.

According to FIG. 15, the graph 1512 illustrates comparison values (e.g., cross-correlation values) for a voiced frame processed using the long-term smoothing techniques described, the graph 1514 illustrates comparison values for a transition frame processed using the long-term smoothing techniques described, and the graph 1516 illustrates comparison values for an unvoiced frame processed using the long-term smoothing techniques described. The cross-correlation values in each graph 1512, 1514, 1516 may be substantially similar. For example, each graph 1512, 1514, 1516 illustrates that a peak cross-correlation between a frame captured by the first microphone 146 of FIG. 1 and a corresponding frame captured by the second microphone 148 of FIG. 1 occurs at approximately a 17 sample shift. Thus, the shift estimate for transition frames (illustrated by the graph 1514) and unvoiced frames (illustrated by the graph 1516) may be relatively accurate (or similar) to the shift estimate of the voiced frame in spite of noise.

The comparison value long-term smoothing process described with respect to FIG. 15 may be applied when the comparison values are estimated on the same shift ranges in each frame. The smoothing logic (e.g., the smoothers 1410, 1420, 1430) may be performed prior to estimation of a shift between the channels based on generated comparison values. For example, the smoothing may be performed prior to estimation of either the tentative shift, the estimation of interpolated shift, or the amended shift. To reduce adaptation of comparison values during silent portions (or background noise which may cause drift in the shift estimation), the comparison values may be smoothed based on a higher time-constant (e.g., $\alpha=0.995$); otherwise the smoothing may be based on $\alpha=0.9$. The determination whether to adjust the comparison values may be based on whether the background energy or long-term energy is below a threshold.

Figure 16:
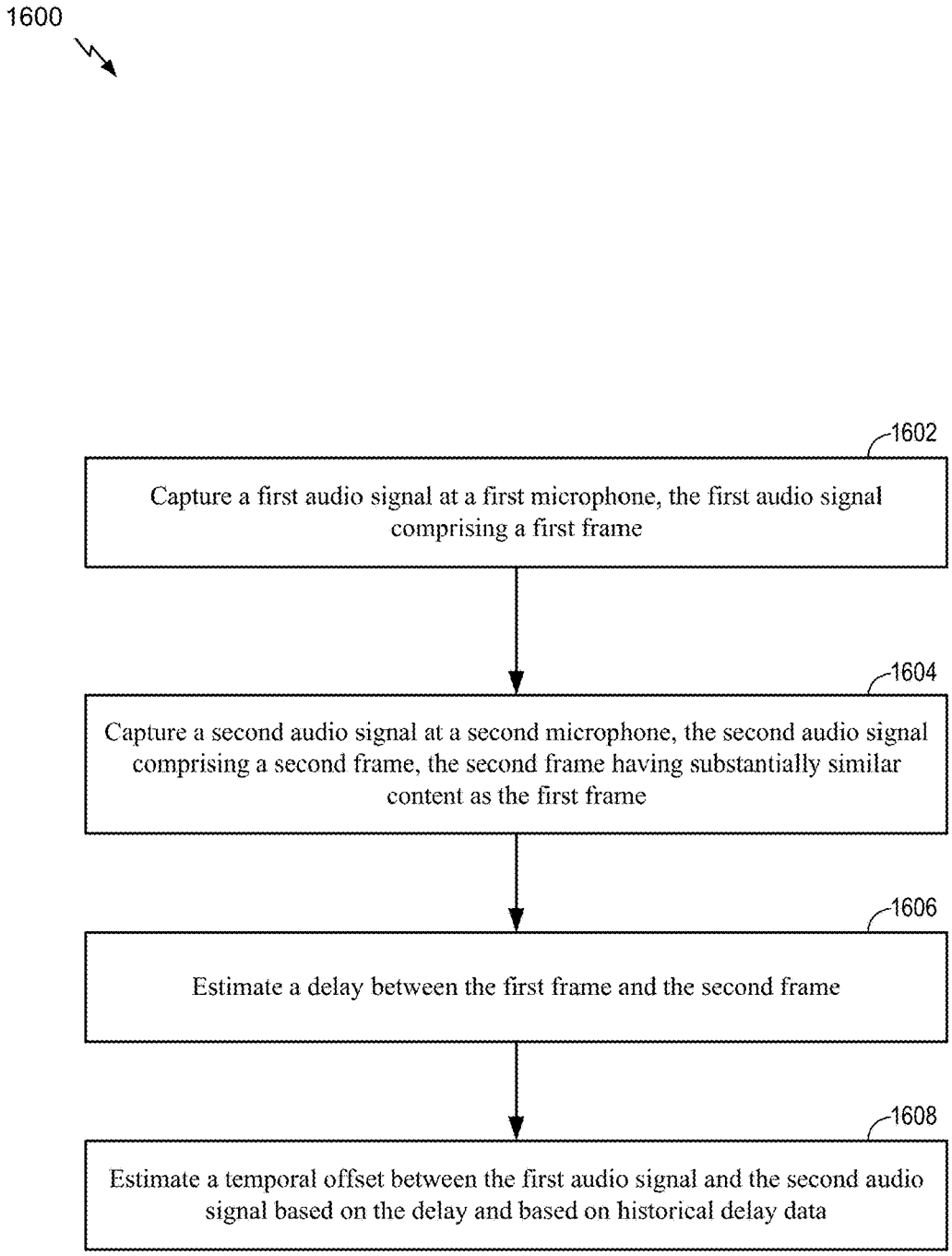
FIG. 16 is a flow chart illustrating a method of estimating a temporal offset between audio captured at multiple microphones.

Referring to FIG. 16, a flow chart illustrating a particular method of operation is shown and generally designated 1600. The method 1600 may be performed by the temporal equalizer 108, the encoder 114, the first device 104 of FIG. 1, or a combination thereof.

The method 1600 includes capturing a first audio signal at a first microphone, at 1602. The first audio signal may include a first frame. For example, referring to FIG. 1, the first microphone 146 may capture the first audio signal 130. The first audio signal 130 may include a first frame.

A second audio signal may be captured at a second microphone, at 1604. The second audio signal may include a second frame, and the second frame may have substantially similar content as the first frame. For example, referring to FIG. 1, the second microphone 148 may capture the second audio signal 132. The second audio signal 132 may include a second frame, and the second frame may have substantially similar content as the first frame. The first frame and the second frames may be one of voiced frames, transition frames, or unvoiced frames.

A delay between the first frame and the second frame may be estimated, at 1606. For example, referring to FIG. 1, the temporal equalizer 108 may determine a cross-correlation between the first frame and the second frame. A temporal offset between the first audio signal and the second audio signal may be estimated based on the delay based on historical delay data, at 1608. For example, referring to FIG. 1, the temporal equalizer 108 may estimate a temporal offset between audio captured at the microphones 146, 148. The temporal offset may be estimated based on a delay between a first frame of the first audio signal 130 and a second frame of the second audio signal 132, where the second frame includes substantially similar content as the first frame. For example, the temporal equalizer 108 may use a cross-correlation function to estimate the delay between the first frame and the second frame. The cross-correlation function may be used to measure the similarity of the two frames as a function of the lag of one frame relative to the other. Based on the cross-correlation function, the temporal equalizer 108 may determine the delay (e.g., lag) between the first frame and the second frame. The temporal equalizer 108 may estimate the temporal offset between the first audio signal 130 and the second audio signal 132 based on the delay and historical delay data.

The historical data may include delays between frames captured from the first microphone 146 and corresponding frames captured from the second microphone 148. For example, the temporal equalizer 108 may determine a cross-correlation (e.g., a lag) between previous frames associated with the first audio signal 130 and corresponding frames associated with the second audio signal 132. Each lag may be represented by a "comparison value". That is, a comparison value may indicate a time shift (k) between a frame of the first audio signal 130 and a corresponding frame of the second audio signal 132. According to one implementation, the comparison values for previous frames may be stored at the memory 153. A smoother 192 of the temporal equalizer 108 may "smooth" (or average) comparison values over a long-term set of frames and used the long-term smoothed comparison values for estimating a temporal offset (e.g., "shift") between the first audio signal 130 and the second audio signal 132.

Thus, the historical delay data may be generated based on smoothed comparison values associated with the first audio signal 130 and the second audio signal 132. For example, the method 1600 may include smoothing comparison values associated with the first audio signal 130 and the second audio signal 132 to generate the historical delay data. The smoothed comparison values may be based on frames of the first audio signal 130 generated earlier in time than the first frame and based on frames of the second audio signal 132 generated earlier in time than the second frame. According to one implementation, the method 1600 may include temporally shifting the second frame by the temporal offset.

To illustrate, if $CompVal_N(k)$ represents the comparison value at a shift of k for the frame N, the frame N may have comparison values from k=T_MIN (a minimum shift) to k=T_MAX (a maximum shift). The smoothing may be performed such that a long-term comparison value $CompVal_{LT_N}(k)$ is represented by $CompVal_{LT_N}(k)=f(CompVal_N(k), CompVal_{N-1}(k), CompVal_{LT_{N-2}}(k), \ldots)$. The function f in the above equation may be a function of all (or a subset) of past comparison values at the shift (k). An alternative representation of the may be $CompVal_{LT_N}(k)=g(CompVal_N(k), CompVal_{N-1}(k), CompVal_{N-2}(k), \ldots)$. The functions f or g may be simple finite impulse response (FIR) filters or infinite impulse response (IIR) filters, respectively. For example, the function g may be a single tap IIR filter such that the long-term comparison value $CompVal_{LT_N}(k)$ is represented by $CompVal_{LT_N}(k)=(1-\alpha)*CompVal_N(k), +(\alpha)*CompVal_{LT_{N-1}}(k)$, where $\alpha\in(0, 1.0)$. Thus, the long-term comparison value $CompVal_{LT_N}(k)$ may be based on a weighted mixture of the instantaneous comparison value $CompVal_N(k)$ at frame N and the long-term comparison values $CompVal_{LT_{N-1}}(k)$ for one or more previous frames. As the value of $\alpha$ increases, the amount of smoothing in the long-term comparison value increases.

Figure 17:
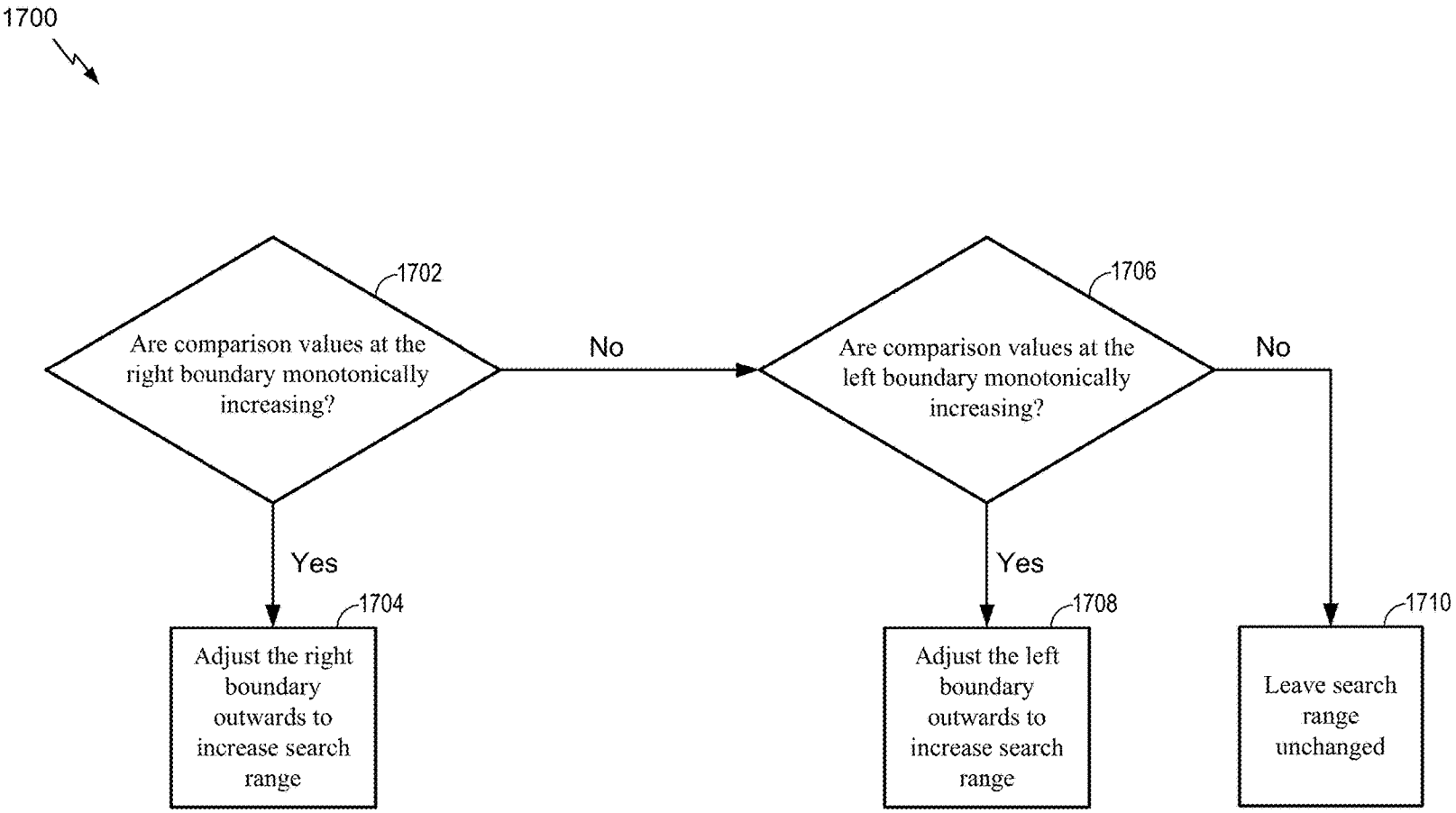
FIG. 17 is a diagram for selectively expanding a search range for comparison values used for shift estimation.
Figure 18:
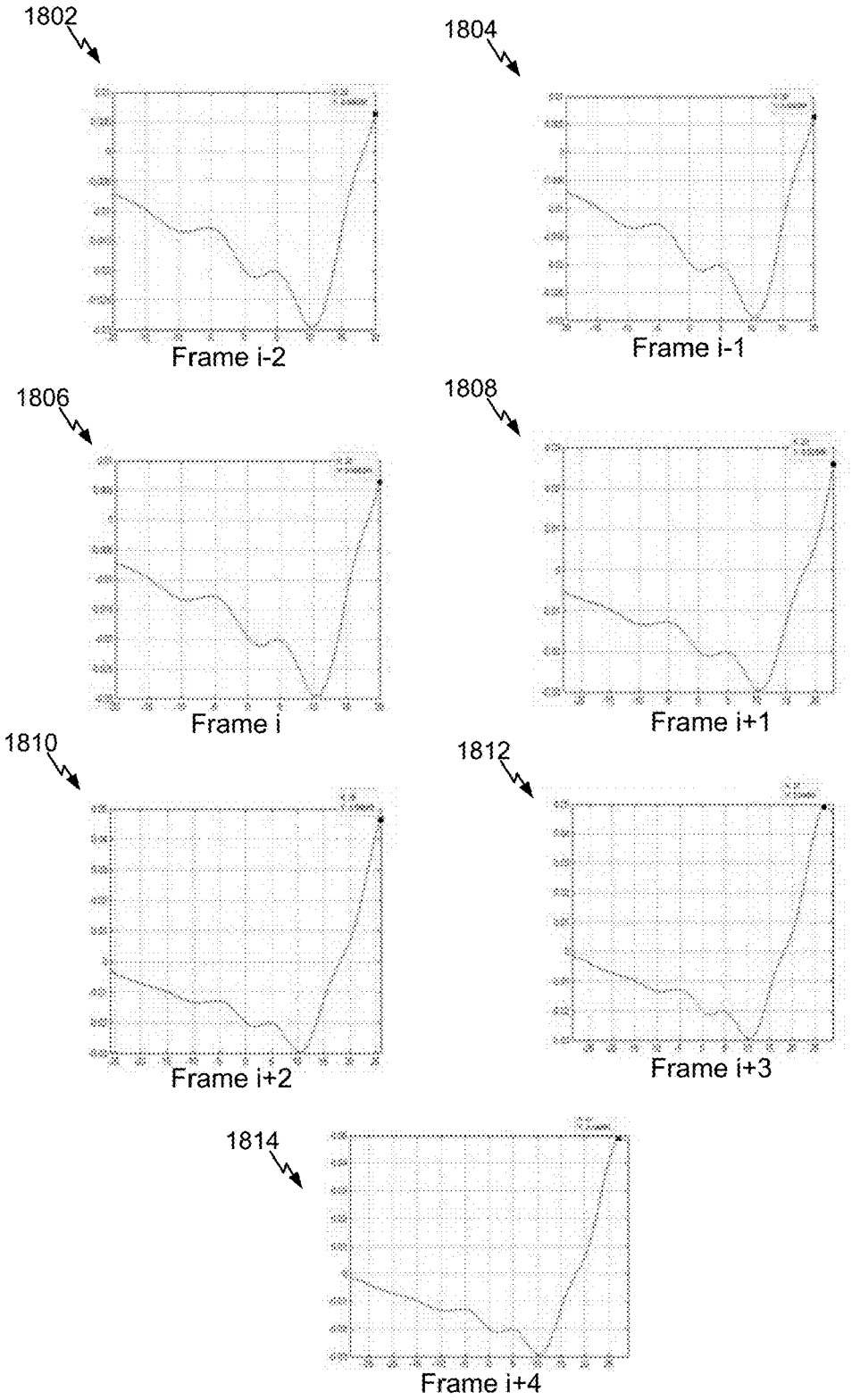
FIG. 18 is depicts graphs illustrating selective expansion of a search range for comparison values used for shift estimation.

According to one implementation, the method 1600 may include adjusting a range of comparison values that are used to estimate the delay between the first frame and the second frame, as described in greater detail with respect to FIGS. 17-18. The delay may be associated with a comparison value in the range of comparison values having a highest cross-correlation. Adjusting the range may include determining whether comparison values at a boundary of the range are monotonically increasing and expanding the boundary in response to a determination that the comparison values at the boundary are monotonically increasing. The boundary may include a left boundary or a right boundary.

The method 1600 of FIG. 16 may substantially normalize the shift estimate between voiced frames, unvoiced frames, and transition frames. Normalized shift estimates may reduce sample repetition and artifact skipping at frame boundaries. Additionally, normalized shift estimates may result in reduced side channel energies, which may improve coding efficiency.

Referring to FIG. 17, a process diagram 1700 for selectively expanding a search range for comparison values used for shift estimation is shown. For example, the process diagram 1700 may be used to expand the search range for comparison values based on comparison values generated for a current frame, comparison values generated for past frames, or a combination thereof.

According to the process diagram 1700, a detector may be configured to determine whether the comparison values in the vicinity of a right boundary or left boundary is increasing or decreasing. The search range boundaries for future comparison value generation may be pushed outward to accommodate more shift values based on the determination. For example, the search range boundaries may be pushed outward for comparison values in subsequent frames or comparison values in a same frame when comparison values are regenerated. The detector may initiate search boundary extension based on the comparison values generated for a current frame or based on comparison values generated for one or more previous frames.

At 1702, the detector may determine whether comparison values at the right boundary are monotonically increasing. As a non-limiting example, the search range may extend from −20 to 20 (e.g., from 20 sample shifts in the negative direction to 20 samples shifts in the positive direction). As used herein, a shift in the negative direction corresponds to a first signal, such as the first audio signal 130 of FIG. 1, being a reference signal and a second signal, such as the second audio signal 132 of FIG. 1, being a target signal. A shift in the positive direction corresponds to the first signal being the target signal and the second signal being the reference signal.

If the comparison values at the right boundary are monotonically increasing, at 1702, the detector may adjust the right boundary outwards to increase the search range, at 1704. To illustrate, if comparison value at sample shift 19 has a particular value and the comparison value at sample shift 20 has a higher value, the detector may extend the search range in the positive direction. As a non-limiting example, the detector may extend the search range from −20 to 25. The detector may extend the search range in increments of one sample, two samples, three samples, etc. According to one implementation, the determination at 1702 may be performed by detecting comparison values at a plurality of samples towards the right boundary to reduce the likelihood of expanding the search range based on a spurious jump at the right boundary.

If the comparison values at the right boundary are not monotonically increasing, at 1702, the detector may determine whether the comparison values at the left boundary are monotonically increasing, at 1706. If the comparison values at the left boundary are monotonically increasing, at 1706, the detector may adjust the left boundary outwards to increase the search range, at 1708. To illustrate, if comparison value at sample shift −19 has a particular value and the comparison value at sample shift −20 has a higher value, the detector may extend the search range in the negative direction. As a non-limiting example, the detector may extend the search range from −25 to 20. The detector may extend the search range in increments of one sample, two samples, three samples, etc. According to one implementation, the determination at 1702 may be performed by detecting comparison values at a plurality of samples towards the left boundary to reduce the likelihood of expanding the search range based on a spurious jump at the left boundary. If the comparison values at the left boundary are not monotonically increasing, at 1706, the detector may leave the search range unchanged, at 1710.

Thus, the process diagram 1700 of FIG. 17 may initiate search range modification for future frames. For example, the if the past three consecutive frames are detected to be monotonically increasing in the comparison values over the last ten shift values before the threshold (e.g., increasing from sample shift 10 to sample shift 20 or increasing from sample shift −10 to sample shift −20), the search range may be increased outwards by a particular number of samples. This outward increase of the search range may be continuously implemented for future frames until the comparison value at the boundary is no longer monotonically increasing. Increasing the search range based on comparison values for previous frames may reduce the likelihood that the "true shift" might lay very close to the search range's boundary but just outside the search range. Reducing this likelihood may result in improved side channel energy minimization and channel coding.

Referring to FIG. 18, graphs illustrating selective expansion of a search range for comparison values used for shift estimation is shown. The graphs may operate in conjunction with the data in Table 1.

TABLE 1

Selective Search Range Expansion Data

| Frame | Is current frame's correlation monotonously increasing at left boundary? | No. of consecutive frames with monotonously increasing left boundary | Is current frame's correlation monotonously increasing at right boundary? | No. of consecutive frames with monotonously increasing right boundary | Action to take | Boundary range | Best Estimated shift |
|---|---|---|---|---|---|---|---|
| i−2 | No | 0 | Yes | 1 | Leave future search range unchanged | [−20, 20] | 2 |
| i−1 | No | 0 | Yes | 2 | Leave future search range unchanged | [−20, 20] | −12 |
| i | No | 0 | Yes | 3 | Push the future right boundary outward | [−20, 20] | −12 |
| i+1 | No | 0 | Yes | 4 | Push the future right boundary outward | [−23, 23] | −12 |
| i+2 | No | 0 | Yes | 5 | Push the future right boundary outward | [−26, 26] | 26 |
| i+3 | No | 0 | No | 0 | Leave future search range unchanged | [−29, 29] | 27 |
| i+4 | No | 1 | No | 1 | Leave future search range unchanged | [−29, 29] | 27 |

According to Table 1, the detector may expand the search range if a particular boundary increases at three or more consecutive frames. The first graph 1802 illustrates comparison values for frame i−2. According to the first graph 1802, the left boundary is not monotonically increasing and the right boundary is monotonically increasing for one consecutive frame. As a result, the search range remains unchanged for the next frame (e.g., frame i−1) and the boundary may range from −20 to 20. The second graph 1804 illustrates comparison values for frame i−1. According to the second graph 1804, the left boundary is not monotonically increasing and the right boundary is monotonically increasing for two consecutive frames. As a result, the search range remains unchanged for the next frame (e.g., frame i) and the boundary may range from −20 to 20.

The third graph 1806 illustrates comparison values for frame i. According to the third graph 1806, the left boundary is not monotonically increasing and the right boundary is monotonically increasing for three consecutive frames. Because the right boundary in monotonically increasing for three or more consecutive frame, the search range for the next frame (e.g., frame i+1) may be expanded and the boundary for the next frame may range from −23 to 23. The fourth graph 1808 illustrates comparison values for frame i+1. According to the fourth graph 1808, the left boundary is not monotonically increasing and the right boundary is monotonically increasing for four consecutive frames. Because the right boundary in monotonically increasing for three or more consecutive frame, the search range for the next frame (e.g., frame i+2) may be expanded and the boundary for the next frame may range from −26 to 26. The fifth graph 1810 illustrates comparison values for frame i+2. According to the fifth graph 1810, the left boundary is not monotonically increasing and the right boundary is monotonically increasing for five consecutive frames. Because the right boundary in monotonically increasing for three or more consecutive frame, the search range for the next frame (e.g., frame i+3) may be expanded and the boundary for the next frame may range from −29 to 29.

The sixth graph 1812 illustrates comparison values for frame i+3. According to the sixth graph 1812, the left boundary is not monotonically increasing and the right boundary is not monotonically increasing. As a result, the search range remains unchanged for the next frame (e.g., frame i+4) and the boundary may range from −29 to 29. The seventh graph 1814 illustrates comparison values for frame i+4. According to the seventh graph 1814, the left boundary is not monotonically increasing and the right boundary is monotonically increasing for one consecutive frame. As a result, the search range remains unchanged for the next frame and the boundary may range from −29 to 29.

According to FIG. 18, the left boundary is expanded along with the right boundary. In alternative implementations, the left boundary may be pushed inwards to compensate for the outward push of the right boundary to maintain a constant number of shift values on which the comparison values are estimated for each frame. In another implementation, the left boundary may remain constant when the detector indicates that the right boundary is to be expanded outwards.

According to one implementation, when the detector indicates a particular boundary is to be expanded outwards, the amount of samples that the particular boundary is expanded outward may be determined based on the comparison values. For example, when the detector determines that the right boundary is to be expanded outwards based on the comparison values, a new set of comparison values may be generated on a wider shift search range and the detector may use the newly generated comparison values and the existing comparison values to determine the final search range. To illustrate, for frame i+1, a set of comparison values on a wider range of shifts ranging from −30 to 30 may be generated. The final search range may be limited based on the comparison values generated in the wider search range.

Although the examples in FIG. 18 indicate that the right boundary may be extended outwards, similar analogous functions may be performed to extend the left boundary outwards if the detector determines that the left boundary is to be extended. According to some implementations, absolute limitations on the search range may be utilized to prevent the search range for indefinitely increasing or decreasing. As a non-limiting example, the absolute value of the search range may not be permitted to increase above 8.75 milliseconds (e.g., the look-ahead of the CODEC).

Figure 19:
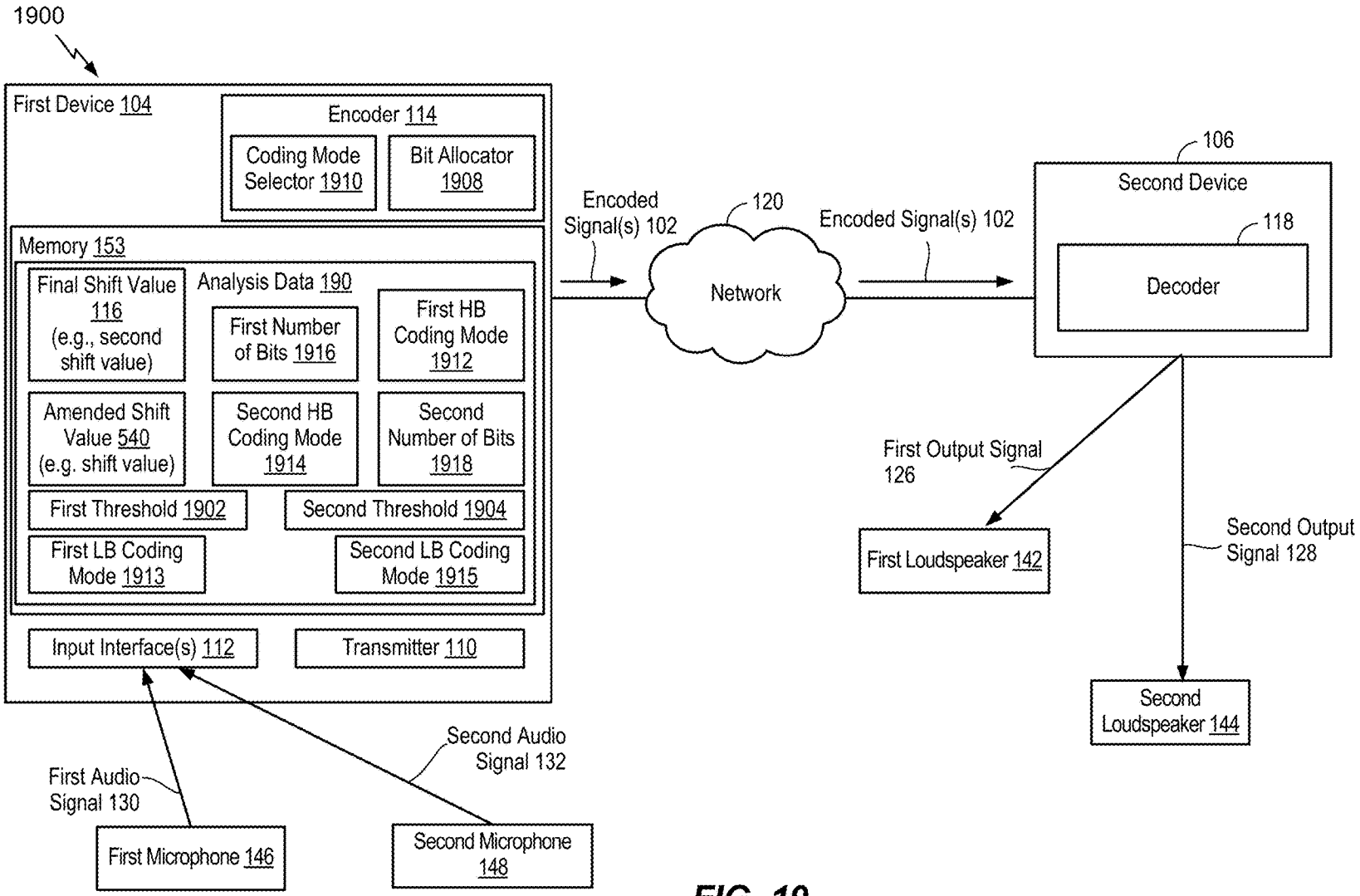
FIG. 19 is a block diagram of a particular illustrative example of a system that includes a device operable to encode multiple audio signals.

Referring to FIG. 19, a particular illustrative example of a system is disclosed and generally designated 1900. The system 1900 includes the first device 104 that is communicatively coupled, via the network 120, to the second device 106.

The first device 104 includes similar components and may operate in a substantially similar manner as described with respect to FIG. 1. For example, the first device 104 includes the encoder 114, the memory 153, the input interfaces 112, the transmitter 110, the first microphone 146, and the second microphone 148. In addition to the final shift value 116, the memory 153 may include additional information. For example, the memory 153 may include the amended shift value 540 of FIG. 5, a first threshold 1902, a second threshold 1904, a first HB coding mode 1912, a first LB coding mode 1913, a second HB coding mode 1914, a second LB coding mode 1915, a first number of bits 1916, and a second number of bits 1918. In addition to the temporal equalizer 108 depicted in FIG. 1, the encoder 114 may include a bit allocator 1908 and a coding mode selector 1910.

The encoder 114 (or another processor at the first device 104) may determine the final shift value 116 and the amended shift value 540 according to the techniques described with respect to FIG. 5. As described below, the amended shift value 540 may also be referred to as the "shift value" and the final shift value 116 may also be referred to as the "second shift value". The amended shift value may be indicative of a shift (e.g., a time shift) of the first audio signal 130 captured by the first microphone 146 relative to the second audio signal 132 captured by the second microphone 148. As described with respect to FIG. 5, the final shift value 116 may be based on the amended shift value 540.

The bit allocator 1908 may be configured to determine a bit allocation based on the final shift value 116 and the amended shift value 540. For example, the bit allocator 1908 may determine a variation between the final shift value 116 and the amended shift value 540. After determining the variation, the bit allocator 1908 may compare variation to the first threshold 1902. As described below, if the variation satisfies the first threshold 1902, the number of bits allocated to a mid signal and the number of bits allocated to a side signal may be adjusted during an encoding operation.

To illustrate, the encoder 114 may be configured to generate at least one encoded signal (e.g., the encoded signals 102) based on the bit allocation. The encoded signals 102 may include a first encoded signal and a second encoded signal. According to one implementation, the first encoded signal may correspond to a mid signal and the second encoded signal may correspond to a side signal. The encoder 114 may generate the mid signal (e.g., the first encoded signal) based on a sum of the first audio signal 130 and the second audio signal 132. The encoder 114 may generate the side signal based on a difference between the first audio signal 130 and the second audio signal 132. According to one implementation, the first encoded signal and the second encoded signal may include low-band signals. For example, the first encoded signal may include a low-band mid signal, and the second encoded signal may include a low-band side signal. The first encoded signal and the second encoded signal may include high-band signals. For example, the first encoded signal may include a high-band mid signal, and the second encoded signal may include a high-band side signal.

If the final shift value 116 (e.g., a shift amount used for encoding the encoded signals 102) is different than the amended shift value 540 (e.g., a shift amount calculated to reduce side signal energy), additional bits may be allocated to the side signal coding as compared to a scenario where the final shift value 116 and the amended shift value 540 are similar. After allocating the additional bits to the side signal coding, the remainder of the available bits may be allocated to the mid signal coding and to the side parameters. Having a similar final shift value 116 and amended shift value 540 may substantially reduce the likelihood of sign reversals in successive frames, substantially reduce an occurrence of a large jump in the shift between the audio signals 130, 132, and/or may temporally slow-shift the target signal from frame to frame. For example, the shift may evolve (e.g., change) slowly because the side channel is not fully decorrelated and because changing the shift in large steps may generate artifacts. Additionally, if the shift changes more than a particular amount from frame to frame and a final shift variation is limited, increased side frame energy may occur. Thus, additional bits may be allocated to the side signal coding to account for the increased side frame energy.

To illustrate, the bit allocator 1908 may allocate the first number of bits 1916 to the first encoded signal (e.g., the mid signal) and may allocate the second number of bits 1918 to the second encoded signal (e.g., the side signal). The bit allocator 1908 may determine the variation (or the difference) between the final shift value 116 and the amended shift value 540. After determining the variation, the bit allocator 1908 may compare variation to the first threshold 1902. In response to the variation between the amended shift value 540 and the final shift value 116 satisfying the first threshold 1902, the bit allocator 1908 may decrease the first number of bits 1916 and increase the second number of bits 1918. For example, the bit allocator 1908 may decrease the number of bits allocated to the mid signal and may increase the number of bits allocated to the side signal. According to one implementation, the first threshold 1902 may be equal to relatively small value (e.g., zero or one) such that the additional bits are allocated to the side signal if the final shift value 116 and the amended shift value 540 are not (substantially) similar.

As described above, the encoder 114 may generate the encoded signals 102 based on the bit allocation. Additionally, the encoded signals 102 may be based on a coding mode, and the coding mode may be based on the amended shift value 540 (e.g., the shift value) and the final shift value 116 (e.g., the second shift value). For example, the encoder 114 may be configured to determine the coding mode based on the amended shift value 540 and the final shift value 116. As described above, the encoder 114 may determine the difference between the amended shift value 540 and the final shift value 116.

In response to the difference satisfying a threshold, the encoder 114 may generate the first encoded signal (e.g., the mid signal) based on a first coding mode and may generate the second encoded signal (e.g., the side signal) based on a second coding mode. Examples of coding modes are described further with reference to FIGS. 21-22. To illustrate, according to one implementation, the first encoded signal includes a low-band mid signal and the second encoded signal includes a low-band side signal, and the first coding mode and the second coding mode include an algebraic code-excited linear prediction (ACELP) coding mode. According to another implementation, the first encoded signal includes a high-band mid signal and the second encoded signal includes a high-band side signal, and the first coding mode and the second coding mode include a bandwidth extension (BWE) coding mode.

According to one implementation, in response to the difference between the amended shift value 540 and the final shift value 116 failing to satisfy the threshold, the encoder 114 may generate an encoded low-band mid signal (e.g., the first encoded signal) based on an ACELP coding mode and may generate an encoded low-band side signal (e.g., the second encoded signal) based on a predictive ACELP coding mode. In this scenario, the encoded signals 102 may include the encoded low-band mid signal and one or more parameters corresponding to the encoded low-band side signal.

According to a particular implementation, the encoder 114 may, based on determining at least that the variation in a second shift value (e.g., the amended shift value 540 or the final shift value 116 of the frame 304) relative to the first shift value 962 (e.g., the final shift of the frame 302) exceeds a particular threshold, set a shift variation tracking flag. The encoder 114 may estimate, based on the shift variation tracking flag, the gain parameter 160 (e.g., an estimated target gain), or both, an energy ratio value or a downmix factor (e.g., DMXFAC (as in Equations 2c-2d)). The encoder 114 may determine the bit allocation for the frame 304 based on the downmix factor (DMXFAC) that is controlled by the shift variation, as shown in the pseudo code below.

Pseudo Code: Generating the Shift Variation Tracking Flag

```
Shift_variation_tracking flag = 0;
if( speech_frame
        && ( abs(prevFrameShiftValue –
currFrameShiftValue) > THR ) )
{
        Shift_variation_tracking flag = 1;
}
Pseudo code: Adjusting downmix factor based on shift variation,
target gain.
if( (currentFrameTargetGain > 1.2 || longTermTargetGain >
1.0) && downmixFactor < 0.4f )
{
    /* Setting the downmix factor to a less conservative
    value */ downmixFactor = 0.4f;
}
else if( (currentFrameTargetGain < 0.8 || longTerm-
TargetGain < 1.0) && downmixFactor > 0.6f )
{
    /* Setting the downmix factor to a less conservative
    value */ downmixFactor = 0.6f;
}
if( shift_variation_tracking flag == 1 )
{
    if(currentFrameTargetGain > 1.0f)
    {
        downmixFactor = max(downmixFactor, 0.6f);
    }
    else if(currentFrameTargetGain < 1.0f)
    {
        downmixFactor = min(downmixFactor, 0.4f);
    }
}
```

Pseudo code: Adjusting bit allocation based on downmix factor.

sideChannel_bits=functionof(downmixFactor, coding mode);

HighBand_bits=functionof(coder_type, core samplerate, total_bitrate)

midChannel_bits=total_bits−sideChannel_bits−HB_bits;

The "sideChannel_bits" may correspond to the second number of bits 1918. The "midChannel_bits" may correspond to the first number of bits 1916. According to a particular implementation, the sideChannel_bits may be estimated based on the downmix factor (e.g., DMXFAC), the coding mode (e.g., ACELP, TCX, INACTIVE, etc.), or both. The high band bit allocation, HighBand_bits may be based on the coder type (ACELP, voiced, unvoiced), the core sample rate (12.8 kHz or 16 kHz core), the fixed total bit rate available for side-channel coding, mid-channel coding, and high-band coding, or a combination thereof. The remaining number of bits after allocating to side-channel coding and high-band coding may be allocated for mid-channel coding.

In a particular implementation, the final shift value 116 chosen for target channel adjustment may be distinct from the suggested or actual amended shift value (e.g., the amended shift value 540). A state machine (e.g., the encoder 114) may, in response to determining that the amended shift value 540 is greater than a threshold and would result in a large shift or adjustment in the target channel, set the final shift value 116 to an intermediate value. For example, the encoder 114 may set the final shift value 116 to an intermediate value between the first shift value 962 (e.g., the previous frame's final shift value) and the amended shift value 540 (e.g., the current frame's suggested or amended shift value). When the final shift value 116 is distinct from the amended shift value 540, the side channel may not be maximally decorrelated. Setting the final shift value 116 to an intermediate value (i.e., not the true or actual shift value, such as represented by the amended shift value 540) may result in allocating more bits to the side-channel coding. The side-channel bit allocation may be directly based on the shift variation or indirectly based on the shift variation tracking flag, target gain, the downmix factor DMXFAC, or a combination thereof.

According to another implementation, in response to the difference between the amended shift value 540 and the final shift value 116 failing to satisfy the threshold, the encoder 114 may generate an encoded high-band mid signal (e.g., the first encoded signal) based on a BWE coding mode and may generate an encoded high-band side signal (e.g., the second encoded signal) based on a blind BWE coding mode. In this scenario, the encoded signals 102 may include the encoded high-band mid signal and one or more parameters corresponding to the encoded high-band side signal.

The encoded signals 102 may be based on first samples of the first audio signal 130 and second samples of the second audio signal 132. The second samples may be time-shifted relative to the first samples by an amount that is based on the final shift value 116 (e.g., the second shift value). The transmitter 110 may be configured to transmit the encoded signals 102 to the second device 106 via the network 120. Upon receiving the encoded signal 102, the second device 106 may operate in a substantially similar manner as described with respect to FIG. 1 to output the first output signal 126 at the first loudspeaker 142 and to output the second output signal 128 at the second loudspeaker 144.

The system 1900 of FIG. 19 may enable the encoder 114 to adjust (e.g., increase) the number of bits allocated to side channel coding if the final shift value 116 is different than the amended shift value 540. For example, the final shift value 116 may be restricted (by the shift change analyzer 512 of FIG. 5) to a value that is different than the amended shift value 540 to avoid sign reversal in successive frames, to avoid large shift jumps, and/or to temporally slow-shift the target signal from frame to frame to align with the reference signal. In these scenarios, the encoder 114 may increase the number of bits allocated to side channel coding to reduce artifacts. It should be understood that the final shift value 116 may be different than the amended shift value 540 based on other parameters, such as inter-channel pre-processing/analysis parameters (e.g., voicing, pitch, frame energy, voice activity, transient detection, speech/music classification, coder type, noise level estimation, signal-to-noise ratio (SNR) estimation, signal entropy, etc.), based on a cross-correlation between channels, and/or based on a spectral similarity between channels.

Figure 20:
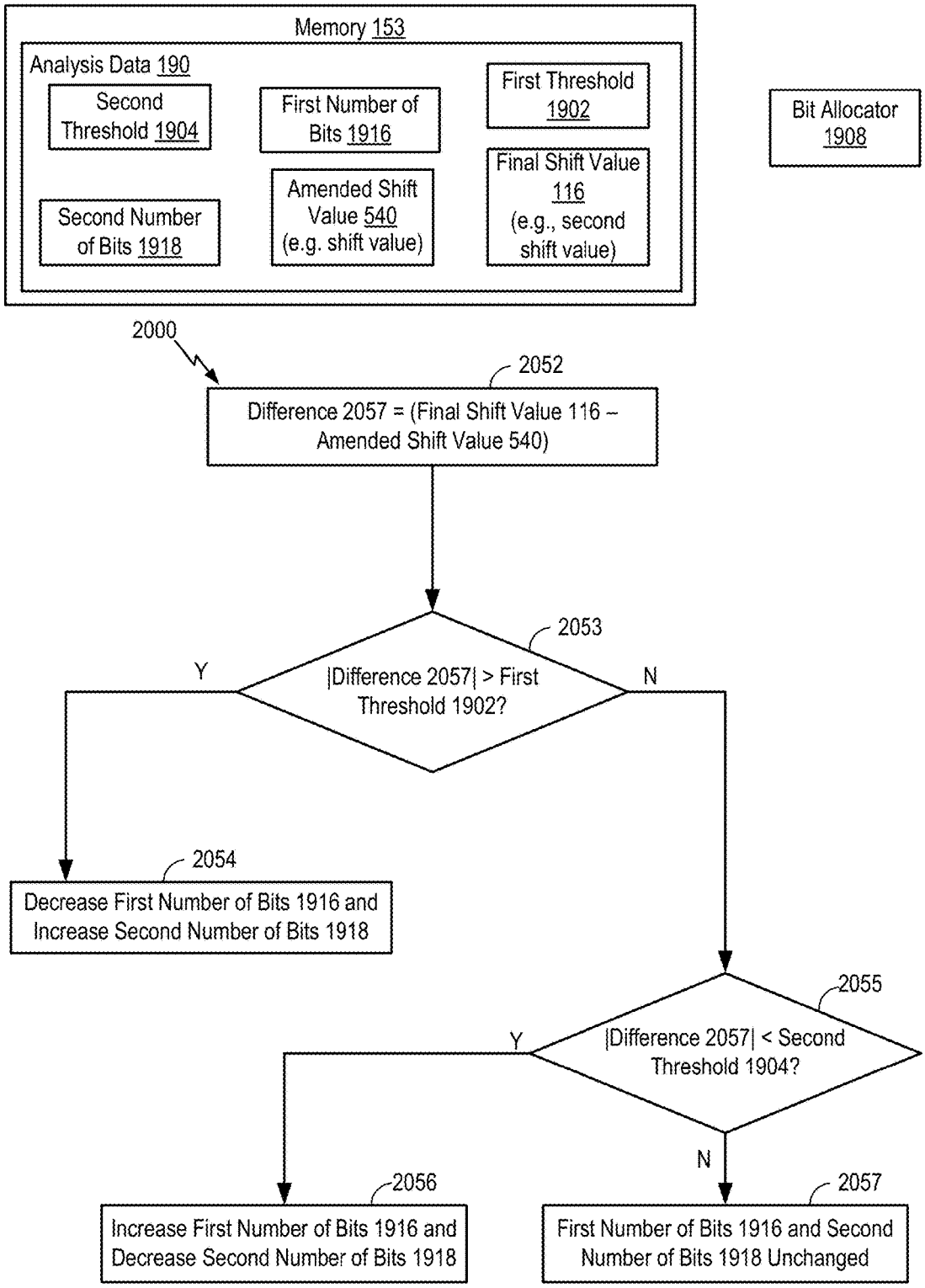
FIG. 20 is a flowchart of a method for allocating bits between a mid signal and a side signal.

Referring to FIG. 20, a flowchart of a method 2000 for allocating bits between a mid signal and a side signal is shown. The method 2000 may be performed by the bit allocator 1908.

At 2052, the method 2000 includes determining a difference 2057 between the final shift value 116 and the amended shift value 540. For example, the bit allocator 1908 may determine the difference 2057 by subtracting the amended shift value 540 from the final shift value 116.

At 2053, the method 2000 includes comparing the difference 2057 (e.g., the absolute value of the difference 2057) to the first threshold 1902. For example, the bit allocator 1908 may determine whether the absolute value of the difference is greater than the first threshold 1902. If the absolute value of the difference 2057 is greater than the first threshold 1902, the bit allocator 1908 may decrease the first number of bits 1916 and may increase the second number of bits 1918, at 2054. For example, the bit allocator 1908 may decrease the number of bits allocated to the mid signal and may increase the number of bits allocated to the side signal.

If the absolute value of the difference 2057 is not greater than the first threshold 1902, the bit allocator 1908 may determine whether the absolute value of the difference 2057 is less than the second threshold 1904, at 2055. If the absolute value of the difference 2057 is less than the second threshold 1904, the bit allocator 1908 may increase the first number of bits 1916 and may decrease the second number of bits 1918, at 2056. For example, the bit allocator 1908 may increase the number of bits allocated to the mid signal and may decrease the number of bits allocated to the side channel. If the absolute value of the difference 2057 is not less than the second threshold 1904, the first number of bits 1916 and the second number of bits 1918 may remain unchanged, at 2057.

The method 2000 of FIG. 20 may enable the bit allocator 1908 to adjust (e.g., increase) the number of bits allocated to side channel coding if the final shift value 116 is different than the amended shift value 540. For example, the final shift value 116 may be restricted (by the shift change analyzer 512 of FIG. 5) to a value that is different than the amended shift value 540 to avoid sign reversal in successive frames, to avoid large shift jumps, and/or to temporally slow-shift the target signal from frame to frame to align with the reference signal. In these scenarios, the encoder 114 may increase the number of bits allocated to side channel coding to reduce artifacts.

Figure 21:
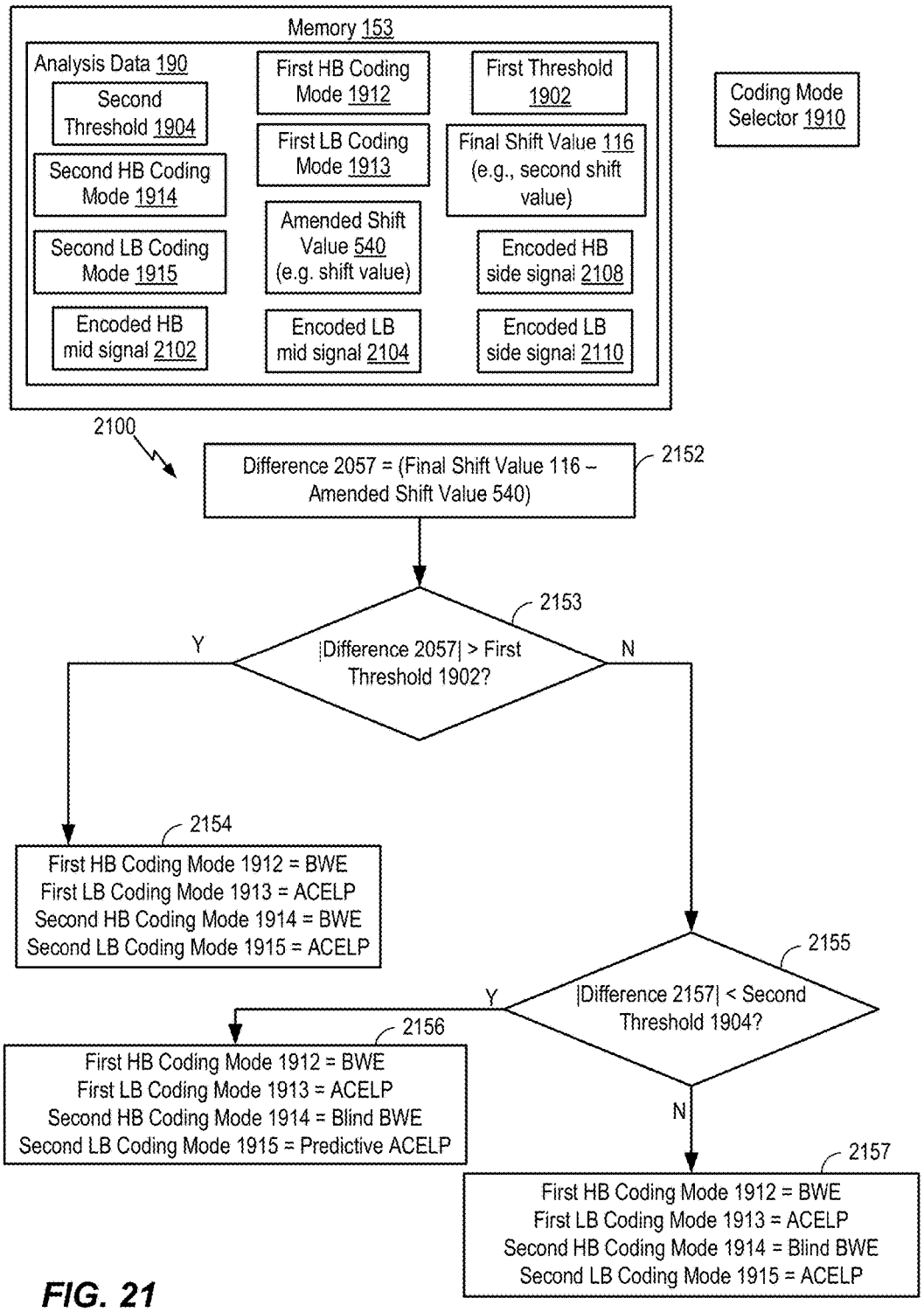
FIG. 21 is a flowchart of a method for selecting different coding modes based on a final shift value and a amended shift value.
Figure 22:
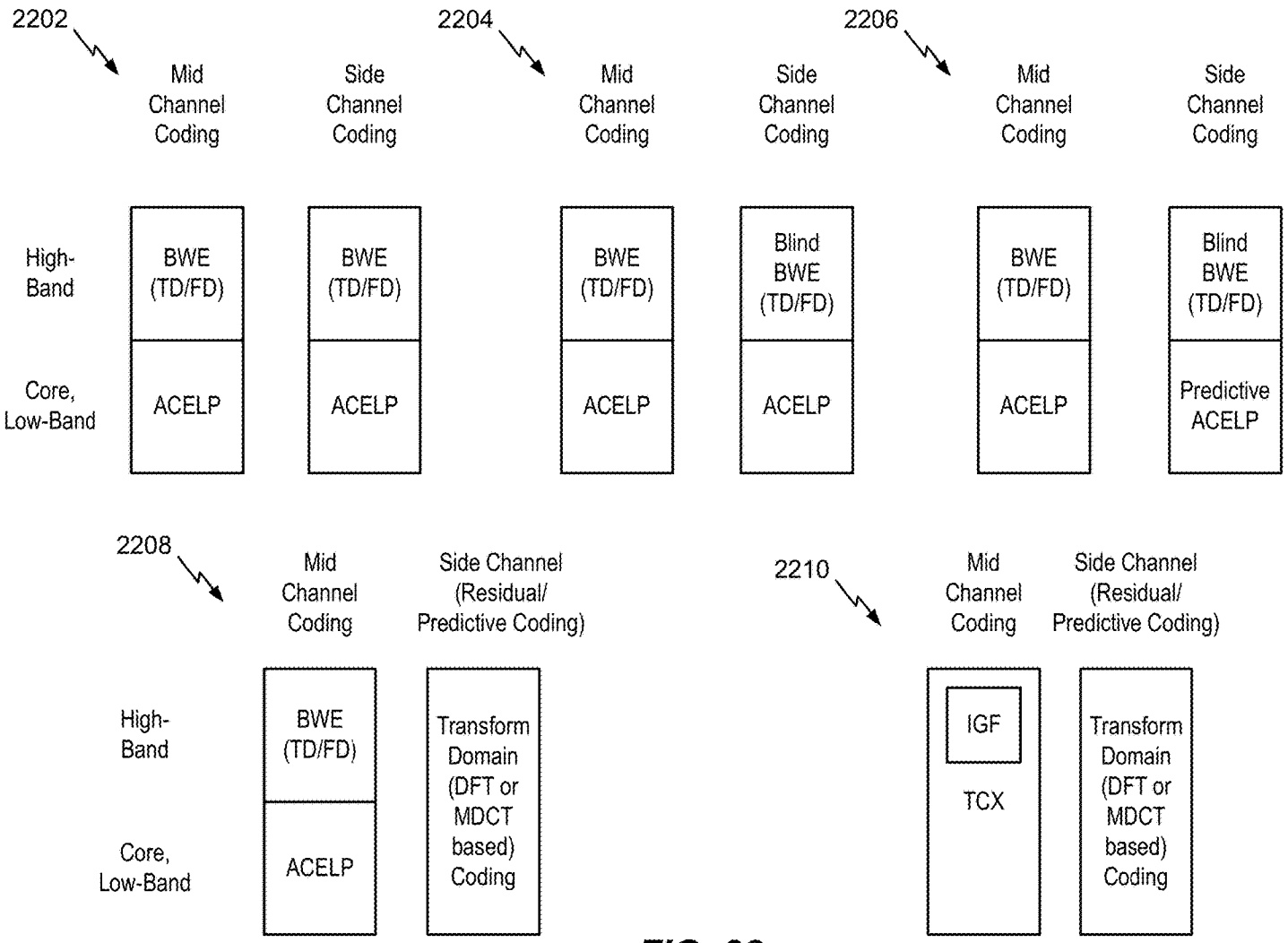
FIG. 22 illustrates different coding modes according to the techniques described herein.

Referring to FIG. 21, a flowchart of a method 2100 for selecting different coding modes based on the final shift value 116 and the amended shift value 540 is shown. The method 2100 may be performed by the coding mode selector 1910.

At 2152, the method 2100 includes determining the difference 2057 between the final shift value 116 and the amended shift value 540. For example, the bit allocator 1908 may determine the difference 2057 by subtracting the amended shift value 540 from the final shift value 2052.

At 2153, the method 2100 includes comparing the difference 2057 (e.g., the absolute value of the difference 2057) to the first threshold 1902. For example, the bit allocator 1908 may determine whether the absolute value of the difference is greater than the first threshold 1902. If the absolute value of the difference 2057 is greater than the first threshold 1902, the coding mode selector 1910 may select a BWE coding mode as the first HB coding mode 1912, select an ACELP coding mode as the first LB coding mode 1913, select a BWE coding mode as the second HB coding mode 1914, and select an ACELP coding mode as the second LB coding mode 1915, at 2154. An illustrative implementation of coding according to this scenario is depicted as a coding scheme 2202 in FIG. 22. According to the coding scheme 2202, the high-band may be encoded using time-division (TD) or frequency-division (FD) BWE coding modes.

Referring back to FIG. 21, if the absolute value of the difference 2057 is not greater than the first threshold 1902, the coding mode selector 1910 may determine whether the absolute value of the difference 2057 is less than the second threshold 1904, at 2155. If the absolute value of the difference 2057 is less than the second threshold 1904, the coding mode selector 1910 may select a BWE coding mode as the first HB coding mode 1912, select an ACELP coding mode as the first LB coding mode 1913, select a blind BWE coding mode as the second HB coding mode 1914, and select a predictive ACELP as the second LB coding mode 1915, at 2156. An illustrative implementation of coding according to this scenario is depicted as a coding scheme 2206 in FIG. 22. According to the coding scheme 2206, the high-band may be encoded using a TD or FD BWE coding mode for mid channel coding, and the high-band may be encoded using a TD or FD blind BWE coding mode for side channel coding.

Referring back to FIG. 21, if the absolute value of the difference 2057 is not less than the second threshold 1904, the coding mode selector 1910 may select a BWE coding mode as the first HB coding mode 1912, select an ACELP coding mode as the first LB coding mode 1913, select a blind BWE coding mode as the second HB coding mode 1914, and select an ACELP coding mode as the second LB coding mode 1915, at 2157. An illustrative implementation of coding according to this scenario is depicted as a coding scheme 2204 in FIG. 22. According to the coding scheme 2204, the high-band may be encoded using a TD or FD BWE coding mode for mid channel coding, and the high-band may be encoded using a TD or FD blind BWE coding mode for side channel coding.

Thus, according to the method 2100, the coding scheme 2202 may allocate a large number of bits for side channel coding, the coding scheme 2204 may allocate a smaller number of bits for side channel coding, and the coding scheme 2206 may allocate an even smaller number of bits for side channel coding. If the signals 130, 132 are noise-like signals, the coding mode selector 1910 may encode the signals 130, 132 according to a coding scheme 2208. For example, the side channel may be encoded using residual or predictive coding. The high-band and low-band side channel may be encoded using transform domain (e.g., Discrete Fourier Transform (DFT) or Modified Discrete Cosine Transform (MDCT) coding). If the signals 130, 132 have reduced noise (e.g., music-like signals), the coding mode selector 1910 may encode the signals 130, 132 according to a coding scheme 2210. The coding scheme 2210 may be similar to the coding scheme 2208, however, the mid channel coding according to the coding scheme 2210 includes transform coded excitation (TCX) coding.

The method 2100 of FIG. 21 may enable the coding mode selector 1910 change the coding modes for mid channel and the side channel based on a difference between the final shift value 116 and the amended shift value 540.

Figure 23:
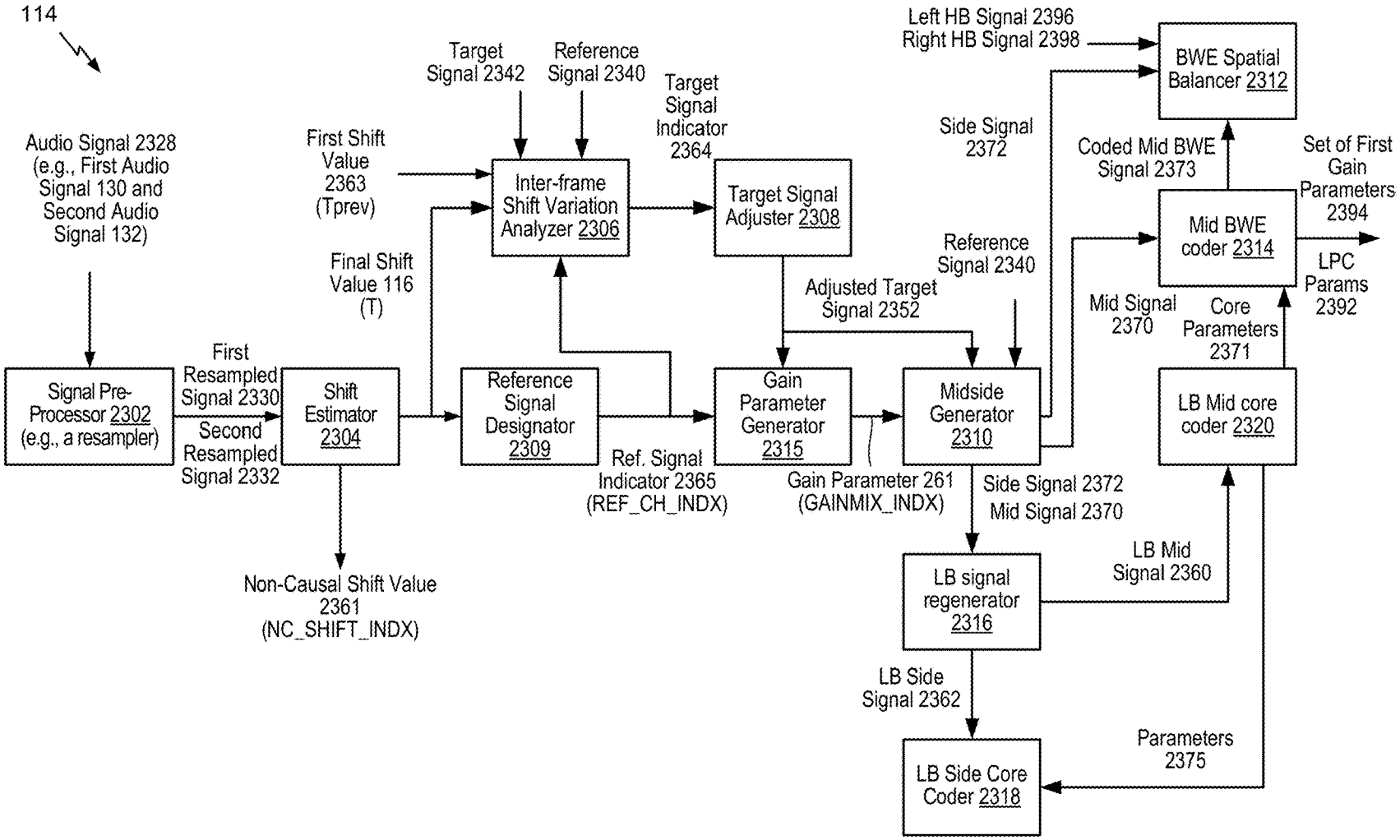
FIG. 23 illustrates an encoder.

Referring to FIG. 23, an illustrative example of the encoder 114 of the first device 104 is shown. The encoder 114 includes a signal pre-processor 2302 coupled, via a shift estimator 2304, to an inter-frame shift variation analyzer 2306, to a reference signal designator 2309, or both. The signal pre-processor 2302 may be configured to receive audio signals 2328 (e.g., the first audio signal 130 and the second audio signal 132) and to process the audio signals 2328 to generate a first resampled signal 2330 and a second resampled signal 2332. For example, the signal pre-processor 2302 may be configured to downsample or resample the audio signals 2328 to generate the resampled signals 2330, 2332. The shift estimator 2304 may be configured to determine shift values based on comparison(s) of the resampled signals 2330, 2332. The inter-frame shift variation analyzer 2306 may be configured to identify audio signals as reference signals and target signals. The inter-frame shift variation analyzer 2306 may also be configured to determine a difference between two shift values. The reference signal designator 2309 may be configured to select one audio signal as a reference signal (e.g., a signal that is not time-shifted) and to select another audio signal as a target signal (e.g., a signal that is time-shifted relative to the reference signal to temporally align the signal with the reference signal).

The inter-frame shift variation analyzer 2306 may be coupled, via the target signal adjuster 2308, to the gain parameter generator 2315. The target signal adjuster 2308 may be configured to adjust a target signal based on a difference between shift values. For example, the target signal adjuster 2308 may be configured to perform interpolation on a subset of samples to generate estimated samples that are used to generate adjusted samples of the target signal. The gain parameter generator 2315 may be configured to determine a gain parameter of the reference signal that "normalizes" (e.g., equalizes) a power level of the reference signal relative to a power level of the target signal. Alternatively, the gain parameter generator 2315 may be configured to determine a gain parameter of the target signal that normalizes (e.g., equalizes) a power level of the target signal relative to a power level of the reference signal.

The reference signal designator 2309 may be coupled to the inter-frame shift variation analyzer 2306, to the gain parameter generator 2315, or both. The target signal adjuster 2308 may be coupled to a midside generator 2310, to the gain parameter generator 2315, or to both. The gain parameter generator 2315 may be coupled to the midside generator 2310. The midside generator 2310 may be configured to perform encoding on the reference signal and the adjusted target signal to generate at least one encoded signal. For example, the midside generator 2310 may be configured to perform stereo encoding to generate a mid channel signal 2370 and a side channel signal 2372.

The midside generator 2310 may be coupled to a bandwidth extension (BWE) spatial balancer 2312, a mid BWE coder 2314, a low band (LB) signal regenerator 2316, or a combination thereof. The LB signal regenerator 2316 may be coupled to a LB side core coder 2318, a LB mid core coder 2320, or both. The mid BWE coder 2314 may be coupled to the BWE spatial balancer 2312, the LB mid core coder 2320, or both. The BWE spatial balancer 2312, the mid BWE coder 2314, the LB signal regenerator 2316, the LB side core coder 2318, and the LB mid core coder 2320 may be configured to perform bandwidth extension and additional coding, such as low band coding and mid band coding, on the mid channel signal 2370, the side channel signal 2372, or both. Performing bandwidth extension and additional coding may include performing additional signal encoding, generating parameters, or both.

During operation, the signal pre-processor 2302 may receive the audio signals 2328. The audio signals 2328 may include the first audio signal 130, the second audio signal 132, or both. In a particular implementation, the audio signals 2328 may include a left channel signal and a right channel signal. In other implementations, the audio signals 2328 may include other signals. The signal pre-processor 2302 may downsample (or resample) the first audio signal 130 and the second audio signal 132 to generate the resampled signals 2330, 2332 (e.g., the downsampled first audio signal 130 and the downsampled second audio signal 132).

The shift estimator 2304 may generate shift values based on the resampled signals 2330, 2332. In a particular implementation, the shift estimator 2304 may generate a non-causal shift value (NC_SHIFT_INDX) 2361 after performance of an absolute value operation. In a particular implementation, the shift estimator 2304 may prevent a next shift value from having a different sign (e.g., positive or negative) than a current shift value. For example, when the shift value for a first frame is negative and the shift value for a second frame is determined to be positive, the shift estimator 2304 may set the shift value for the second frame to be zero. As another example, when the shift value for the first frame is positive and the shift value for the second frame is determined to be negative, the shift estimator 2304 may set the shift value for the second frame to be zero. Thus, in this implementation, a shift value for a current frame has the same sign (e.g., positive or negative) as a shift value for a previous frame, or the shift value for the current frame is zero.

The reference signal designator 2309 may select one of the first audio signal 130 and the second audio signal 132 as a reference signal for a time period corresponding to the third frame and the fourth frame. The reference signal designator 2309 may determine the reference signal based on the final shift value 116 from the shift estimator 2304. For example, when the final shift value 116 is negative, the reference signal designator 2309 may identify the second audio signal 132 as the reference signal and the first audio signal 130 as the target signal. When the final shift value 116 is positive or zero, the reference signal designator 2309 may identify the second audio signal 132 as the target signal and the first audio signal 130 as the reference signal. The reference signal designator 2309 may generate the reference signal indicator 2365 that has a value that indicates the reference signal. For example, the reference signal indicator 2365 may have a first value (e.g., a logical zero value) when the first audio signal 130 is identified as the reference signal, and the reference signal indicator 2365 may have a second value (e.g., a logical one value) when the second audio signal 132 is identified as the reference signal. The reference signal designator 2309 may provide the reference signal indicator 2365 to the inter-frame shift variation analyzer 2306 and to the gain parameter generator 2315.

The inter-frame shift variation analyzer 2306 may generate a target signal indicator 2364 based on the final shift value 116, a first shift value 2363, a target signal 2342, a reference signal 2340, and the reference signal indicator 2365. The target signal indicator 2364 indicates an adjusted target channel. For example, a first value (e.g., a logical zero value) of the target signal indicator 2364 may indicate that the first audio signal 130 is the adjusted target channel, and a second value (e.g., a logical one value) of the target signal indicator 2364 may indicate that the second audio signal 132 is the adjusted target channel. The inter-frame shift variation analyzer 2306 may provide the target signal indicator 2364 to the target signal adjuster 2308.

The target signal adjuster 2308 may adjust samples corresponding to the adjusted target signal to generate the adjusted samples an adjusted target signal 2352. The target signal adjuster 2308 may provide the adjusted target signal 2352 to the gain parameter generator 2315 and to the midside generator 2310. The gain parameter generator 2315 may generate a gain parameter 261 based on the reference signal indicator 2365 and the adjusted target signal 2352. The gain parameter 261 may normalize (e.g., equalize) a power level of the target signal relative to a power level of the reference signal. Alternatively, the gain parameter generator 2315 may receive the reference signal (or samples thereof) and determine the gain parameter 261 that normalizes a power level of the reference signal relative to a power level of the target signal. The gain parameter generator 2315 may provide the gain parameter 261 to the midside generator 2310.

The midside generator 2310 may generate the mid channel signal 2370, the side channel signal 2372, or both, based on the adjusted target signal 2352, the reference signal 2340, and the gain parameter 261. The midside generator 2310 may provide the side channel signal 2372 to the BWE spatial balancer 2312, the LB signal regenerator 2316, or both. The midside generator 2310 may provide the mid channel signal 2370 to the mid BWE coder 2314, the LB signal regenerator 2316, or both. The LB signal regenerator 2316 may generate a LB mid signal 2360 based on the mid channel signal 2370. For example, the LB signal regenerator 2316 may generate the LB mid signal 2360 by filtering the mid channel signal 2370. The LB signal regenerator 2316 may provide the LB mid signal 2360 to the LB mid core coder 2320. The LB mid core coder 2320 may generate parameters (e.g., core parameters 2371, parameters 2375, or both) based on the LB mid signal 2360. The core parameters 2371, the parameters 2375, or both, may include an excitation parameter, a voicing parameter, etc. The LB mid core coder 2320 may provide the core parameters 2371 to the mid BWE coder 2314, the parameters 2375 to the LB side core coder 2318, or both. The core parameters 2371 may be the same as or distinct from the parameters 2375. For example, the core parameters 2371 may include one or more of the parameters 2375, may exclude one or more of the parameters 2375, may include one or more additional parameters, or a combination thereof. The mid BWE coder 2314 may generate a coded mid BWE signal 2373 based on the mid channel signal 2370, the core parameters 2371, or a combination thereof. The mid BWE coder 2314 may also generate a set of first gain parameters 2394 and LPC parameters 2392 based on the mid channel signal 2370, the core parameters 2371, or a combination thereof. The mid BWE coder 2314 may provide the coded mid BWE signal 2373 to the BWE spatial balancer 2312. The BWE spatial balancer 2312 may generate parameters (e.g., one or more gain parameters, spectral adjustment parameters, other parameters, or a combination thereof) based on the coded mid BWE signal 2373, a left HB signal 2396 (e.g., a high-band portion of a left channel signal), a right HB signal 2398 (e.g., a high-band portion of a right channel signal), or a combination thereof.

The LB signal regenerator 2316 may generate a LB side signal 2362 based on the side channel signal 2372. For example, the LB signal regenerator 2316 may generate the LB side signal 2362 by filtering the side channel signal 2372. The LB signal regenerator 2316 may provide the LB side signal 2362 to the LB side core coder 2318.

Thus, the system 2300 of FIG. 23 generates encoded signals (e.g., output signals generated at the LB side core coder 2318, the LB mid core coder 2320, the mid BWE coder 2314, the BWE spatial balancer 2312, or a combination thereof) that are based on an adjusted target channel. Adjusting the target channel based on a difference between shift values may compensate for (or conceal) inter-frame discontinuities, which may reduce clicks or other audio sounds during playback of the encoded signals.

Figure 24:
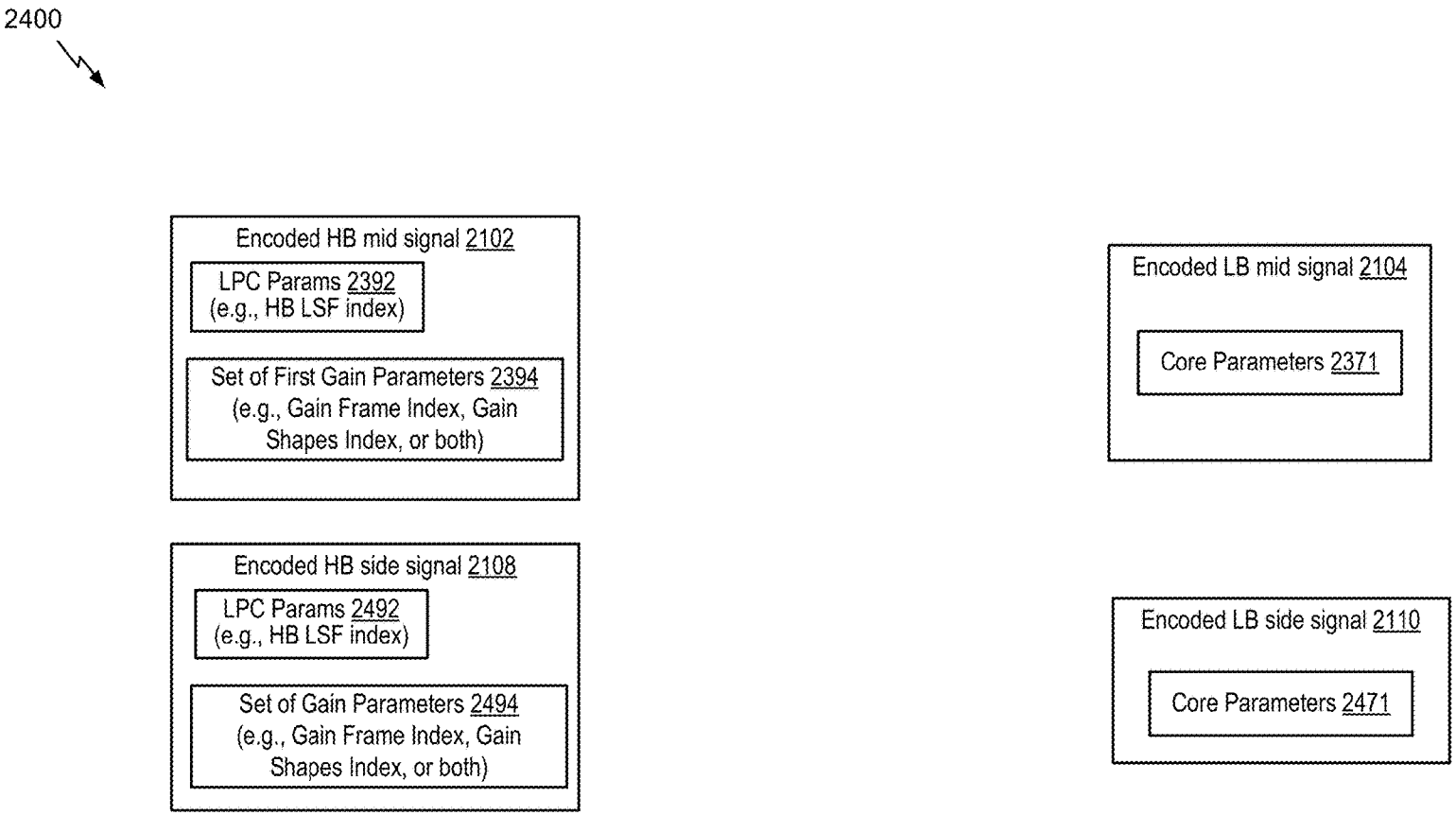
FIG. 24 illustrates different encoded signals according to the techniques described herein.

Referring to FIG. 24, a diagram 2400 illustrates different encoded signals according to the techniques described herein. For example, an encoded HB mid signal 2102, an encoded LB mid signal 2104, an encoded HB side signal 2108, and an encoded LB side signal 2110 are shown.

The encoded HB mid signal 2102 includes the LPC parameters 2392 and the set of first gain parameters 2394. The LPC parameters 2392 may indicate a high-band line spectral frequency (LSF) index. The set of first gain parameters 2394 may indicate a gain frame index, a gain shapes index, or both. The encoded HB side signal 2108 includes LPC parameters 2492 and a set of gain parameters 2494. The LPC parameters 2492 may indicate a high-band LSF index. The set of gain parameters 2494 may indicate a gain frame index, a gain shapes index, or both. The encoded LB mid signal 2104 may include core parameters 2371, and the encoded LB side signal 2110 may include core parameters 2471.

Figure 25:
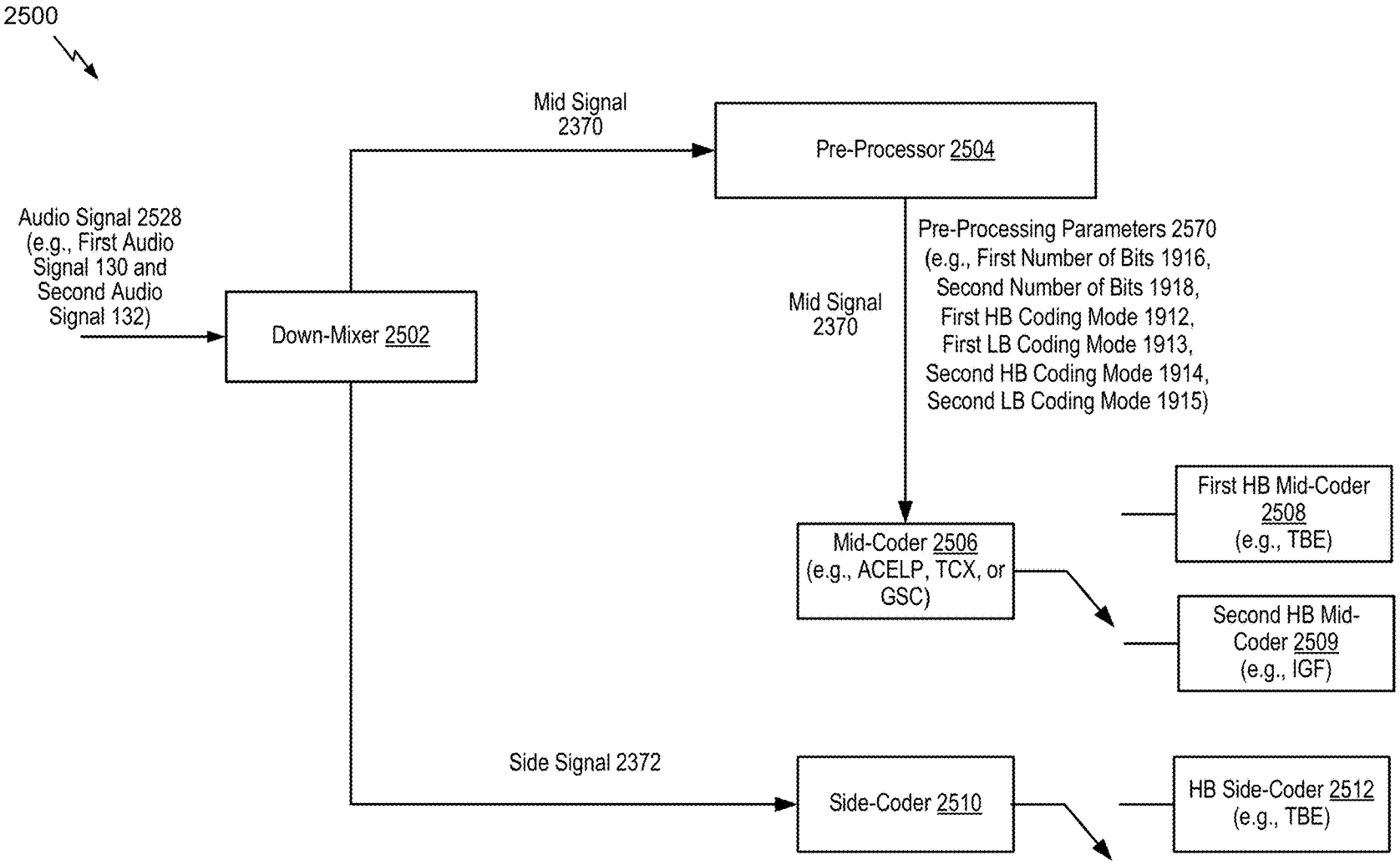
FIG. 25 is a system for encoding a signal according to the techniques described herein.

Referring to FIG. 25, a system 2500 for encoding a signal according to the techniques described herein is shown. The system 2500 includes a down-mixer 2502, a pre-processor 2504, a mid-coder 2506, a first HB mid-coder 2508, a second HB mid-coder 2509, a side-coder 2510, and HB side-coder 2512.

An audio signal 2528 may be provided to the down-mixer 2502. According to one implementation, the audio signal 2528 may include the first audio signal 130 and the second audio signal 132. The down-mixer 2502 may perform a down-mix operation to generate the mid channel signal 2370 and the side channel signal 2372. The mid channel signal 2370 may be provided to the pre-processor 2504, and the side channel signal 2372 may be provided to the side-coder 2510.

The pre-processor 2504 may generate pre-processing parameters 2570 based on the mid channel signal 2370. The pre-processing parameters 2570 may include the first number of bits 1916, the second number of bits 1918, the first HB coding mode 1912, the first LB coding mode 1913, the second HB coding mode 1914, and the second LB coding mode 1915. The mid channel signal 2370 and the pre-processing parameters 2570 may be provided to the mid-coder 2506. Based on the coding mode, the mid-coder 2506 may selectively couple to the first HB mid-coder 2508 or to the second HB mid-coder 2509. The side-coder 2510 may couple to the HB side-coder 2512.

Figure 26:
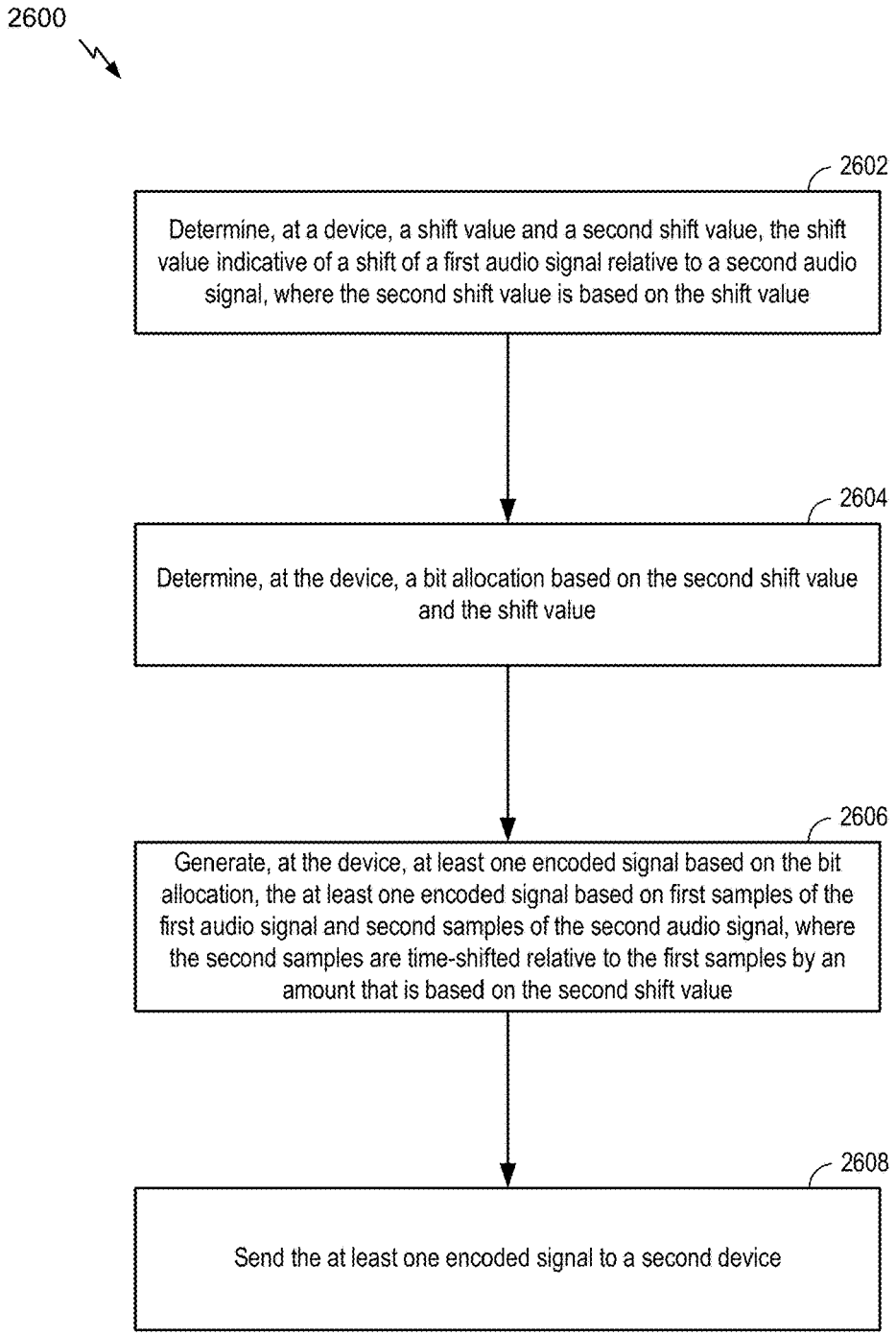
FIG. 26 is a flowchart of a method for communication.

Referring to FIG. 26, a flowchart of a method 2600 for communication is shown. The method 2600 may be performed by the first device 104 of FIGS. 1 and 19.

The method 2600 includes determining, at a device, a shift value and a second shift value, at 2602. The shift value may be indicative of a shift of a first audio signal relative to a second audio signal, and the second shift value may be based on the shift value. For example, referring to FIG. 19, the encoder 114 (or another processor at the first device 104) may determine the final shift value 116 and the amended shift value 540 according to the techniques described with respect to FIG. 5. With respect to the method 2600, the amended shift value 540 may also be referred to as the "shift value" and the final shift value 116 may also be referred to as the "second shift value". The amended shift value may be indicative of a shift (e.g., a time shift) of the first audio signal 130 captured by the first microphone 146 relative to the second audio signal 132 captured by the second microphone 148. As described with respect to FIG. 5, the final shift value 116 may be based on the amended shift value 540.

The method 2600 also includes determining, at the device, a bit allocation based on the second shift value and the shift value, at 2604. For example, referring to FIG. 19, the bit allocator 1908 may determine a bit allocation based on the final shift value 116 and the amended shift value 540. For example, the bit allocator 1908 may determine a difference between the final shift value 116 and the amended shift value 540. If the final shift value 116 is different than the amended shift value 540, additional bits may be allocated to the side signal coding as compared to a scenario where the final shift value 116 and the amended shift value 540 are similar. After allocating the additional bits to the side signal coding, the remainder of the available bits may be allocated to the mid signal coding and to the side parameters. Having a similar final shift value 116 and amended shift value 540 may substantially reduce the likelihood of sign reversals in successive frames, substantially reduce an occurrence of a large jump in the shift between the audio signals 130, 132, and/or may temporally slow-shift the target signal from frame to frame.

The method 2600 also includes generating, at the device, at least one encoded signal based on the bit allocation, at 2606. The at least one encoded signal may be based on first samples of the first audio signal and second samples of the second audio signal. The second samples may be time-shifted relative to the first samples by an amount that is based on the second shift value. For example, referring to FIG. 19, the encoder 114 may generate at least one encoded signal (e.g., the encoded signals 102) based on the bit allocation. The encoded signals 102 may include a first encoded signal and a second encoded signal. According to one implementation, the first encoded signal may correspond to a mid signal and the second encoded signal may correspond to a side signal. The encoded signals 102 may be based on first samples of the first audio signal 130 and second samples of the second audio signal 132. The second samples may be time-shifted relative to the first samples by an amount that is based on the final shift value 116 (e.g., the second shift value).

The method 2600 also includes sending the at least one encoded signal to a second device, at 2608. For example, referring to FIG. 19, the transmitter 110 may transmit the encoded signals 102 to the second device 106 via the network 120. Upon receiving the encoded signal 102, the second device 106 may operate in a substantially similar manner as described with respect to FIG. 1 to output the first output signal 126 at the first loudspeaker 142 and to output the second output signal 128 at the second loudspeaker 144.

According to one implementation, the method 2600 includes determining that the bit allocation has a first value in response to a difference between the shift value and the second shift value satisfying a threshold. The at least one encoded signal may include a first encoded signal and a second encoded signal. The first encoded signal may correspond to a mid signal and the second encoded signal may correspond to a side signal. The bit allocation may indicate that a first number of bits are allocated to the first encoded signal and that a second number of bits are allocated to the second encoded signal. The method 2600 may also include decreasing the first number of bits and increasing the second number of bits in response to a difference between the shift value and the second shift value satisfying a first threshold.

According to one implementation, the method 2600 may include generating the mid signal based on a sum of the first audio signal and the second audio signal. The method 2600 may also include generating the side signal based on a difference between the first audio signal and the second audio signal. According to one implementation of the method 2600, the first encoded signal includes a low-band mid signal and the second encoded signal includes a low-band side signal. According to another implementation of the method 2600, the first encoded signal includes a high-band mid signal and the second encoded signal includes a high-band side signal.

According to one implementation, the method 2600 includes determining a coding mode based on the shift value and the second shift value. The at least one encoded signal may be based on the coding mode. The method 2600 may also include generating a first encoded signal based on a first coding mode and generating a second encoded signal based on a second mode in response to a difference between the shift value and the second shift value satisfying a threshold. The at least one encoded signal may include the first encoded signal and the second encoded signal. According to one implementation, the first encoded signal may include a low-band mid signal, and the second encoded signal may include a low-band side signal. The first coding mode and the second coding mode may include an ACELP coding mode. According to another implementation, the first encoded signal may include a high-band mid signal, and the second encoded signal may include a high-band side signal. The first coding mode and the second coding mode may include a BWE code mode.

According to one implementation, the method 2600 includes generating an encoded low-band mid signal based on an ACELP coding mode and generating an encoded low-band side signal based on a predictive ACELP coding mode. The at least one encoded signal may include the encoded low-band mid signal and one or more parameters corresponding to the encoded low-band side signal.

According to one implementation, the method 2600 includes generating an encoded high-band mid signal based on a BWE coding mode in response to a difference between the shift value and the second shift value failing to satisfy a threshold. The method 2600 may also include generating an encoded high-band side signal based on a blind BWE coding mode in response to the difference failing to satisfy the threshold. The at least one encoded signal may include the encoded high-band mid signal and one or more parameters corresponding to the encoded high-band side signal.

The method 2600 of FIG. 6 may enable the encoder 114 to adjust (e.g., increase) the number of bits allocated to side channel coding if the final shift value 116 is different than the amended shift value 540. For example, the final shift value 116 may be restricted (by the shift change analyzer 512 of FIG. 5) to a value that is different than the amended shift value 540 to avoid sign reversal in successive frames, to avoid large shift jumps, and/or to temporally slow-shift the target signal from frame to frame to align with the reference signal. In these scenarios, the encoder 114 may increase the number of bits allocated to side channel coding to reduce artifacts.

Figure 27:
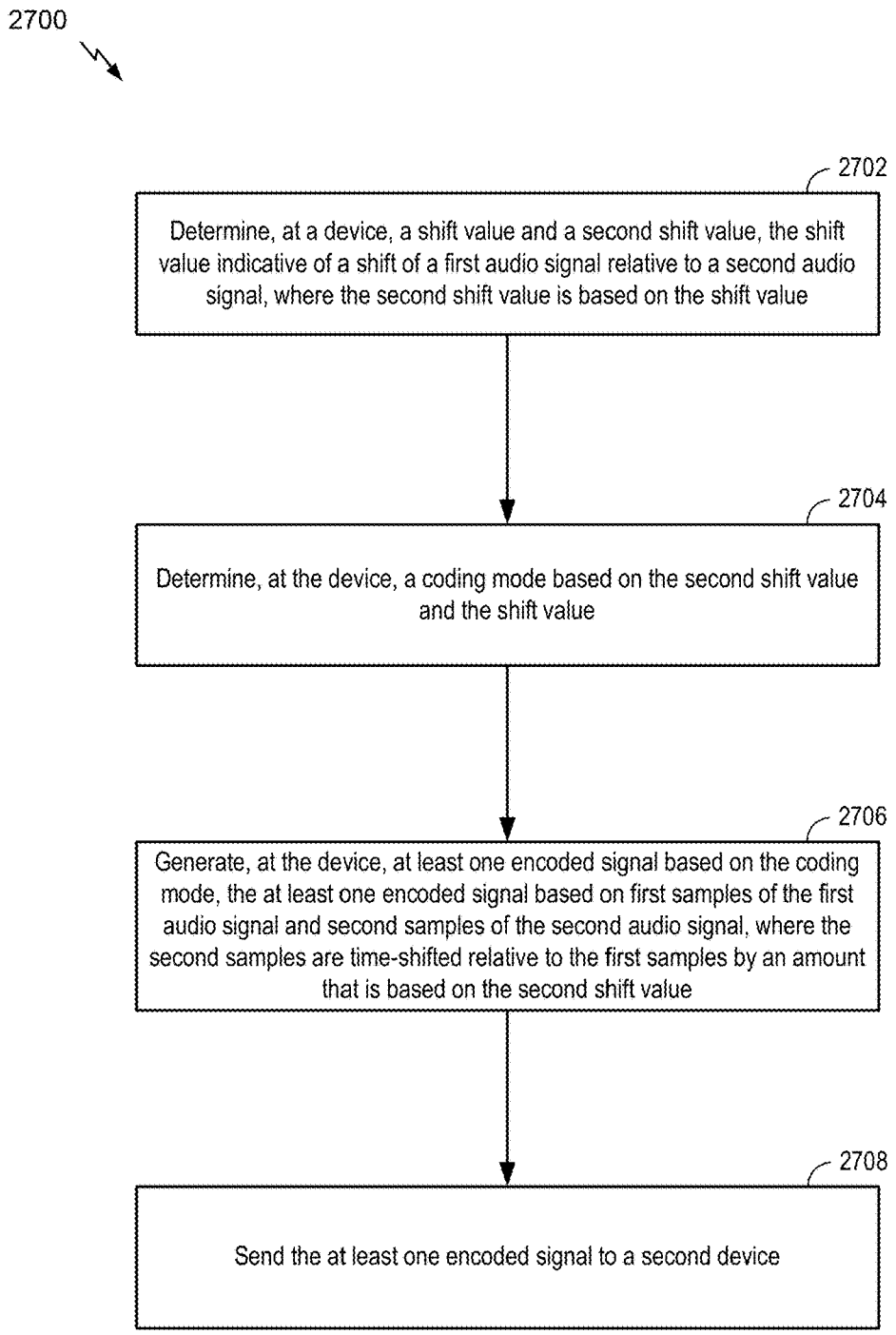
FIG. 27 is a flowchart of a method for communication.

Referring to FIG. 27, a flowchart of a method 2700 for communication is shown. The method 2700 may be performed by the first device 104 of FIGS. 1 and 19.

The method 2700 may include determining, at a device, a shift value and a second shift value, at 2702. The shift value may be indicative of a shift of a first audio signal relative to a second audio signal, and the second shift value may be based on the shift value. For example, referring to FIG. 19, the encoder 114 (or another processor at the first device 104) may determine the final shift value 116 and the amended shift value 540 according to the techniques described with respect to FIG. 5. With respect to the method 2700, the amended shift value 540 may also be referred to as the "shift value" and the final shift value 116 may also be referred to as the "second shift value". The amended shift value may be indicative of a shift (e.g., a time shift) of the first audio signal 130 captured by the first microphone 146 relative to the second audio signal 132 captured by the second microphone 148. As described with respect to FIG. 5, the final shift value 116 may be based on the amended shift value 540.

The method 2700 may also include determining, at the device, a coding mode based on the second shift value and the shift value, at 2704. The method 2700 may also include generating, at the device, at least one encoded signal based on the coding mode, at 2706. The at least one encoded signal may be based on first samples of the first audio signal and second samples of the second audio signal. The second samples may be time-shifted relative to the first samples by an amount that is based on the second shift value. For example, referring to FIG. 19, the encoder 114 may generate at least one encoded signal (e.g., the encoded signals 102) based on the coding mode. The encoded signals 102 may include a first encoded signal and a second encoded signal. According to one implementation, the first encoded signal may correspond to a mid signal and the second encoded signal may correspond to a side signal. The encoded signals 102 may be based on first samples of the first audio signal 130 and second samples of the second audio signal 132. The second samples may be time-shifted relative to the first samples by an amount that is based on the final shift value 116 (e.g., the second shift value).

The method 2700 may also include sending the at least one encoded signal to a second device, at 2708. For example, referring to FIG. 19, the transmitter 110 may transmit the encoded signals 102 to the second device 106 via the network 120. Upon receiving the encoded signal 102, the second device 106 may operate in a substantially similar manner as described with respect to FIG. 1 to output the first output signal 126 at the first loudspeaker 142 and to output the second output signal 128 at the second loudspeaker 144.

The method 2700 may also include generating a first encoded signal based on a first coding mode and generating a second encoded signal based on a second coding mode in response to a difference between the shift value and the second shift value satisfying a threshold. The at least one encoded signal may include the first encoded signal and the second encoded signal. According to one implementation, the first encoded signal may include a low-band mid signal, and the second encoded signal may include a low-band side signal. The first coding mode and the second coding mode may include an ACELP coding mode. According to another implementation, the first encoded signal may include a high-band mid signal, and the second encoded signal may include a high-band side signal. The first coding mode and the second coding mode may include a BWE coding mode.

According to one implementation, the method 2700 may also include generating an encoded low-band mid signal based on an ACELP coding mode and generating an encoded low-band side signal based on a predictive ACELP coding mode in response to a difference between the shift value and the second shift value failing to satisfy a threshold. The at least one encoded signal may include the encoded low-band mid signal and one or more parameters corresponding to the encoded low-band side signal.

According to another implementation, the method 2700 may also include generating an encoded high-band mid signal based on a BWE coding mode and generating an encoded high-band side signal based on a blind BWE coding mode in response to a difference between the shift value and the second shift value failing to satisfy a threshold. The at least one encoded signal may include the encoded high-band mid signal and one or more parameters corresponding to the encoded high-band side signal.

According to one implementation, in response to a difference between the shift value and the second shift value satisfying a first threshold and failing to satisfy a second threshold, the method 2700 may include generating an encoded low-band mid signal and an encoded low-band side signal based on an ACELP coding mode. The method 2700 may also include generating an encoded high-band signal based on a BWE coding mode and generating an encoded high-band side signal based on a blind BWE coding mode. The at least one encoded signal may include the encoded high-band mid signal, the encoded low-band mid signal, the encoded low-band side signal, and one or more parameters corresponding to the encoded high-band side signal.

According to one implementation, the method 2700 may include determining a bit allocation based on the second shift value and the shift value. The at least one encoded signal may be generated based on the bit allocation. The at least one encoded signal may include a first encoded signal and a second encoded signal. The bit allocation may indicate that a first number of bits are allocated to the first encoded signal and that a second number of bits are allocated to the second encoded signal. The method 2700 may also include decreasing the first number of bits and increasing the second number of bits in response to a difference between the shift value and the second shift value satisfying a first threshold.

Figure 28:
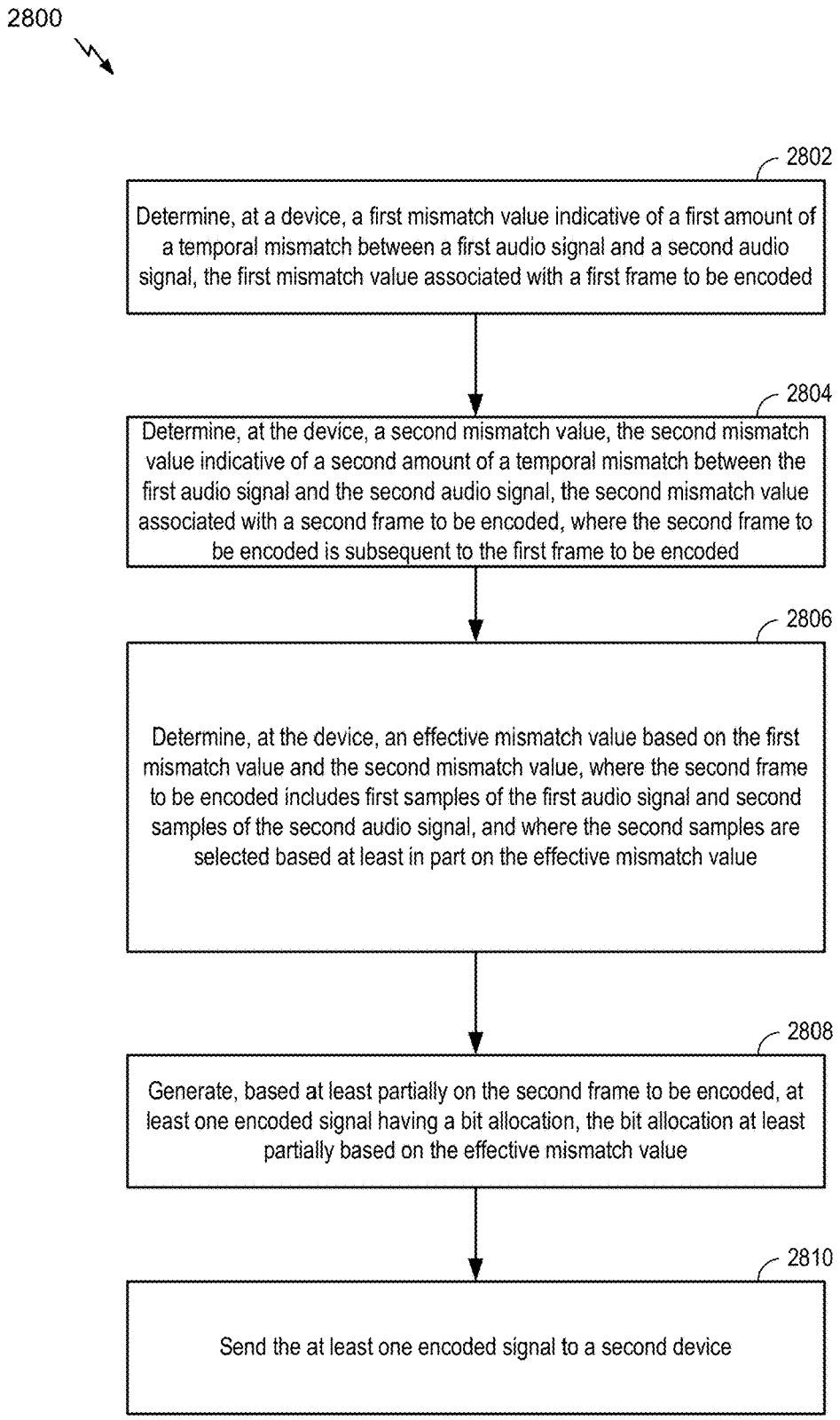
FIG. 28 is a flowchart of a method for communication.

Referring to FIG. 28, a flowchart of a method 2800 for communication is shown. The method 2800 may be performed by the first device 104 of FIGS. 1 and 19.

The method 2800 includes determining, at a device, a first mismatch value indicative of a first amount of a temporal mismatch between a first audio signal and a second audio signal, at 2802. For example, referring to FIG. 9, the encoder 114 (or another processor at the first device 104) may determine the first shift value 962, as described with reference to FIG. 9. With respect to the method 2800, the first shift value 962 may also be referred to as the "first mismatch value." The first shift value 962 may be indicative of a first amount of a temporal mismatch between the first audio signal 130 and the second audio signal 132, as described with reference to FIG. 9. The first shift value 962 may be associated with a first frame to be encoded. For example, the first frame to be encoded may include samples 322-324 of the frame 302 of FIG. 3 and particular samples of the second audio signal 132. The particular samples may be selected based on the first shift value 962, as described with reference to FIG. 1.

The method 2800 also includes determining, at the device, a second mismatch value, the second mismatch value indicative of a second amount of a temporal mismatch between the first audio signal and the second audio signal, at 2804. For example, the encoder 114 (or another processor at the first device 104) may determine the tentative shift value 536, the interpolated shift value 538, the amended shift value 540, or a combination thereof, as described with reference to FIG. 5. With respect to the method 2800, the tentative shift value 536, the interpolated shift value 538, or the amended shift value 540 may also be referred to as the "second mismatch value." One or more of the tentative shift value 536, the interpolated shift value 538, or the amended shift value 540 may be indicative of a second amount of temporal mismatch between the first audio signal 130 and the second audio signal 132. The second mismatch value may be associated with a second frame to be encoded. For example, the second frame to be encoded may include the samples 326-332 of the first audio signal 130 and the samples 354-360 of the second audio signal 132, as described with reference to FIG. 4. As another example, the second frame to be encoded may include the samples 326-332 of the first audio signal 130 and the samples 358-364 of the second audio signal 132, as described with reference to FIG. 3.

The second frame to be encoded may be subsequent to the first frame to be encoded. For example, at least some samples associated with the second frame to be encoded may be subsequent to at least some samples associated with the first frame to be encoded in the first samples 320 of the first audio signal 130 or in the second samples 350 of the second audio signal 132. In a particular aspect, the samples 326-332 of the second frame to be encoded may be subsequent to the samples 322-324 of the first frame to be encoded in the first samples 320 of the first audio signal 130. To illustrate, each of the samples 326-332 may be associated with a timestamp indicating a later time than indicated by a timestamp associated with any of the samples 322-324. In some aspects, the samples 354-360 (or the samples 358-364) of the second frame to be encoded may be subsequent to the particular samples of the first frame to be encoded in the second samples 350 of the second audio signal 132.

The method 2800 further includes determining, at the device, an effective mismatch value based on the first mismatch value and the second mismatch value, at 2806. For example, the encoder 114 (or another processor at the first device 104) may determine the amended shift value 540, the final shift value 116, or both, according to the techniques described with respect to FIG. 5. With respect to the method 2800, the amended shift value 540 or the final shift value 116 may also be referred to as the "effective mismatch value." The encoder 114 may identify one of the first shift value 962 or the second mismatch value as a first value. For example, the encoder 114 may, in response to determining that the first shift value 962 is less than or equal to the second mismatch value, identify the first shift value 962 as the first value. The encoder 114 may identify the other of the first shift value 962 or the second mismatch value as a second value.

The encoder 114 (or another processor at the first device 104) may generate the effective mismatch value to be greater than or equal to the first value and less than or equal to the second value. For example, the encoder 114 may generate the final shift value 116 to equal a particular value (e.g., 0) that indicates no time shift in response to determining that the first shift value 962 is greater than 0 and the amended shift value 540 is less than 0 or that the first shift value 962 is less than 0 and the amended shift value 540 is greater than 0, as described with reference to FIGS. 10A and 10B. In this example, the final shift value 116 may be referred to as the "effective mismatch value" and the amended shift value 540 may be referred to as the "second mismatch value."

As another example, the encoder 114 may generate the final shift value 116 to equal the estimated shift value 1072, as described with reference to FIGS. 10A and 11. The estimated shift value 1072 may greater than or equal to a difference between the amended shift value 540 and a first offset and less than or equal to a sum of the first shift value 962 and the first offset. Alternatively, the estimated shift value 1072 may be greater than or equal to a difference between the first shift value 962 and a second offset and less than or equal to a sum of the amended shift value 540 and the second offset, as described with reference to FIG. 11. In this example, the final shift value 116 may be referred to as the "effective mismatch value" and the amended shift value 540 may be referred to as the "second mismatch value."

In a particular aspect, the encoder 114 may generate the amended shift value 540 to be greater than or equal to the lower shift value 930 and less than or equal to the greater shift value 932, as described with reference to FIG. 9. The lower shift value 930 may be based on the lower one of the first shift value 962 or the interpolated shift value 538. The greater shift value 932 may be based on the other one of the first shift value 962 or the interpolated shift value 538. In this aspect, the interpolated shift value 538 may be referred to as the "second mismatch value" and the amended shift value 540 or the final shift value 116 may be referred to as the "effective mismatch value." The samples 358-364 (or the samples 354-360) of the second samples 350 may be selected based at least in part on the effective mismatch value, as described with reference to FIGS. 1 and 3-5.

The method 2800 also includes generating, based at least partially on the second frame to be encoded, at least one encoded signal having a bit allocation. For example, the encoder 114 (or another processor at the first device 104) may generate the encoded signals 102 based on the second frame to be encoded, as described with reference to FIG. 1. To illustrate, the encoder 114 may generate the encoded signals 102 by encoding the samples 326-332 and the samples 354-360, as described with reference to FIGS. 1 and 4. In an alternate aspect, the encoder 114 may generate the encoded signals 102 by encoding the samples 326-332 and the samples 358-364, as described with reference to FIGS. 1 and 3.

The encoded signals 102 may have a bit allocation, as described with reference to FIG. 9. For example, the bit allocation may indicate that the first number of bits 1916 is allocated to a first encoded signal (e.g., a mid signal), that the second number of bits 1918 is allocated to a second encoded signal (e.g., a side signal), or both. The encoder 114 (or another processor at the first device 104) may generate the first encoded signal (e.g., the mid signal) to have a first bit allocation corresponding to the first number of bits 1916, the second encoded signal (e.g., the side signal) to have a second bit allocation corresponding to the second number of bits 1918, or both, as described with reference to FIG. 9.

The method 2800 further includes sending the at least one encoded signal to a second device, at 2810. For example, referring to FIG. 19, the transmitter 110 may transmit the encoded signals 102 to the second device 106 via the network 120. Upon receiving the encoded signal 102, the second device 106 may operate in a substantially similar manner as described with respect to FIG. 1 to output the first output signal 126 at the first loudspeaker 142 and to output the second output signal 128 at the second loudspeaker 144.

The method 2800 may also include generating a first bit allocation associated with the first frame to be encoded, as described with reference to FIG. 19. The first bit allocation may indicate that a second number of bits are allocated to a first encoded side signal. The bit allocation associated with the second frame to be encoded may indicate that a particular number is allocated to encoding the encoded signals 102. The particular number may be greater than, less than, or equal to the second number. For example, the encoder 114 may generate one or more first encoded signals having a first bit allocation based on the first number of bits 1916, the second number of bits 1918, or both, as described with reference to FIG. 1. The encoder 114 may generate the first encoded signals by encoding the samples 322-324 and selected samples of the second samples 350, as describe with reference to FIG. 3. The encoder 114 may update the first number of bits 1916, the second number of bits 1918, or both, as described with reference to FIG. 20. The encoder 114 may generate the encoded signals 102 having the bit allocation corresponding to the updated first number of bits 1916, the updated second number of bits 1918, or both, as described with reference to FIG. 20.

The method 2800 may further include determining the comparison values 534 of FIG. 5, the comparison values 915, the comparison values 916 of FIG. 9, the comparison values 1140 of FIG. 11, comparison values corresponding to the graph 1502, comparison values corresponding to the graph 1504, the comparison values corresponding to the graph 1506 of FIG. 15, or a combination thereof. For example, the encoder 114 may determine comparison values based on a comparison of the samples 326-332 of the first audio signal 130 to multiple sets of samples of the second audio signal 132, as described with reference to FIGS. 3-4. Each set of the multiple sets of samples may correspond to a particular mismatch value from a particular search range. For example, the particular search range may be greater than or equal to the lower shift value 930 and less than or equal to the greater shift value 932, as described with reference to FIG. 9. As another example, the particular search range may be greater than or equal to the first shift value 1130 and less than or equal to the second shift value 1132, as described with reference to FIG. 9. The interpolated comparison value 838, the amended shift value 540, the final shift value 116, or a combination thereof, may be based on comparison values, as described with reference to FIGS. 8, 9A, 9B, 10A, and 11.

The method 2800 may also include determining boundary comparison values of the comparison values, as described with reference to FIG. 17. For example, the encoder 114 may determine comparison values at the right boundary (e.g., 20 samples shift/mismatch), comparison values at the left boundary (−20 samples shift/mismatch), or both, as described with reference to FIG. 18. The boundary comparison values may correspond to mismatch values that are within a threshold (e.g., 10 samples) of a boundary mismatch value (e.g., −20 or 20) of the particular search range. The encoder 114 may identify the second frame to be encoded as indicative of a monotonic trend in response to determining that the boundary comparison values are monotonically increasing or monotonically decreasing, as described with reference to FIG. 17.

The encoder 114 may determine that a particular number of frames to be encoded (e.g., three frames) that are prior to the second frame to be encoded are identified as indicative of a monotonic trend, as described with reference to FIGS. 17-18. The encoder 114 may, in response to determining that the particular number is greater than a threshold, determine a particular search range (e.g., −23 to 23) corresponding to the second frame to be encoded, as described with reference to FIGS. 17-18. The particular search range including a second boundary mismatch (e.g., −23) value that is beyond a first boundary mismatch value (e.g., −20) of a first search range (e.g., −20 to 20) corresponding to the first frame to be encoded. The encoder 114 may generate comparison values based on the particular search range, as described with reference to FIG. 18. The second mismatch value may be based on the comparison values.

The method 2800 may further include determining a coding mode based at least in part on the effective mismatch value. For example, the encoder 114 may determine the first LB coding mode 1913, the second LB coding mode 1915, the first HB coding mode 1912, the second HB coding mode 1914, or a combination thereof, as described with reference to FIG. 19. The encoded signals 102 may be based on the first LB coding mode 1913, the second LB coding mode 1915, the first HB coding mode 1912, the second HB coding mode 1914, or a combination thereof, as described with reference to FIG. 19. According to a particular implementation, the encoder 114 may generate an encoded HB mid signal based on the first HB coding mode 1912, an encoded HB side signal based on the second HB coding mode 1914, an encoded LB mid signal based on the first LB coding mode 1913, an encoded LB side signal based on the second LB coding mode 1915, or a combination thereof, as described with reference to FIG. 19.

According to some implementations, the first HB coding mode 1912 may include a BWE coding mode, and the second HB coding mode 1914 may include a blind BWE coding mode, as described with reference to FIG. 21. The encoded signals 102 may include the encoded HB mid signal, and one or more parameters corresponding to the encoded HB side signal.

According to some implementations, the first HB coding mode 1912 may include a BWE coding mode, and the second HB coding mode 1914 may include a BWE coding mode, as described with reference to FIG. 21. The encoded signals 102 may include the encoded HB mid signal, and one or more parameters corresponding to the encoded HB side signal.

According to some implementations, the first LB coding mode 1913 may include an ACELP coding mode, the second LB coding mode 1915 may include an ACELP coding mode, the first HB coding mode 1912 may include a BWE coding mode, the second HB coding mode 1914 may include a blind BWE coding mode, or a combination thereof, as described with reference to FIG. 21. The encoded signals 102 may include the encoded HB mid signal, the encoded LB mid signal, the encoded LB side signal, and one or more parameters corresponding to the encoded HB side signal.

According to some implementations, the first LB coding mode 1913 may include an ACELP coding mode, the second LB coding mode 1915 may include a predictive ACELP coding mode, or both, as described with reference to FIG. 21. The encoded signals 102 may include the encoded LB mid signal, and one or more parameters corresponding to the encoded LB side signal.

Figure 29:
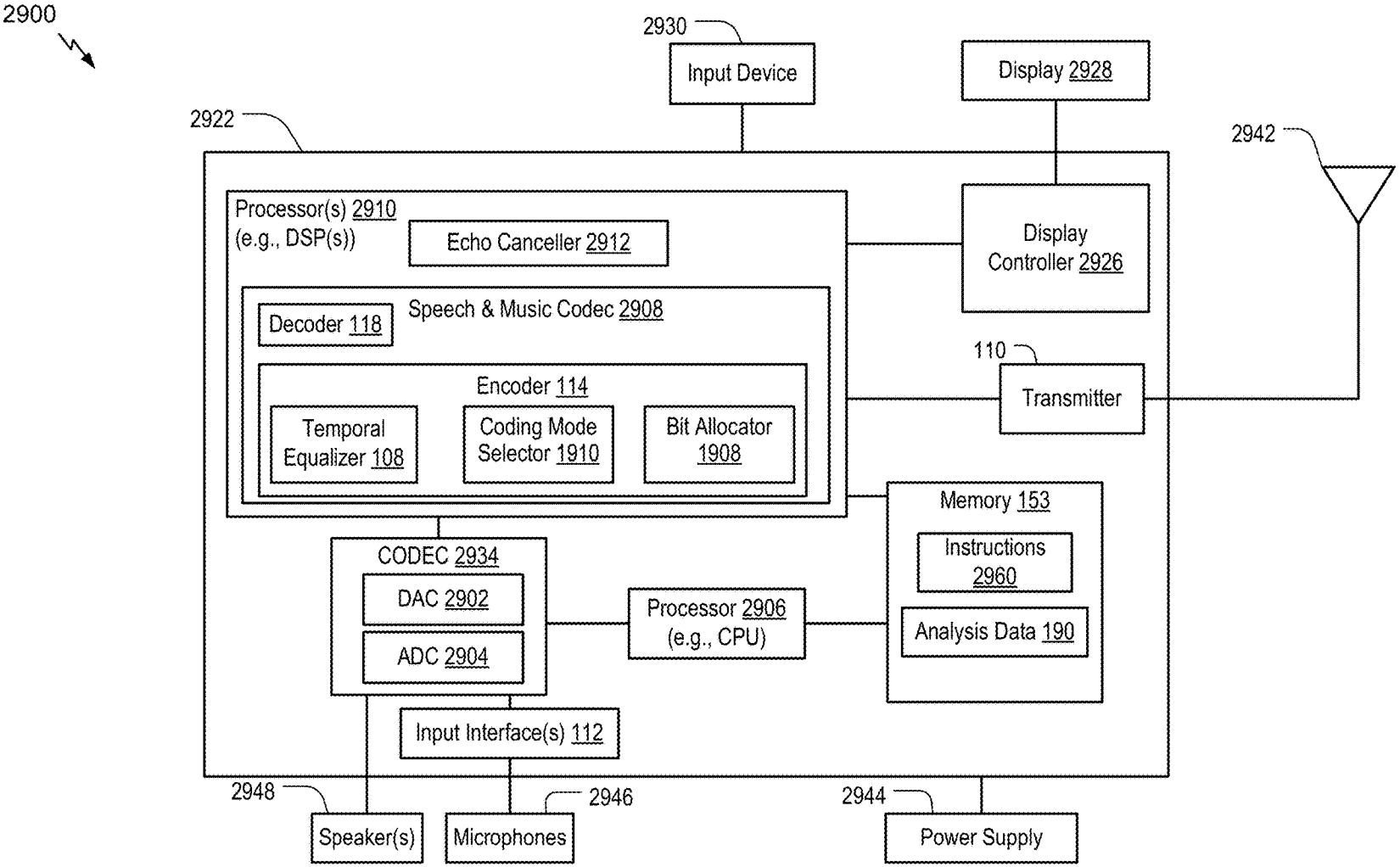
FIG. 29 is a block diagram of a particular illustrative example of a device that is operable to encode multiple audio signals.

Referring to FIG. 29, a block diagram of a particular illustrative example of a device (e.g., a wireless communication device) is depicted and generally designated 2900. In various implementations, the device 2900 may have fewer or more components than illustrated in FIG. 29. In an illustrative implementation, the device 2900 may correspond to the first device 104 or the second device 106 of FIG. 1. In an illustrative implementation, the device 2900 may perform one or more operations described with reference to systems and methods of FIGS. 1-28.

In a particular implementation, the device 2900 includes a processor 2906 (e.g., a central processing unit (CPU)). The device 2900 may include one or more additional processors 2910 (e.g., one or more digital signal processors (DSPs)). The processors 2910 may include a media (e.g., speech and music) coder-decoder (CODEC) 2908, and an echo canceller 2912. The media CODEC 2908 may include the decoder 118, the encoder 114, or both, of FIG. 1. The encoder 114 may include the temporal equalizer 108, the bit allocator 1908, and the coding mode selector 1910.

The device 2900 may include a memory 153 and a CODEC 2934. Although the media CODEC 2908 is illustrated as a component of the processors 2910 (e.g., dedicated circuitry and/or executable programming code), in other implementations one or more components of the media CODEC 2908, such as the decoder 118, the encoder 114, or both, may be included in the processor 2906, the CODEC 2934, another processing component, or a combination thereof.

The device 2900 may include the transmitter 110 coupled to an antenna 2942. The device 2900 may include a display 2928 coupled to a display controller 2926. One or more speakers 2948 may be coupled to the CODEC 2934. One or more microphones 2946 may be coupled, via the input interface(s) 112, to the CODEC 2934. In a particular implementation, the speakers 2948 may include the first loudspeaker 142, the second loudspeaker 144 of FIG. 1, the Yth loudspeaker 244 of FIG. 2, or a combination thereof. In a particular implementation, the microphones 2946 may include the first microphone 146, the second microphone 148 of FIG. 1, the Nth microphone 248 of FIG. 2, the third microphone 1146, the fourth microphone 1148 of FIG. 11, or a combination thereof. The CODEC 2934 may include a digital-to-analog converter (DAC) 2902 and an analog-to-digital converter (ADC) 2904.

The memory 153 may include instructions 2960 executable by the processor 2906, the processors 2910, the CODEC 2934, another processing unit of the device 2900, or a combination thereof, to perform one or more operations described with reference to FIGS. 1-28. The memory 153 may store the analysis data 190.

One or more components of the device 2900 may be implemented via dedicated hardware (e.g., circuitry), by a processor executing instructions to perform one or more tasks, or a combination thereof. As an example, the memory 153 or one or more components of the processor 2906, the processors 2910, and/or the CODEC 2934 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 2960) that, when executed by a computer (e.g., a processor in the CODEC 2934, the processor 2906, and/or the processors 2910), may cause the computer to perform one or more operations described with reference to FIGS. 1-28. As an example, the memory 153 or the one or more components of the processor 2906, the processors 2910, and/or the CODEC 2934 may be a non-transitory computer-readable medium that includes instructions (e.g., the instructions 2960) that, when executed by a computer (e.g., a processor in the CODEC 2934, the processor 2906, and/or the processors 2910), cause the computer perform one or more operations described with reference to FIGS. 1-28.

In a particular implementation, the device 2900 may be included in a system-in-package or system-on-chip device (e.g., a mobile station modem (MSM)) 2922. In a particular implementation, the processor 2906, the processors 2910, the display controller 2926, the memory 153, the CODEC 2934, and the transmitter 110 are included in a system-in-package or the system-on-chip device 2922. In a particular implementation, an input device 2930, such as a touchscreen and/or keypad, and a power supply 2944 are coupled to the system-on-chip device 2922. Moreover, in a particular implementation, as illustrated in FIG. 29, the display 2928, the input device 2930, the speakers 2948, the microphones 2946, the antenna 2942, and the power supply 2944 are external to the system-on-chip device 2922. However, each of the display 2928, the input device 2930, the speakers 2948, the microphones 2946, the antenna 2942, and the power supply 2944 can be coupled to a component of the system-on-chip device 2922, such as an interface or a controller.

The device 2900 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, a base station, a vehicle, or any combination thereof.

In a particular implementation, one or more components of the systems described herein and the device 2900 may be integrated into a decoding system or apparatus (e.g., an electronic device, a CODEC, or a processor therein), into an encoding system or apparatus, or both. In other implementations, one or more components of the systems described herein and the device 2900 may be integrated into a wireless communication device (e.g., a wireless telephone), a tablet computer, a desktop computer, a laptop computer, a set top box, a music player, a video player, an entertainment unit, a television, a game console, a navigation device, a communication device, a personal digital assistant (PDA), a fixed location data unit, a personal media player, a base station, a vehicle, or another type of device.

It should be noted that various functions performed by the one or more components of the systems described herein and the device 2900 are described as being performed by certain components or modules. This division of components and modules is for illustration only. In an alternate implementation, a function performed by a particular component or module may be divided amongst multiple components or modules. Moreover, in an alternate implementation, two or more components or modules of the systems described herein may be integrated into a single component or module. Each component or module illustrated in systems described herein may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described implementations, an apparatus includes means for determining a bit allocation based on a shift value and a second shift value. The shift value may be indicative of a shift of a first audio signal relative to a second audio signal, and the second shift value may be based on the shift value. For example, the means for determining the bit allocation may include the bit allocator 1908 of FIG. 19, one or more devices/circuits configured to determine the bit allocation (e.g., a processor executing instructions that are stored at a computer-readable storage device), or a combination thereof.

The apparatus may also include means for transmitting at least one encoded signal that is generated based on the bit allocation. The at least one encoded signal may be based on first samples of the first audio signal and second samples of the second audio signal, and the second samples may be time-shifted relative to the first samples by an amount that is based on the second shift value. For example, the means for transmitting may include the transmitter 110 of FIGS. 1 and 19.

Also in conjunction with the described implementations, an apparatus includes means for determining a first mismatch value indicative of a first amount of temporal mismatch between a first audio signal and a second audio signal. The first mismatch value is associated with a first frame to be encoded. For example, the means for determining the first mismatch value may include the encoder 114, the temporal equalizer 108 of FIG. 1, the temporal equalizer(s) 208 of FIG. 2, the signal comparator 506, the interpolator 510, the shift refiner 511, the shift change analyzer 512, the absolute shift generator 513 of FIG. 5, the processors 2910, the CODEC 2934, the processor 2906, one or more devices/circuits configured to determine the first mismatch value (e.g., a processor executing instructions that are stored at a computer-readable storage device), or a combination thereof.

The apparatus also includes means for determining a second mismatch value indicative of a second amount of temporal mismatch between the first audio signal and the second audio signal. The second mismatch value is associated with a second frame to be encoded. The second frame to be encoded is subsequent to the first frame to be encoded. For example, the means for determining the second mismatch value may include the encoder 114, the temporal equalizer 108 of FIG. 1, the temporal equalizer(s) 208 of FIG. 2, the signal comparator 506, the interpolator 510, the shift refiner 511, the shift change analyzer 512, the absolute shift generator 513 of FIG. 5, the processors 2910, the CODEC 2934, the processor 2906, one or more devices/circuits configured to determine the second mismatch value (e.g., a processor executing instructions that are stored at a computer-readable storage device), or a combination thereof.

The apparatus further includes means for determining an effective mismatch value based on the first mismatch value and the second mismatch value. The second frame to be encoded includes first samples of the first audio signal and second samples of the second audio signal. The second samples are selected based at least in part on the effective mismatch value. For example, the means for determining the effective mismatch value may include the encoder 114, the temporal equalizer 108 of FIG. 1, the temporal equalizer(s) 208 of FIG. 2, the signal comparator 506, the interpolator 510, the shift refiner 511, the shift change analyzer 512, the processors 2910, the CODEC 2934, the processor 2906, one or more devices/circuits configured to determine the effective mismatch value (e.g., a processor executing instructions that are stored at a computer-readable storage device), or a combination thereof.

The apparatus also includes means for transmitting at least one encoded signal having a bit allocation that is at least partially based on the effective mismatch value. The at least one encoded signal is generated based at least partially on the second frame to be encoded. For example, the means for transmitting may include the transmitter 110 of FIGS. 1 and 19.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device for communication comprising:

a processor configured to:

determine a first mismatch value indicative of a first amount of a temporal mismatch between a first audio signal and a second audio signal, the first mismatch value associated with a first frame to be encoded;

determine a second mismatch value indicative of a second amount of a temporal mismatch between the first audio signal and the second audio signal, the second mismatch value associated with a second frame to be encoded, wherein the second frame to be encoded is subsequent to the first frame to be encoded;

determine an effective mismatch value based on the first mismatch value and the second mismatch value, wherein the second frame to be encoded includes first samples of the first audio signal and second samples of the second audio signal, and wherein the second samples are selected based at least in part on the effective mismatch value;

select, based at least in part on the effective mismatch value, a first coding mode and a second coding mode; and generate, based at least partially on the second frame to be encoded, at least one encoded signal having a bit allocation, the bit allocation at least partially based on the effective mismatch value, wherein the at least one encoded signal is based on a first encoded signal and a second encoded signal, wherein the first encoded signal is based on the first coding mode, and wherein the second encoded signal is based on the second coding mode; and a transmitter configured to transmit the at least one encoded signal to a second device.

2. The device of claim 1, wherein the effective mismatch value is greater than or equal to a first value and less than or equal to a second value, wherein the first value equals one of the first mismatch value or the second mismatch value, wherein the second value equals the other of the first mismatch value or the second mismatch value.

3. The device of claim 1, wherein the processor is further configured to determine the effective mismatch value based on a variation between the first mismatch value and the second mismatch value.

4. The device of claim 1, wherein the at least one encoded signal includes the first encoded signal and the second encoded signal, wherein the first encoded signal includes an encoded mid signal, wherein the second encoded signal includes an encoded side signal, and wherein the bit allocation indicates that a first number of bits are allocated to the encoded mid signal and that a second number of bits are allocated to the encoded side signal.

5. The device of claim 1, wherein the processor is further configured to generate, based on the first frame to be encoded, at least a first particular encoded signal having a first bit allocation, and wherein the transmitter is further configured to transmit at least the first particular encoded signal.

6. The device of claim 1, wherein, based on a variation between the first mismatch value and the second mismatch value, the bit allocation is distinct from a first bit allocation associated with the first frame to be encoded.

7. The device of claim 1, wherein a particular number of bits are available for signal encoding, wherein a first bit allocation associated with the first frame to be encoded indicates a first ratio, and wherein the bit allocation indicates a second ratio.

8. The device of claim 1, wherein the at least one encoded signal includes the first encoded signal, wherein the processor is further configured to generate the bit allocation to indicate that a particular number of bits are allocated to the first encoded signal, wherein the first encoded signal includes an encoded mid signal, wherein a first bit allocation associated with the first frame to be encoded indicates that a first number of bits are allocated to a first encoded mid signal, and wherein the particular number is less than the first number.

9. The device of claim 1, wherein the at least one encoded signal includes the second encoded signal, wherein the processor is further configured to generate the bit allocation to indicate that a particular number of bits are allocated to the second encoded signal, wherein the second encoded signal includes an encoded side signal, wherein a first bit allocation associated with the first frame to be encoded indicates a second number of bits are allocated to a first encoded side signal, and wherein the particular number is greater than the second number.

10. The device of claim 1, wherein the processor is further configured to:

determine a variation value based on the second mismatch value and the effective mismatch value; and in response to determining that the variation value is greater than a first threshold, generate the bit allocation to indicate a first number of bits and a second number of bits, wherein the bit allocation indicates that the first number of bits are allocated to an encoded mid signal and that the second number of bits are allocated to an encoded side signal, wherein the first encoded signal includes the encoded mid signal and the second encoded signal includes the encoded side signal, and wherein the at least one encoded signal includes the first encoded signal and the second encoded signal.

11. The device of claim 10, wherein the processor is further configured to, in response to determining that the variation value is less than or equal to the first threshold and less than a second threshold, generate the bit allocation to indicate a third number of bits and a fourth number of bits, wherein the bit allocation indicates that the third number of bits are allocated to the encoded mid signal and that the fourth number of bits are allocated to the encoded side signal, wherein the third number of bits is greater than the first number of bits, wherein the fourth number of bits is less than the second number of bits, wherein the first encoded signal includes the encoded mid signal, and wherein the second encoded signal includes the encoded side signal.

12. The device of claim 1, wherein the processor is further configured to determine comparison values based on a comparison of first samples of the first audio signal to multiple sets of samples of the second audio signal, wherein each set of the multiple sets of samples corresponds to a particular mismatch value from a particular search range, and wherein the second mismatch value is based on the comparison values.

13. The device of claim 12, wherein the processor is further configured to:

determine boundary comparison values of the comparison values, the boundary comparison values corresponding to mismatch values that are within a threshold of a boundary mismatch value of the particular search range; and identify the second frame to be encoded as indicative of a monotonic trend in response to determining that the boundary comparison values are monotonically increasing.

14. The device of claim 12, wherein the processor is further configured to:

determine boundary comparison values of the comparison values, the boundary comparison values corresponding to mismatch values that are within a threshold of a boundary mismatch value of the particular search range; and identify the second frame to be encoded as indicative of a monotonic trend in response to determining that the boundary comparison values are monotonically decreasing.

15. The device of claim 1, wherein the processor is further configured to:

determine that a particular number of frames to be encoded that are prior to the second frame to be encoded are identified as indicative of a monotonic trend;

in response to determining that the particular number is greater than a threshold, determine a particular search range corresponding to the second frame to be encoded, the particular search range including a second boundary mismatch value that is beyond a first boundary mismatch value of a first search range corresponding to the first frame to be encoded; and generate comparison values based on the particular search range, wherein the second mismatch value is based on the comparison values.

16. The device of claim 1, wherein the processor is further configured to:

generate a mid signal based on a sum of the first samples of the first audio signal and the second samples of the second audio signal; and generate an encoded mid signal by encoding the mid signal based on the bit allocation, wherein the first encoded signal includes the encoded mid signal, and wherein the at least one encoded signal includes the first encoded signal.

17. The device of claim 1, wherein the processor is further configured to:

generate a side signal based on a difference between the first samples of the first audio signal and the second samples of the second audio signal; and generate an encoded side signal by encoding the side signal based on the bit allocation, wherein the second encoded signal includes the encoded side signal, and wherein the at least one encoded signal includes the second encoded signal.

18. The device of claim 1, wherein the at least one encoded signal includes the first encoded signal and the second encoded signal, and wherein the processor is further configured to generate the at least one encoded signal by:

generating, based on the first coding mode, the first encoded signal based on first samples of the first audio signal and second samples of the second audio signal, wherein the second samples are selected based on the effective mismatch value; and generating, based on the second coding mode, the second encoded signal based on the first samples and the second samples.

19. The device of claim 1, wherein the first encoded signal includes a low-band mid signal, wherein the second encoded signal includes a low-band side signal, and wherein the first coding mode and the second coding mode include an algebraic code-excited linear prediction (ACELP) coding mode.

20. The device of claim 1, wherein the first encoded signal includes a high-band mid signal, wherein the second encoded signal includes a high-band side signal, and wherein the first coding mode and the second coding mode include a bandwidth extension (BWE) coding mode.

21. The device of claim 1, wherein the processor is further configured to:

generate, based at least in part on the effective mismatch value, an encoded low-band mid signal based on an algebraic code-excited linear prediction (ACELP) coding mode, wherein the first encoded signal includes the encoded low-band mid signal; and generate, based at least in part on the effective mismatch value, an encoded low-band side signal based on a predictive ACELP coding mode, wherein the second encoded signal includes the encoded low-band side signal, wherein the at least one encoded signal includes the first encoded signal and one or more parameters corresponding to the second encoded signal.

22. The device of claim 1, wherein the processor is further configured to:

generate, based at least in part on the effective mismatch value, an encoded high-band mid signal based on a bandwidth extension (BWE) coding mode, wherein the first encoded signal includes the encoded high-band mid signal; and generate, based at least in part on the effective mismatch value, an encoded high-band side signal based on a blind BWE coding mode, wherein the second encoded signal includes the encoded high-band side signal, wherein the at least one encoded signal includes the first encoded signal and one or more parameters corresponding to the second encoded signal.

23. The device of claim 1, further comprising an antenna coupled to the transmitter, wherein the transmitter is configured to transmit the at least one encoded signal via the antenna.

24. The device of claim 1, wherein the processor and the transmitter are integrated into a mobile communication device.

25. The device of claim 1, wherein the processor and the transmitter are integrated into a base station.

26. A method of communication comprising:

determining, at a device, a first mismatch value indicative of a first amount of a temporal mismatch between a first audio signal and a second audio signal, the first mismatch value associated with a first frame to be encoded;

determining, at the device, a second mismatch value, the second mismatch value indicative of a second amount of a temporal mismatch between the first audio signal and the second audio signal, the second mismatch value associated with a second frame to be encoded, wherein the second frame to be encoded is subsequent to the first frame to be encoded;

determining, at the device, an effective mismatch value based on the first mismatch value and the second mismatch value, wherein the second frame to be encoded includes first samples of the first audio signal and second samples of the second audio signal, and wherein the second samples are selected based at least in part on the effective mismatch value;

selecting, based at least in part on the effective mismatch value, a first coding mode and a second coding mode;

generating, based at least partially on the second frame to be encoded, at least one encoded signal having a bit allocation, the bit allocation at least partially based on the effective mismatch value, wherein the at least one encoded signal is based on a first encoded signal and a second encoded signal, wherein the first encoded signal is based on the first coding mode, and wherein the second encoded signal is based on the second coding mode; and sending the at least one encoded signal to a second device.

27. The method of claim 26, wherein the at least one encoded signal includes the first encoded signal and the second encoded signal, and wherein generating the at least one encoded signal includes:

generating, based on the first coding mode, the first encoded signal based on first samples of the first audio signal and second samples of the second audio signal, wherein the second samples are selected based on the effective mismatch value; and generating, based on the second coding mode, the second encoded signal based on the first samples and the second samples.

28. The method of claim 26, wherein the at least one encoded signal includes the first encoded signal and the second encoded signal, wherein the first encoded signal includes a low-band mid signal, wherein the second encoded signal includes a low-band side signal, and wherein the first coding mode and the second coding mode include an algebraic code-excited linear prediction (ACELP) coding mode.

29. The method of claim 26, wherein the at least one encoded signal includes the first encoded signal and the second encoded signal, wherein the first encoded signal includes a high-band mid signal, wherein the second encoded signal includes a high-band side signal, and wherein the first coding mode and the second coding mode include a bandwidth extension (BWE) coding mode.

30. The method of claim 26, wherein the device comprises a mobile communication device.

31. The method of claim 26, wherein the device comprises a base station.

32. The method of claim 26, further comprising:

generating, based at least in part on the effective mismatch value, an encoded high-band mid signal based on a bandwidth extension (BWE) coding mode, wherein the first encoded signal includes the encoded high-band mid signal; and generating, based at least in part on the effective mismatch value, an encoded high-band side signal based on a blind BWE coding mode, wherein the second encoded signal includes the encoded high-band side signal, wherein the at least one encoded signal includes the first encoded signal and one or more parameters corresponding to the second encoded signal.

33. The method of claim 26, further comprising:

generating, based at least in part on the effective mismatch value, an encoded low-band mid signal and an encoded low-band side signal based on an algebraic code-excited linear prediction (ACELP) coding mode, wherein the first encoded signal includes the encoded low-band mid signal;

generating, based at least in part on the effective mismatch value, an encoded high-band mid signal based on a bandwidth extension (BWE) coding mode, wherein the second encoded signal includes the encoded high-band mid signal; and generating, based at least in part on the effective mismatch value, an encoded high-band side signal based on a blind BWE coding mode, wherein the at least one encoded signal includes the encoded high-band mid signal, the encoded low-band mid signal, the encoded low-band side signal, and one or more parameters corresponding to the encoded high-band side signal.

34. The method of claim 26, wherein the bit allocation indicates that a first number of bits are allocated to the first encoded signal and that a second number of bits are allocated to the second encoded signal.

35. The method of claim 34, wherein the first number of bits is less than a first particular number of bits indicated by a first bit allocation associated with the first frame to be encoded, wherein the second number of bits is greater than a second particular number of bits indicated by the first bit allocation.

36. A computer-readable storage device storing instructions that, when executed by a processor, cause the processor to perform operations comprising:

determining a first mismatch value indicative of a first amount of temporal mismatch between a first audio signal and a second audio signal, the first mismatch value associated with a first frame to be encoded;

determining a second mismatch value indicative of a second amount of temporal mismatch between the first audio signal and the second audio signal, the second mismatch value associated with a second frame to be encoded, wherein the second frame to be encoded is subsequent to the first frame to be encoded;

determining an effective mismatch value based on the first mismatch value and the second mismatch value, wherein the second frame to be encoded includes first samples of the first audio signal and second samples of the second audio signal, and wherein the second samples are selected based at least in part on the effective mismatch value;

selecting, based at least in part on the effective mismatch value, a first coding mode and a second coding mode; and generating, based at least partially on the second frame to be encoded, at least one encoded signal having a bit allocation, the bit allocation at least partially based on the effective mismatch value, wherein the at least one encoded signal is based on a first encoded signal and a second encoded signal, wherein the first encoded signal is based on the first coding mode, and wherein the second encoded signal is based on the second coding mode.

37. The computer-readable storage device of claim 36, wherein the at least one encoded signal includes the first encoded signal and the second encoded signal, wherein the bit allocation indicates that a first number of bits are allocated to the first encoded signal and that a second number of bits are allocated to the second encoded signal.

38. The computer-readable storage device of claim 36, wherein the first encoded signal corresponds to a mid signal and the second encoded signal corresponds to a side signal.

39. The computer-readable storage device of claim 38, wherein the operations further comprise:

generating the mid signal based on a sum of the first audio signal and the second audio signal; and generating the side signal based on a difference between the first audio signal and the second audio signal.

40. An apparatus comprising:

means for determining a first mismatch value indicative of a first amount of temporal mismatch between a first audio signal and a second audio signal, the first mismatch value associated with a first frame to be encoded;

means for determining a second mismatch value indicative of a second amount of temporal mismatch between the first audio signal and the second audio signal, the second mismatch value associated with a second frame to be encoded, wherein the second frame to be encoded is subsequent to the first frame to be encoded;

means for determining an effective mismatch value based on the first mismatch value and the second mismatch value, wherein the second frame to be encoded includes first samples of the first audio signal and second samples of the second audio signal, and wherein the second samples are selected based at least in part on the effective mismatch value;

means for selecting, based at least in part on the effective mismatch value, a first coding mode and a second coding mode; and means for transmitting at least one encoded signal having a bit allocation that is at least partially based on the effective mismatch value, the at least one encoded signal generated based at least partially on the second frame to be encoded, wherein the at least one encoded signal is based on a first encoded signal and a second encoded signal, wherein the first encoded signal is based on the first coding mode, and wherein the second encoded signal is based on the second coding mode.

41. The apparatus of claim 40, wherein the means for determining, the means for selecting, and the means for transmitting are integrated into at least one of a mobile phone, a communication device, a computer, a music player, a video player, an entertainment unit, a navigation device, a personal digital assistant (PDA), a decoder, or a set top box.

42. The apparatus of claim 40, wherein the means for determining, the means for selecting, and the means for transmitting are integrated into a mobile communication device.

43. The apparatus of claim 40, wherein the means for determining, the means for selecting, and the means for transmitting are integrated into a base station.

* * * * *